US007039343B2

(12) United States Patent
Sasaki et al.

(10) Patent No.: US 7,039,343 B2
(45) Date of Patent: May 2, 2006

(54) IMAGE FORMING APPARATUS USING A DEVELOPING LIQUID

(75) Inventors: Tsutomu Sasaki, Kanagawa (JP); Mie Yoshino, Kanagawa (JP); Yusuke Takeda, Kanagawa (JP); Tsuneo Kurotori, Tokyo (JP); Tohru Nakano, Kanagawa (JP); Noriyasu Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/052,222

(22) Filed: Feb. 8, 2005

(65) Prior Publication Data

US 2005/0147423 A1 Jul. 7, 2005

Related U.S. Application Data

(62) Division of application No. 10/812,166, filed on Mar. 30, 2004, now Pat. No. 6,865,359, which is a division of application No. 10/188,818, filed on Jul. 5, 2002, now Pat. No. 6,738,592.

(30) Foreign Application Priority Data

| | | |
|---|---|---|
| Jul. 6, 2001 | (JP) | 2001-206485 |
| Aug. 29, 2001 | (JP) | 2001-259575 |
| Sep. 17, 2001 | (JP) | 2001-281439 |

(51) Int. Cl.
*G03G 15/11* (2006.01)

(52) U.S. Cl. ..... 399/249; 399/45; 399/237; 430/117

(58) Field of Classification Search ..... 399/45, 399/249, 237, 348, 343; 430/117, 125
See application file for complete search history.

(56) References Cited

U.S. PATENT DOCUMENTS

| | | | | |
|---|---|---|---|---|
| 5,809,388 | A | 9/1998 | Inada et al. | 399/320 |
| 5,864,737 | A | 1/1999 | Obu et al. | 399/176 |
| 5,887,219 | A * | 3/1999 | Eom | 399/45 |
| 5,923,930 | A | 7/1999 | Tsukamoto et al. | 399/237 |
| 5,937,247 | A | 8/1999 | Takeuchi et al. | 399/237 |
| 5,987,281 | A | 11/1999 | Kurotori et al. | 399/237 |
| 6,038,421 | A | 3/2000 | Yoshino et al. | 399/239 |
| 6,061,540 | A | 5/2000 | Takeda | 399/237 |
| 6,108,508 | A | 8/2000 | Takeuchi et al. | 399/238 |
| 6,115,576 | A | 9/2000 | Nakano et al. | 399/302 |
| 6,131,001 | A | 10/2000 | Tsukamoto et al. | 399/57 |

(Continued)

FOREIGN PATENT DOCUMENTS

JP 08-297418 A * 11/1996

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus configured to use a highly viscous, dense developing liquid including a carrier liquid and toner. The apparatus includes a developing unit with a developer carrier and a coating member for coating the developing liquid on the developer carrier. The developer carrier conveys the liquid to a developing zone where it faces an image carrier to develop a latent image on the image carrier. In the developing zone, the toner is caused to move toward the image by electrophoresis to form a toner layer in which the toner is present in the carrier liquid and a carrier layer in which the toner is absent. When the developer carrier and image carrier are moved from each other, the toner moves toward the image such that the developing liquid separates at the boundary between the toner and carrier layers.

36 Claims, 36 Drawing Sheets

U.S. PATENT DOCUMENTS

| | | | | |
|---|---|---|---|---|
| 6,134,394 | A | 10/2000 | Tsukamoto et al. | 399/30 |
| 6,154,624 | A | 11/2000 | Sasaki et al. | 399/250 |
| 6,236,825 | B1 | 5/2001 | Takeuchi | 399/237 |
| 6,305,860 | B1 * | 10/2001 | Park | 399/249 X |
| 6,337,963 | B1 | 1/2002 | Kusayanagi | 399/237 |
| 6,405,008 | B1 | 6/2002 | Obu et al. | 399/237 |
| 6,445,897 | B1 | 9/2002 | Uezono et al. | 399/237 |
| 6,466,757 | B1 | 10/2002 | Itaya et al. | 399/249 |
| 6,650,856 | B1 | 11/2003 | Ahn et al. | 399/237 |
| 6,735,408 | B1 | 5/2004 | Yoshino et al. | 399/237 |
| 2001/0021323 | A1 * | 9/2001 | Itaya et al. | 399/237 |
| 2001/0026713 | A1 * | 10/2001 | Nishikawa | 399/249 |
| 2002/0098016 | A1 | 7/2002 | Kurotori et al. | 399/237 |
| 2002/0110390 | A1 | 8/2002 | Park et al. | 399/237 |
| 2002/0197083 | A1 * | 12/2002 | Yoshino et al. | 399/237 |

FOREIGN PATENT DOCUMENTS

| | | |
|---|---|---|
| JP | 2001-228717 | 8/2001 |
| JP | 2002-031956 A * | 1/2002 |

* cited by examiner

FIG. 7

| | SWEEP ROLLER NIP ( 2mm ) | |
|---|---|---|
| | AFTER SWEEP ROLLER ( mg/cm² ) | AFTER DEVELOPING ROLLER ( mg/cm² ) |
| BACKGROUND | 0.17 | 0.38 |
| IMAGE | 0.52 | 0.68 |

FIG. 11

| DEVELOPMENT RATIO | LUMP GENERATION RANK |
|---|---|
| 50% | 5 |
| 40% | 5 |
| 30% | 4 |
| 20% | 4 |
| 10% | 3 |
| 0% | 1 |

FIG. 16

| ELECTRIC FIELD V/m | LUMP GENERATION RANK 5 : NONE ~ 1 : MANY LUMPS | BACKGROUND DENSITY |
|---|---|---|
| 0 | 5 | BAD |
| 1.00E + 07 | 5 | STAIN |
| 1.50E + 07 | 5 | STAIN |
| 2.00E + 07 | 4 | STAIN |
| 2.50E + 07 | 4 | STAIN |
| 3.00E + 07 | 3 | STAIN |
| 3.50E + 07 | 2 | CLEAR |
| 4.00E + 07 | 2 | CLEAR |
| 5.00E + 07 | 1 | CLEAR |

FIG. 20

| ELECTRIC FIELD V/m | LUMP GENERATION RANK 5 : NONE ~ 1 : MANY LUMPS | BACKGROUND DENSITY |
|---|---|---|
| 0 | 5 | BAD |
| 1.00E + 07 | 5 | STAIN |
| 1.50E + 07 | 5 | STAIN |
| 2.00E + 07 | 5 | CLEAR |
| 2.50E + 07 | 5 | CLEAR |
| 3.00E + 07 | 5 | CLEAR |
| 3.50E + 07 | 4 | CLEAR |
| 4.00E + 07 | 4 | CLEAR |
| 5.00E + 07 | 3 | CLEAR |

IMAGE FORMING APPARATUS USING A DEVELOPING LIQUID

BACKGROUND OF THE INVENTION

1. Field of the Invention

The present invention relates to a copier, printer, facsimile apparatus or similar image forming apparatus and more particularly to an image forming apparatus of the type including at least one developer carrier configured to carry a high viscosity, high density developing liquid, which consists of a carrier liquid and toner dispersed therein, and developing a latent image formed on an image carrier with the developer carrier deposited on the developer carrier.

2. Description of the Background Art

Japanese Patent Laid-Open Publication No. 7-239615 and Japanese Patent Application No. 11-38447, for example, each discloses an image forming system including a developer carrier formed with an elastic layer thereon and held in contact with an image carrier to form a nip. A developing liquid consisting of a carrier liquid and toner dispersed therein is deposited on the developer carrier in the form of a thin layer. The carrier liquid and toner in the thin layer are electrostatically transferred to a latent image formed on the image carrier at the nip.

In the image forming system described above, toner grains deposit on the latent image of the image carrier at the nip while, at the same time, the carrier liquid deposited on the carrier grains also moves toward the image carrier. This brings about a problem that not only the toner grains but also the excess carrier liquid deposit on the latent image, aggravating the consumption of the carrier liquid. Moreover, the excess carrier liquid increases the running cost of the system, and its amount effects the fixation of the toner on a sheet.

As for the background or non-image portion of the image carrier, it is a common practice to transfer some carrier liquid to the background at the nip while preventing the toner from depositing on the background. When the toner is deposited on the background, it is caused to move toward the developer carrier and removed thereby within the nip. However, the toner is apt to deposit on the background of the image carrier in spite of such an expedient and remain on the image carrier even after the image carrier has moved away from the nip, constituting residual toner.

To obviate residual toner, it has been customary to form a strong electric field between the background of the image carrier and the developer carrier (background electric field hereinafter), thereby preventing the toner from depositing on the background. The background electric field obviates toner deposition on the background more positively as it becomes stronger. For the same purpose, Japanese. Patent Application No. 2000-42582 proposes to use a removing member and forms an electric field between the background and the removing member (removal electric field hereinafter). The removal electric field attracts floating residual toner toward the removing member away from the image carrier, thereby protecting a toner image from fog ascribable to the residual toner.

The problem with the background electric field is that when it is intensified, a force pressing the residual toner in the non-image portion against the developer carrier grows stronger. It even occurs that the background electric field is excessively intensified for the purpose of obviating toner deposition on the background, causing the toner pressed against the developer carrier to cohere. This is also true with the removal electric field scheme; that is, the stronger the removal electric field, the more the residual toner attracted toward the removing member coheres. The cohered toner has a grain size larger than the original grain size and cannot faithfully reproduce thin lines when reused for development. It is therefore desirable to prevent the residual toner from cohering.

In the image forming apparatus of the type described, to transfer the toner image from the image carrier to a sheet, an image transfer roller causes the sheet to contact the toner image on the image carrier while a bias opposite in polarity to the toner image is applied to the image transfer roller. At this instant, assume that the developer layer formed on the image carrier is excessively thick, i.e., the amount of the carrier liquid or that of the toner is excessive. Then, even when the sheet is brought into contact with the surface of the image carrier, the developer carrier and sheet often fail to closely contact each other, resulting in a short toner transfer ratio, the blurring of an image or the thickening of characters. Moreover, carrier liquid consumption is aggravated and increases the running cost. On the other hand, if the amount of the carrier liquid is short, then image transfer using electrophoresis is obstructed with the result that image density is lowered over the entire image or in part of an image corresponding to the recesses of the irregular surface of a sheet or the entire image.

It has been proposed to leave an adequate amount of carrier liquid that does not bring about the problems described above, and sweep the excessive carrier liquid with a sweep roller or similar excess liquid removing means.

Today, various kinds of sheets are available as a recording medium applicable to an image forming apparatus of the type described. As for full-color image formation, in particular, the application of a coated sheet covered with a coating layer for enhancing whiteness and smoothness is in study. If process conditions for image formation are fixedly applied to all of various kinds of sheets, then the problems stated above are likely to become more conspicuous, depending on the kind of sheets.

More specifically, assume that use is made of a sheet absorbing the carrier liquid little, a sheet having a smooth surface or a sheet coated with a relatively large amount of coating material, and that the conventional fixed process conditions assigned to plain copy sheets having a rough surface and easily absorbs the carrier liquid each. Then, the thickening of characters and the blurring of the trailing edge of a solid image are conspicuous, as determined by experiments. When some of the process conditions are varied to free an image from the above defects, other problems occur when use is made of a sheet easily absorbing the carrier liquid, a sheet having a rough surface or a sheet coated with a relatively small amount of coating material, as also determined by experiments. Fore example, the resulting image is low in image density over its entire area or in portions corresponding to the recesses of the irregular surface of a sheet or is practically lost in such portions.

To cope with various kinds of sheet, Japanese Patent Laid-Open Publication No. 8-297418, fire example, disposes a liquid film control system using excess liquid removing means whose liquid removing force is variable and switching the liquid removing force in accordance with the property of a sheet. The variable liquid removing force controls the thickness of a liquid film. The excess liquid removing means is implemented as a squeeze roller or a slit nozzle. The squeeze roller is positioned to face the surface of an image carrier at a preselected distance and rotatable in the same direction as the image carrier. The slit nozzle is also positioned to face the surface of the image carrier at a preselected distance and sends compressed air toward the image carrier. Such a liquid film control system is effective when use is made of low viscosity, low density developing liquid, e.g., a developing liquid with viscosity of about 1 mPa·s and consisting of an insulative carrier liquid Isopar (trade name) available from Exxon and 1 wt % to 2 wt % of toner.

Recently, replacing the conventional low viscosity, low density developing liquid with a high viscosity, high density developing liquid has been proposed. A developing liquid with high viscosity and high density has viscosity of about 50 mPa·s to 10,000 mPa·s and consisting of silicone oil, normal paraffin, Isopar M (trade name) also available from Exxon, vegetable oil, mineral oil or similar carrier liquid and 5 wt % to 40 wt % of toner. The liquid film control method stated earlier cannot easily control the film of such a developing liquid that is highly viscous and deposits on the image carrier only in a small amount. For example, compressed air sent from the slit nozzle cannot easily remove the developing liquid due to high viscosity. Further, because the highly dense developing liquid is left on the image carrier in the form of a thin film after development, it is difficult to cause the squeeze roller spaced from the image carrier to contact the carrier liquid layer on the image carrier for mechanical accuracy reasons.

SUMMARY OF THE INVENTION

It is a first object of the present invention to provide an image forming apparatus capable of reducing the consumption of a carrier liquid and enhancing desirable fixation by reducing the amount of carrier liquid to deposit on the image portion of an image carrier.

It is a second object of the present invention to provide an image forming apparatus capable of preventing, in a construction wherein an electric field is used to remove residual toner from the background of an image carrier, the residual toner removed from the background from cohering.

It is a third object of the present invention to provide an image forming apparatus capable of forming desirable images on various kinds of sheets with a high viscosity, high density developing liquid, and a liquid film control method for the same.

In accordance with the present invention, an image forming apparatus using a high viscosity, high density developing liquid consisting of a carrier liquid and toner dispersed in said carrier liquid includes an image carrier. A latent image forming device forms a latent image on the image carrier while a developing unit develops the latent image to thereby produce a corresponding toner image. An image transferring unit transfers the toner image from the image carrier to a recording medium. A fixing unit fixes the toner image directly or indirectly transferred to the recording medium. The developing unit includes at least one developer carrier for depositing the developing liquid thereon and a coating member for coating the developing liquid on the developer carrier. The developer carrier conveys the developing liquid to a developing zone where it faces the image carrier to thereby cause the developing liquid to develop the latent image formed on the image carrier. In the developing zone, the toner in the developing liquid, which faces the image portion of the image carrier where the latent image is formed, is caused to move toward the image portion by electrophoresis to thereby form a toner layer in which the toner is present in the carrier liquid and a carrier layer in which the toner is absent in the carrier liquid. When the developer carrier and image carrier moved away from the developing zone part from each other, the toner is caused to move toward the image portion over a degree at which the developing liquid can separate at the boundary between the toner layer and the carrier layer.

BRIEF DESCRIPTION OF THE DRAWINGS

The above and other objects, features and advantages of the present invention will become more apparent from the following detailed description taken with the accompanying drawings in which:

FIG. 7 is a table listing experimental results relating to the removal of a carrier liquid from the drum;

FIG. 11 a table showing a relation between the development ratio of the background and the cohesion of toner;

FIG. 16 is a table listing experimental results relating to the cohesion of toner;

FIG. 20 is a table listing experimental results relating to the cohesion of toner and background density;

DESCRIPTION OF THE PREFERRED EMBODIMENTS

Figure 1:
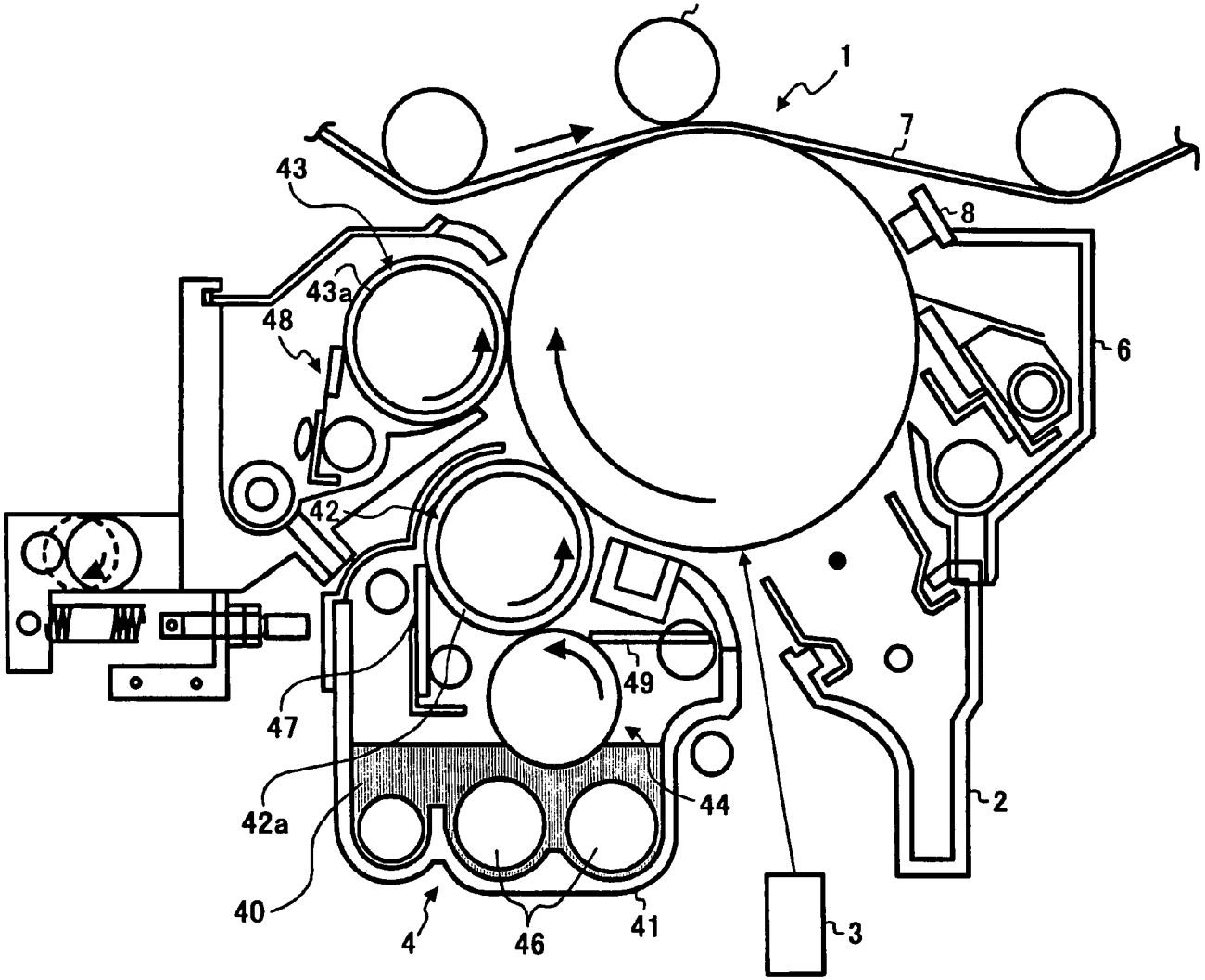
FIG. 1 is a front view showing a first embodiment of the image forming apparatus in accordance with the present invention.

Preferred embodiments of the image forming apparatus in accordance with the present invention will be described hereinafter. It is to be noted that identical reference numerals used in the illustrative embodiments do not always designate identical structural parts.

First Embodiment

This embodiments is directed toward the first object stated earlier. Generally, in an image forming apparatus of the type using a developing liquid, a latent image is formed on an image carrier whose surface endlessly moves. In a developing zone between the latent image carrier and a developer carrier, the latent image is developed by a developer deposited on the developer carrier and becomes a toner image. More specifically, in the developing zone, toner forming part of the developing liquid electrostatically moves toward the image carrier and deposits on the latent image in the form of a toner layer. A carrier liquid forming the other part of the developing liquid moves toward the developer carrier due to reaction to the migration of the toner, forming a carrier liquid layer.

Assume that the thickness of the toner layer is smaller than preselected thickness at the outlet of the developing zone where the developer carrier and image carrier part from each other. In this condition, we experimentally found that the developing liquid separated around the boundary between the toner layer and the carrier liquid layer with the result that the toner layer and carrier liquid layer deposited on the image carrier and developer carrier, respectively. This was true not only in the image portion of the image carrier but also in the non-image portion of the same. Conversely, as for the non-image or background portion, when the developing liquid separates at the position mentioned above, the toner layer and carrier liquid layer deposit on the developer carrier and image carrier, respectively. It is therefore preferable to make the toner layer thick and the carrier liquid layer thin in the non-image portion.

Referring to FIG. 1 of the drawings, the first embodiment of an image forming apparatus in accordance with the present invention is shown and implemented as an electrophotographic printer by way of example. As shown, the printer includes a photoconductive drum 1, which is a specific form of an image carrier. Arranged around the drum 1 are a charger 2, an optical writing unit 3, a developing unit 4 including a developing roller and a sweep roller, an image transferring unit 5, a secondary image transferring unit, not shown, and a cleaning unit 6. The drum 1 may be formed of, e.g., a-Si (amorphous silicon) or OPC (Organic Photo Conductor). The optical writing unit 3 may include an LED (Light Emitting Diode) array or laser optics by way of example.

The printer with the above configuration forms a toner image by the following negative-to-positive development procedure by way of example. A motor or similar drive means, not shown, causes the drum 1 to rotate at a constant speed in a direction indicated by an arrow. The charger 2 uniformly charges the surface of the drum 1 in rotation to about 600 V in the dark. The optical writing unit 3 scans the charged surface of the drum 1 in accordance with image data to thereby form a latent image on the drum 1. The developing unit 4 develops the latent image being conveyed by the drum 1, thereby producing a corresponding toner image. The image transferring unit 5 transfers the toner image from the drum 1 to an intermediate image transfer body 7. The secondary image transferring unit transfers the toner image from the intermediate image transfer body 7 to a sheet or recording medium. The sheet with the toner image is driven out of the printer via a fixing unit not shown. After the image transfer from the drum 1 to the intermediate image transfer body 7 (primary transfer), a quenching lamp 8 discharges the surface of the drum 1, and then the cleaning unit 6 removes the toner left on the drum 1 to thereby prepare the drum 1 for the next printing cycle.

For the image transferring device 5, use may be made of any one of conventional methods including one using an electrostatic roller, one using corona discharge, and one using adhesion transfer. Likewise, for the secondary image transferring unit, use may be made of, e.g., the method using an electrostatic roller, the method using corona discharge, the method using adhesion transfer or a thermal transfer method. Further, the fixing unit may be implemented by, e.g., a thermal fixing system, a solvent fixing system or a pressure fixing system.

The developing liquid, labeled 40 in FIG. 1, applicable to the illustrative embodiment is a high viscosity, high density developing liquid as distinguished from an ordinary low viscosity (about 1 cSt), low density (about 1%) developing liquid containing Isoper mentioned earlier as a carrier liquid. The highly viscous, dense developing liquid has viscosity ranging from 50 cSt to 5,000 cSt and density ranging from 5% to 40% by way of example. A carrier liquid is implemented by silicone oil, normal paraffin, Isopar M (trade name) also available from Exxon, vegetable oil, mineral oil or similar highly insulative material. The carrier liquid may be either volatile or nonvolatile, depending on the application. The toner may have any grain size between submicrons and 6 μm so long as it matches with the application.

As shown in FIG. 1, the developing unit 4 includes a tank 41 storing the developer 40, a developing roller 42, a sweep roller 43, Anilox roller or coating means 44, and agitators 46 implemented as a screw. Cleaning members 47 and 48 implemented as metal blades or rubber blades are associated with the developing roller 42 and sweep roller 43, respectively. The blades may be replaced with rollers, if desired. A doctor blade 49 is associated with the Anilox roller 44.

A conductive elastic layer 42*a* is formed on the circumference of the developing roller 42, and may be formed of urethane rubber. The elastic layer 42*a* should preferably have rubber hardness of 50° or below in terms of JIS (Japanese Industrial Standards) A scale. Urethane rubber forming the elastic layer 42*a* may, of course, be replaced with any other suitable material that is conductive and does not swell or dissolve on contacting a solvent. The elastic layer 42*a* may be formed on the drum 1 instead of on the developing roller 42, if desired. Further, the drum 1 may be implemented as an endless belt.

When the developing roller 42 is pressed against the drum 1 by adequate pressure, the elastic layer 42*a* elastically deforms and forms a development nip between it and the drum 1. The development nip guarantees a preselected developing time long enough for the toner of the developing liquid 40 to move toward and deposit on the drum 1 under the action of an electric field formed in the developing zone. By adjusting the pressure to act between the developing roller 42 and the drum 1, it is possible to control the width of the development nip. The width of the development nip is selected to be larger than the product of the linear velocity of the developing roller 42 and a time constant for development, which refers to a period of time necessary for the amount of development to saturate and is produced by dividing the nip width by a process speed. For example, if the nip width is 2 mm and if the process speed is 300 mm/sec, then the time constant for development is about 7 milliseconds.

During development, the Anilox roller 44 coats the developing liquid 40 on the developing roller 42 in the form of a thin layer. In the illustrative embodiment, the Anilox roller 44 coats the developing liquid 40 such that the pigment content of the toner deposited on the developing roller 42 is 4 μg or above, but 40 μg or below for a unit area of 1 $cm^2$. For this purpose, the Anilox roller 44 coats the developing liquid 40 in a layer whose thickness is between 5 μm and 10 μm. If the pigment content of the toner deposited on the developing roller 42 for the unit area of 1 $cm^2$ is smaller than 4 μg, then the pigment is likely to fail to move to the image portion of the latent image formed on the drum 1 in a sufficient amount, resulting in short image density. If the pigment content of the toner is larger than 40 μg, then the toner is apt to remain in the non-image portion or background after development in an excessive amount, resulting in fog or background contamination.

The developing liquid 40 forming a thin layer on the developing roller 42 is brought to the development nip between the drum 1 and the developing roller 42. Generally, in a developing device for an electrophotographic process, the surface of a developing roller is moved at a higher speed than the surface of a photoconductive drum in order to convey a sufficient amount of toner to a developing zone between the roller and the drum. The toner therefore moves at a higher speed than the surface of the drum and is therefore shifted relative to a latent image formed on the drum. This causes the leading edge of an image to be blurred or brings vertical lines and horizontal lines out of balance. This is also true with development using a developing liquid. By contrast, in the illustrative embodiment, the surface of the developing roller 42 and that of the drum 1 move at substantially the same speed in order to prevent the toner from having a speed vector in the tangential direction of the drum 1, thereby obviating the above defective images.

Figure 2A:
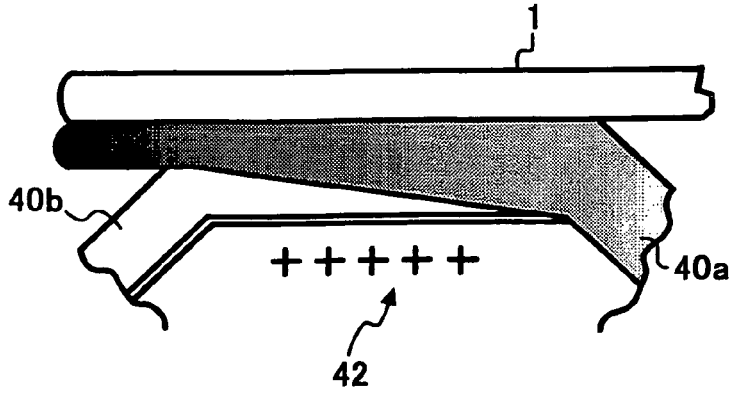
FIGS. 2A through 2C show different conditions of a developer brought to a development nip.
Figure 2B:
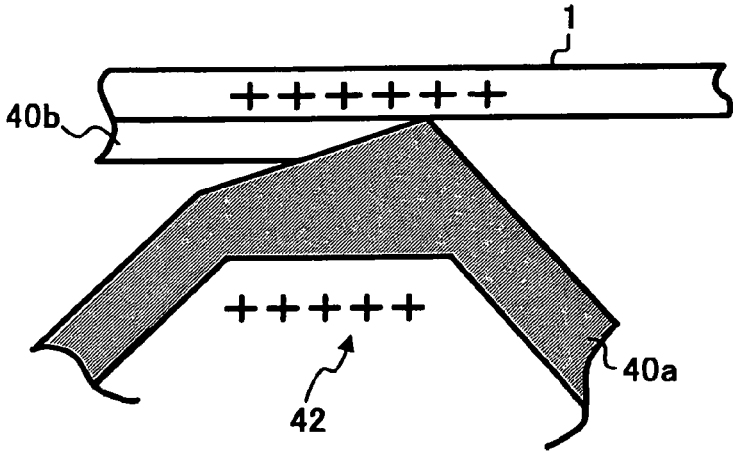
Figure 2C:
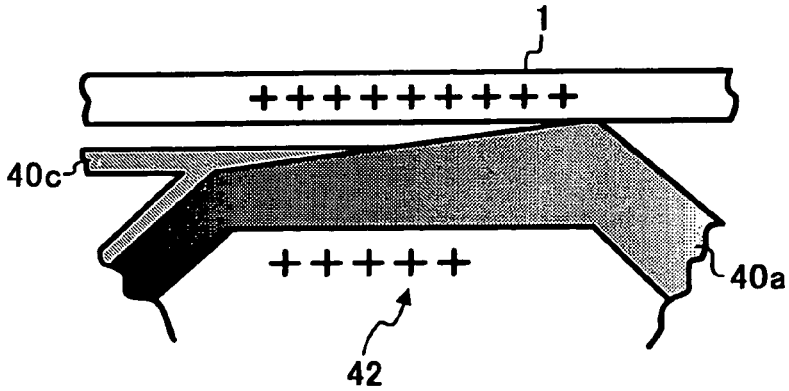

A bias for development (400 V) lower than the surface potential (600 V) of the drum 1 is applied to the developing roller 42. The bias forms an electric field between the developing roller 42 and the image portion of the drum 1 lowered in potential to 50 V or below by the optical writing unit 3. FIGS. 2A through 2C show the conditions of the developing liquid 40 at the development nip. As shown in FIG. 2A, toner 40*a* contained in the developer 40 moves to the drum 1 due to the above electric field and develops on a latent image (image portion). As shown in FIG. 2B, in a non-image or background portion, the electric field formed by the bias and the potential of the drum 1 causes the toner 40*a* to move toward the developing roller 42 for thereby preventing it from depositing on the non-image portion.

However, as shown in FIG. 2B, some carrier liquid 40*b* deposits on the background of the drum 1 moved away from the nip. This part of the carrier liquid 40*b* is transferred to the intermediate image transfer body 7 or removed by the cleaning unit 6. The carrier liquid 40*b* removed by the cleaning unit 6 is processed by a processing device, not shown, and again used. However, the carrier liquid 40*b* deposited on the intermediate image transfer body 7 is transferred to a sheet and consumed thereby, increasing the running cost of the printer. While the carrier liquid 40*b* should preferably be prevented from depositing on the background of the drum 1, it is difficult to fully prevent the former from depositing on the latter. Moreover, the carrier liquid 40*b* deposits on the image portion of the drum 1 together with the toner 40*a*.

In light of the above, toner grains dispersed in the developing liquid and expected to move from the developing roller 42 to the drum 1 optimize the electric field for the development of a latent image. This successfully reduces the amount of carrier liquid to deposit on the toner grains that are to deposit on the drum 1.

Figure 3:
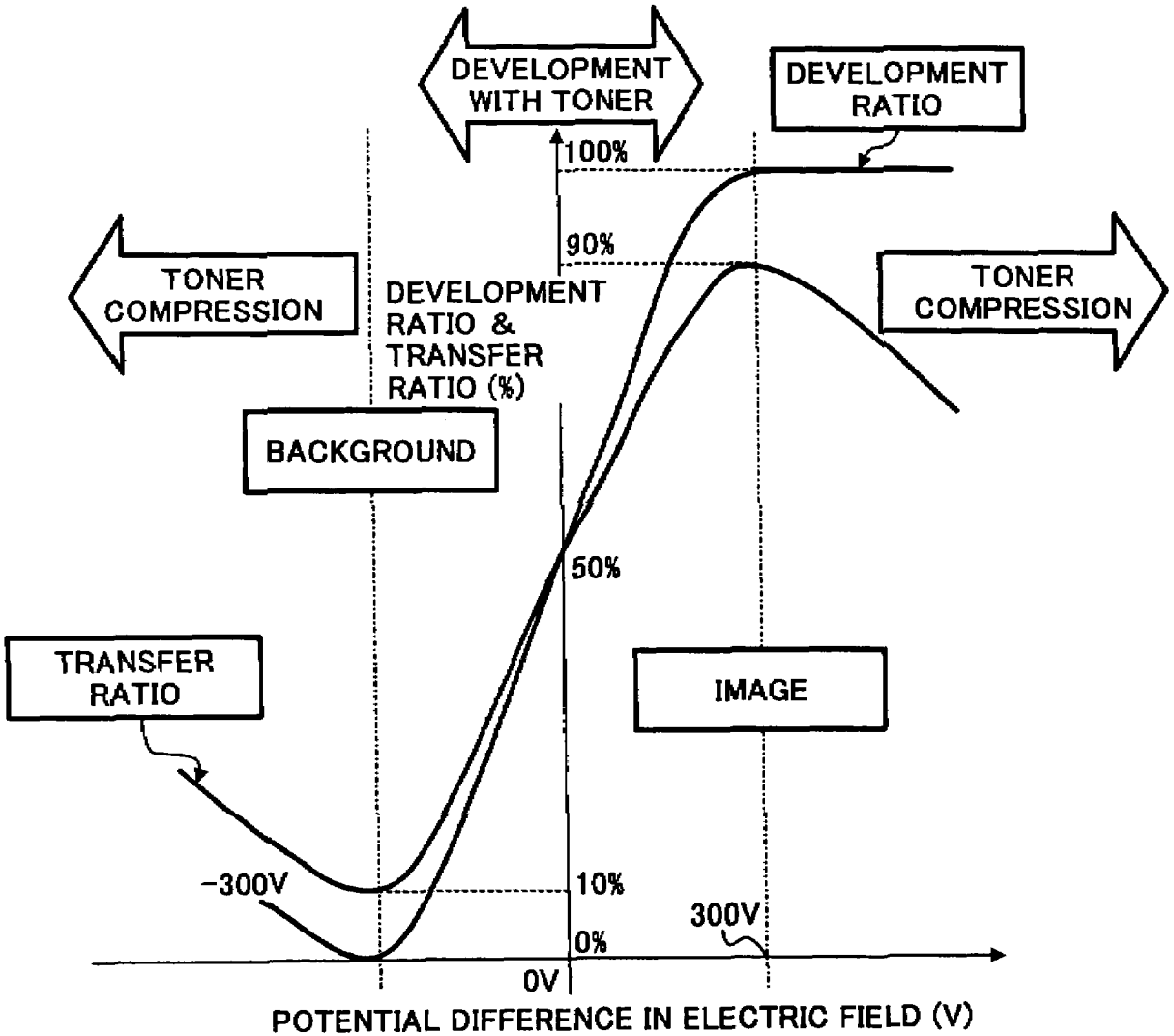
FIG. 3 is a graph showing a development ratio and an image transfer ratio determined by setting up a potential difference at each of an image portion and a background or non-image portion.

More specifically, as shown in FIG. 3, assume a space for development formed by the developing liquid brought to the nip between the drum 1 and the developing roller 42. As for the image portion of the drum 1, substantially the entire toner grains have moved from the developing roller 42 to the drum 1 when the potential difference in the electric field is 300 V in the above space. At this instant, the transfer ratio in the image portion is close to the maximum transfer ratio (about 90%). Therefore, when the potential difference is further increased, the transfer ratio in the image area decreases. The transfer ratio is expressed as:

$$\text{transfer ratio} = \text{amount of developer deposited on drum} / \text{amount of developer coated on roller} \quad (1)$$

It follows that when the potential difference is increased from 300 V little by little, the toner grains deposited on the image portion of the drum 1 more strongly cohere and force out the carrier liquid before development ends. In the illustrative embodiment, the a-Si drum 1 and developing roller 4.2 had an outside diameter of 60 mm and an outside diameter of 20 mm, respectively, and were caused to rotate at substantially the same speed. Although the surface of the developing roller 42 is covered with a PFA tube or similar parting layer, the developing liquid separates, in the absence of an electric field, toward the developing roller 42 by substantially 50% and toward drum 1 by substantially 50% at the outlet of the nip.

Figures 4A, 4B:
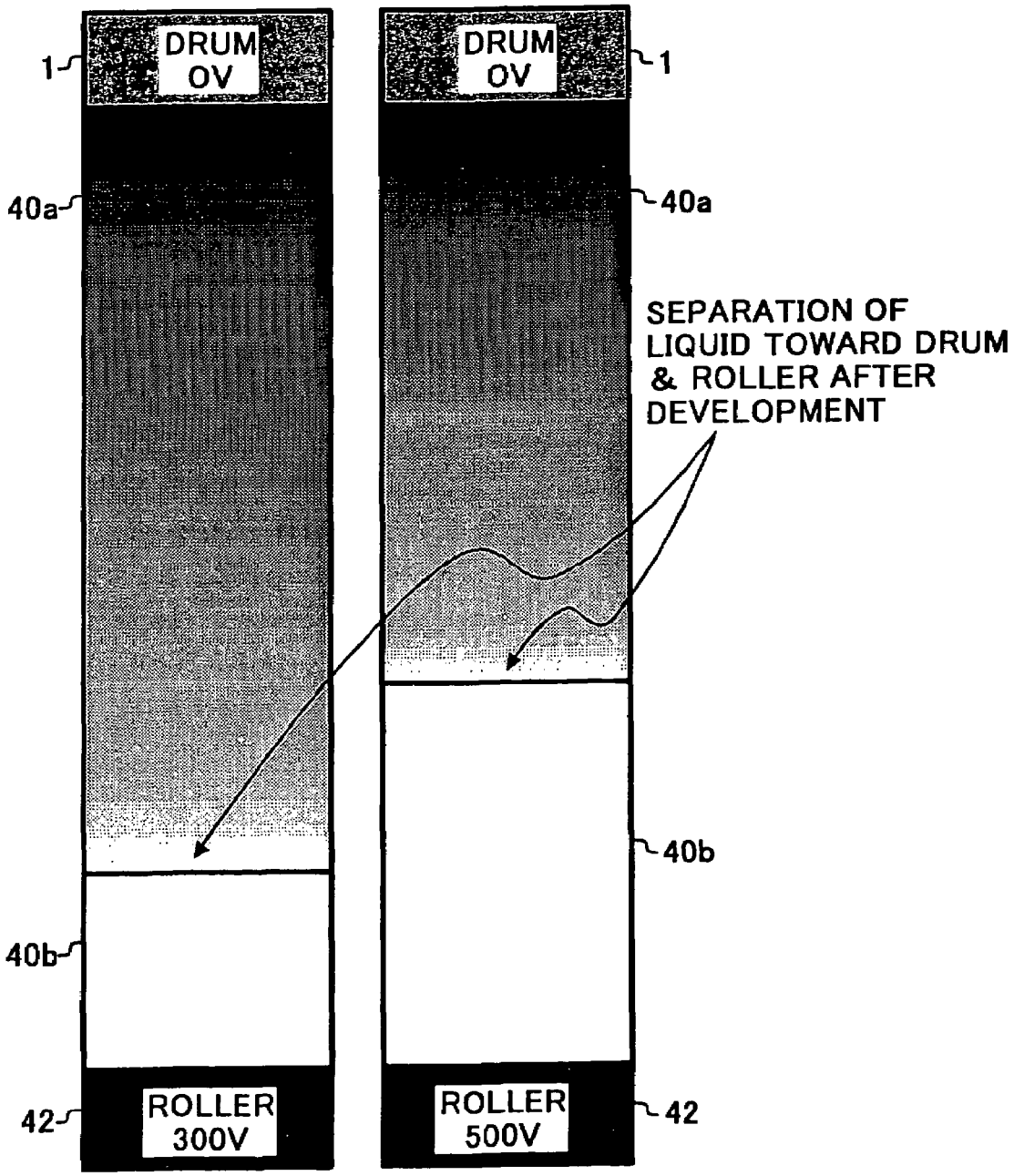
FIGS. 4A and 4B demonstrate how a developer lying in a development space separates, in an image portion, after development at a position where a developing roller parts from a photoconductive drum.

FIGS. 4A and 4B demonstrate how the developing liquid separates in the space for development at the position where the developing roller 42 parts from the drum 1. In a specific condition shown in FIG. 4A, when the bias applied to the developing roller 42 is 300 V and the potential of the drum 1 is 0 V, substantially 100% of the toner grains have fully moved to the drum 1 by electrophoresis, but about 80% of the developing liquid has been transferred to the drum 1; the transfer ratio is about 80%. In light of this, as shown in FIG. 4B, when the bias applied to the developing roller 42 is raised to 500 V in order to further strengthen the electric field, the transfer ratio is lowered to about 60%. More specifically, in such a strong electric field, the toner grains more strongly cohere together while sufficiently forcing out the carrier liquid present therebetween and thereby lowers the transfer ratio. In addition, such cohesion of the toner grains implements a high-resolution image.

Moreover, when the fixing unit fixes the toner image on a sheet, the illustrative embodiment causes a minimum amount of carrier liquid 40*b* present in the image portion to be transferred to the sheet. As a result, adhesion acting between the toner grains, which are formed of resin, or the adhesion acting between the toner grains and the sheet increases, enhancing stable fixation.

The effect described above occurs on the background of the drum 1 also. However, to prevent the carrier liquid from depositing on the drum 1, a strong electric field is not formed in the background portion. More specifically, as shown in FIG. 3, when the potential difference in the background portion is −300 V, the development ratio is substantially 0%, but the transfer ratio is close to the minimum transfer ratio (about 10%). Should the potential difference be further increased, the cohesion of the toner grains on the developing roller 42 would become stronger to increase the transfer ratio and would thereby increase the amount of carrier liquid to deposit on the drum 1, aggravating the consumption of the carrier liquid. The transfer ratio in the background portion should preferably be 40% or below and as low as possible. It follows that when the potential difference in the background portion is −300 V, the deposition of the carrier liquid on the drum 1 and therefore the consumption of the carrier liquid can be substantially minimized. Further, the developing liquid collected can be repeatedly used because the toner grains do not cohere on the developing roller.

To achieve the same advantage, the developing time may be extended. In the illustrative embodiment, the developing time is selected to be about 7 milliseconds. A long developing time allows the toner grains deposited on the drum 1 to further strongly cohere together while forcing out the carrier liquid present therebetween.

Figure 5:
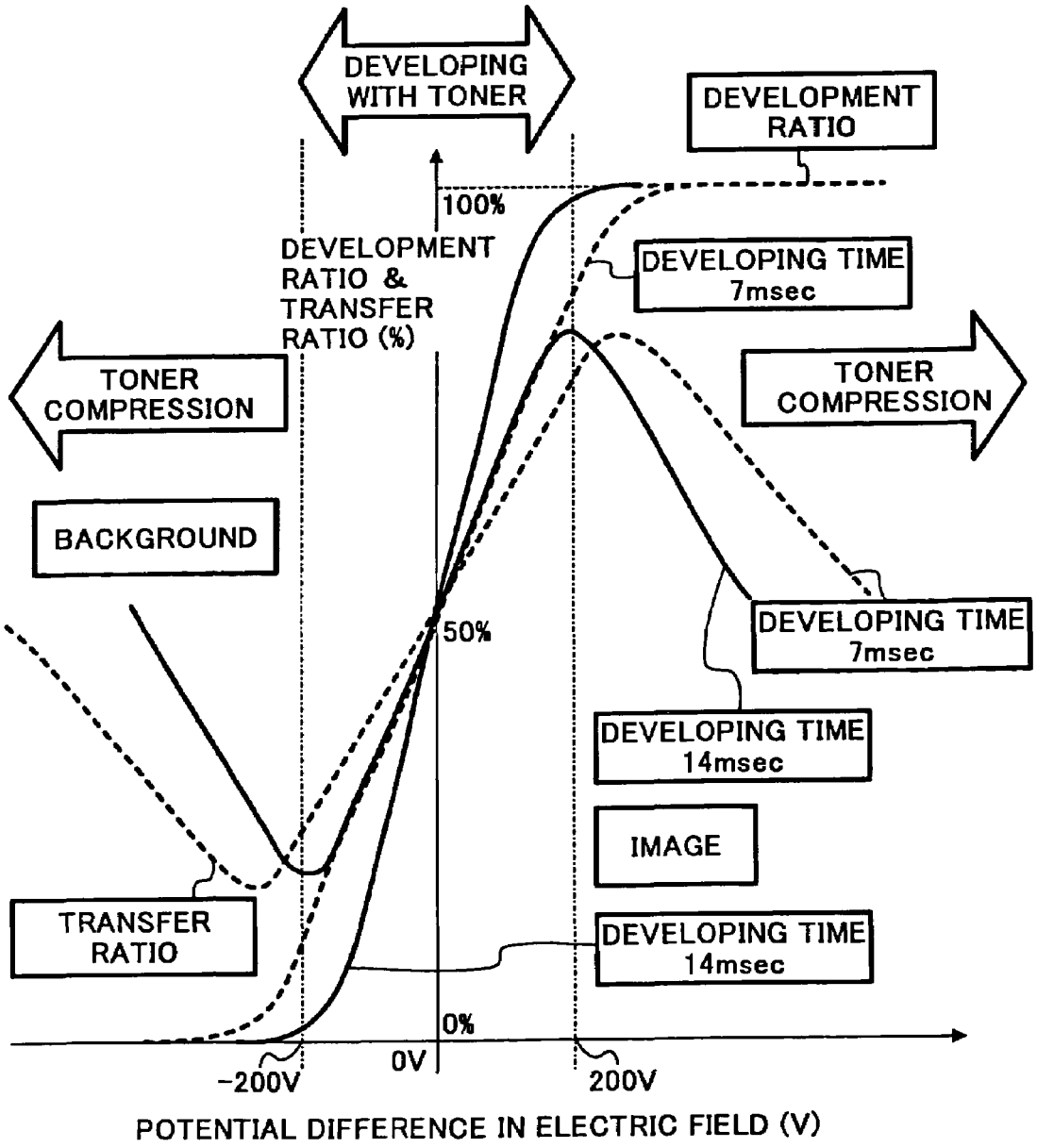
FIG. 5 is a graph showing a development ratio and an image transfer ratio with respect to developing times of 7 milliseconds and 14 milliseconds.

FIG. 5 shows a relation between the developing ratio and the transfer ratio with respect to the developing times of 7 milliseconds and 14 milliseconds. A potential difference that forms an electric field for allowing the toner to sufficiently move by electrophoresis is selected to be 200 V; a potential difference above 200 V further promotes the cohesion of the toner grains on the image portion of the drum 1, implementing a toner image with a minimum of carrier liquid. When the developing time is 7 milliseconds, a potential allowing the toner grains to fully move to the drum 1 is 300 V. As for the developing time of 14 milliseconds, the cohesion of the toner grains is further intensified when the potential difference is 300 V, more positively forcing out the carrier liquid present between the toner grains. This is successful to reduce the amount of carrier liquid to deposit on the drum 1.

Because the electric field in the background portion is weak, some toner grains and some carrier liquid are caused to deposit on the drum 1. In the illustrative embodiment, the sweep roller 43 is positioned downstream of the developing roller 42 in the direction of rotation of the drum 1 and pressed against the drum 1. The surface of the sweep roller 43 moves at substantially the same speed as the surface of the drum 1 and sweeps the toner grains 40*a* and carrier liquid 40*b* deposited on the non-image portion of the drum 1.

More specifically, an elastic layer 43*a* is formed on the circumference of the sweep roller 43 and may be formed of urethane rubber or similar material that does not swell or dissolve on contacting a solvent. The elastic layer 43*a* should preferably have rubber hardness of 50° or above in JIS A scale. The sweep roller 43 is provided with surface smoothness (Rz) of 3 μm or less by means of coating or a tube. The elastic layer 43*a* may be formed on the drum 1 instead of on the sweep roller 43, if desired.

When the sweep roller 43 is pressed against the drum 1 by adequate pressure, the elastic layer 43*a* elastically deforms and forms a sweep nip between it and the drum 1. By controlling the above pressure, it is possible to control the width of the sweep nip in the direction of movement.

The surface of the sweep roller 43 moves substantially at the same speed as the surface of the drum 1, as stated above. Therefore, the toner deposited on the drum 1 is prevented from having a vector in the tangential direction of the drum 1. The sweep roller 43 can therefore remove excessive part of the carrier liquid 40*b* without disturbing a toner image formed on the drum 1.

Figure 6:
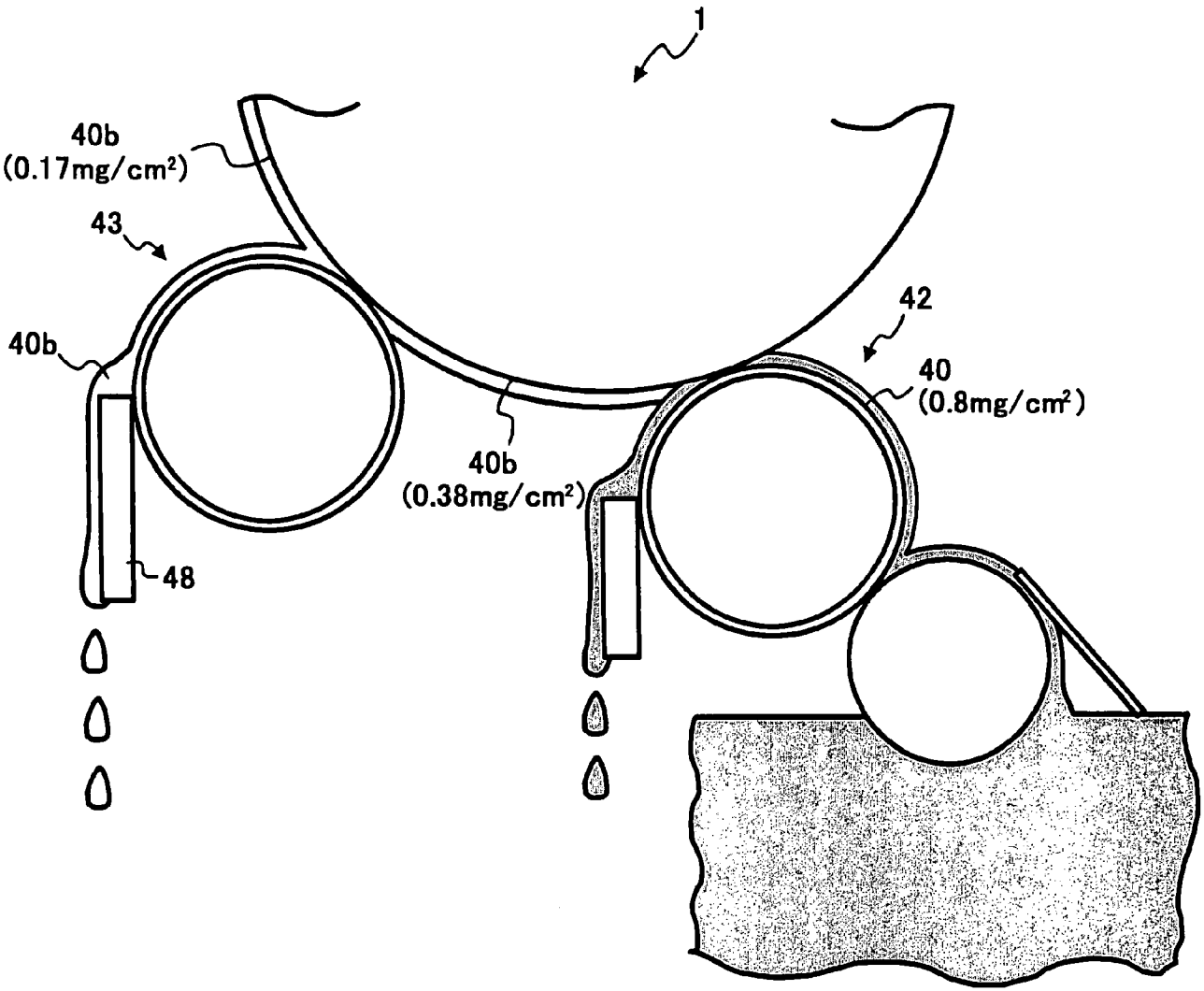
FIG. 6 is an enlarged view showing a removal nip.

FIG. 6 shows how the sweep roller 43 removes the carrier liquid 40*b* deposited on the background of the drum 1 more specifically. FIG. 7 is a table listing experimental results relating to the removal of the carrier liquid 40*b* with the sweep roller 43. For experiments, the sweep roller 43 was provided with an outside diameter of 24 mm while the elastic layer 43*a* was provided with rubber hardness of 20° (JIS A scale). Also, the drum 1 was provided with an outside diameter of 80 mm while the sweep nip between the sweep roller 43 and the drum 1 was selected to be 2 mm wide.

In FIG. 6, when the developing liquid 40 is deposited on the developing roller 42 in an amount of 0.8 mg/cm$^2$, the carrier liquid 40*b* deposits on the background of the drum 1 moved away from the development nip in an amount of 0.38 mg/cm$^2$. The amount of the carrier liquid 40*b* decreases to 0.17 mg/cm$^2$ when moved away from the sweep nip, meaning that the sweep roller 43 removes the carrier liquid 40*b* by an amount of 0.21 mg/cm$^2$ that is about one-half of the amount deposited on the drum 1 during development. A cleaning member 48 removes the collected carrier liquid 40*b* from the sweep roller 43 and returns it to the tank 41.

The sweep roller 43 can remove part of the carrier liquid 40*b* deposited on the image position in addition to the carrier liquid 40*b* deposited on the background. Specifically, as shown in FIG. 7, the carrier liquid 40*b* deposits on the image portion of the drum 1 moved away from the development nip in an amount of 0.68 mg/cm$^2$. Such an amount decreases to 0.52 mg/cm$^2$ when the carrier liquid 40*b* moves away from the sweep nip between the drum 1 and the sweep roller 43. That is, the sweep roller 43 removes the carrier liquid deposited on the image portion of the drum 1 by an amount of 0.16 mg/cm$^2$.

As stated above, the sweep roller 43 removes excessive part of the carrier liquid 40 from the background and image-portion of the drum 1 and returns it to the tank 41. This reduces the consumption of the carrier liquid 40*b*, compared to a configuration lacking the sweep roller 43, for thereby reducing the running cost of the printer.

The experimental sweep roller 43 has rubber hardness of about 20° (JIS A scale), so that pressure within the sweep nip is low. Therefore, if the pressure within the sweep nip is raised, e.g., if the rubber hardness of the sweep roller 43 is higher than 50°, then the amount of carrier liquid 40*b* to move away from the sweep nip and therefore to deposit on the drum 1 can be further reduced. However, excessively high pressure acting between the drum 1 and the sweep roller 43 would prevent even the toner grains of the image portion from passing the nip and would thereby bring about defective images. In light of this, the rubber hardness of the elastic layer 43*a* should preferably be, but not limited to, 50° or below, more preferably about 20° (JIS A scale).

Figure 8A:
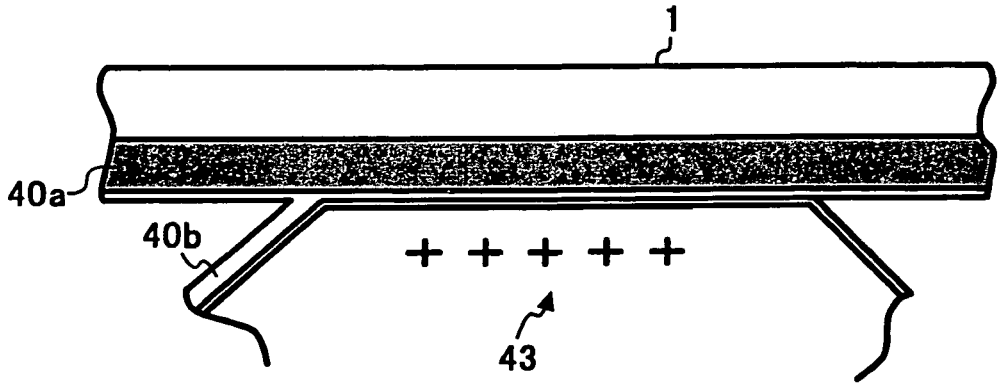
FIGS. 8A and 8B show different conditions of the developer brought to the removal nip.
Figure 8B:
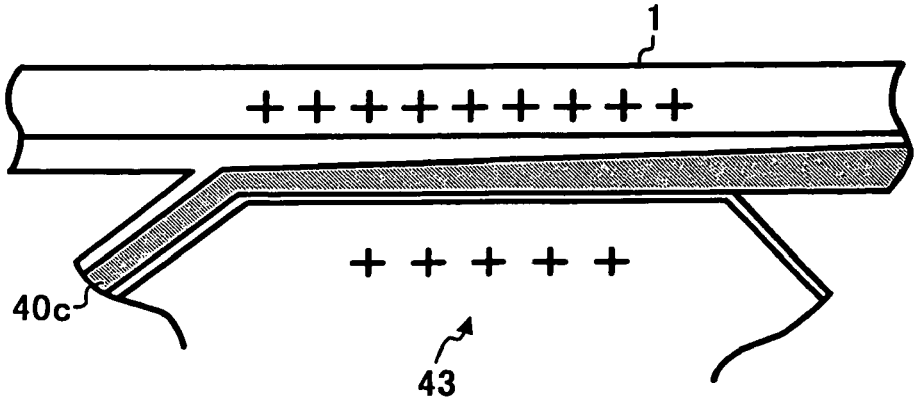

The sweep roller 43 is capable of removing a small amount of excess toner deposited on the background of the drum 1 in addition to the excess carrier liquid 40*b*, as will be described specifically hereinafter. As shown in FIG. 2C, when part of the toner 40*a* deposited on the background of the drum 1 at the development nip fails to migrate to the surface of the developing roller 42 and remains on the drum 1, it brings about fog or background contamination. The sweep roller 43 can remove this part of toner (fog toner hereinafter). FIGS. 8A and 8B show specific conditions of the developing liquid at the sweep nip between the drum 1 and the sweep roller 43. In the specific conditions, the elastic layer 43*a* of the sweep roller 43 is formed of conductive urethane rubber and applied with a bias for removing the fog toner.

More specifically, a bias of 250 V close to the surface potential (100 V to 200 V) of the toner layer formed on the drum 1 by development is applied to the sweep roller 43 in order to prevent the toner 40*a* forming the above layer from moving toward the sweep roller 43. As shown in FIG. 8B, in the background portion, an electric field formed by a potential difference between the background of the drum 1 and the above bias causes the fog toner 40*c*, which is floating, to move toward the sweep roller 43. At this instant, the sweep roller 43 can easily collect the fog toner 40*c* because the thickness of the developer layer on the background has decreased to about one-half of the thickness at the development nip and because the toner content has decreased to about 20% of the toner content before development. The sweep roller 43 can therefore fully obviate the fogging of the background. The potentials stated above are related as:

$$\text{drum potential} > VB1 > VB2 > \text{toner layer potential} \quad (2)$$

where VB1 and VB2 respectively denote a potential between the drum 1 and the developing roller 42 and a potential between the drum 1 and the sweep roller 43.

The voltage satisfying the above relation (2) allows the sweep roller 43 to further promote the cohesion of the toner grains in the image portion without peeling them off, thereby removing the excess carrier liquid from the image portion and removing the fog toner 40*c* from the background.

Because the sweep roller 43 efficiently removes the fog toner 40*c*, some fog toner 40*c* may be left at the development nip between the drum 1 and the developing roller 42. This successfully lowers an electric field necessary for removing fog, i.e., a potential difference between the bias applied to the developing roller 42 and the charge potential of the drum 1 and therefore lowers the charge potential required of the drum 1. The illustrative embodiment therefore enhances the durability of the drum 1 and reduces the load on the charge roller 2 as well as power necessary fore exposure.

The conventional image forming method stated earlier can effect development and the removal of fog toner with a developer carrier at the same time. Such a method, however, needs a relatively long developing time, e.g., about 40 milliseconds and therefore a large nip width between the image carrier and the developer carrier. In the conventional method, the developer carrier with an elastic layer is pressed against the image carrier to form the above nip, so that relatively high contact pressure is necessary for forming the nip.

By contrast, in the illustrative embodiment, the sweep roller 43 removes the fog toner 40*c* and therefore allows the developing roller 42 to effect only development. This reduces the required nip width and therefore the required contact pressure (e.g. 0.3 kgf/mm or below) and thereby reduces the loads on the developing roller 42 and sweep roller 43 for thereby enhancing durability.

While the illustrative embodiment has concentrated on negative-to-positive development, it is, of course, applicable to positive-to-positive development. The monochromatic printer shown and described may be replaced with a color printer well known in the art, if desired. Further, the electrophotographic image forming system may be replaced with, e.g., an ionographic image forming system.

Particularly, in the illustrative embodiment, the image carrier is implemented by a-Si higher in hardness than, e.g., OPC and highly resistant to moisture, repeated use, voltage and environment and highly durable. The image carrier therefore suffers from a minimum of damage despite the contact of the developer carrier and liquid removing member and swells or deteriorates little despite the developing liquid. This enhances the durability and service life of the entire image forming apparatus.

As stated above, the illustrative embodiment has various unprecedented advantages, as enumerated below.

(1) When the image carrier and developer carrier part from each other in the developing zone, toner is caused to move toward a latent image formed on the image carrier by electrophoresis over a degree at which the developing liquid can separate around a boundary between the toner layer and the carrier layer. The toner therefore coheres due to compression and makes the toner layer thin, so that the carrier liquid deposits on the image carrier moved away from the developing zone little and deposits on the developer carrier more.

(2) The carrier liquid deposited on the developer carrier can be again used for development. This reduces the consumption of the carrier liquid and therefore the running cost of the image forming apparatus.

(3) Because the amount of the carrier liquid has decreased when a toner image is fixed, desirable fixation is achieved.

(4) The toner on the image carrier closely coheres and implements a high-resolution image.

(5) The amount of the carrier liquid to deposit on the background or non-image portion of the image carrier is reduced. This, coupled with the above advantages (1) and (3), further reduces the running cost. In addition, the toner does not deposit on the background of the image carrier, insuring a high-quality image free from background contamination.

(6) The developing time is controllable in terms of the size of the nip and therefore without effecting the image forming speed. While the developing time may be controlled in terms of the process speed, such a scheme must lower the process speed when, e.g., a longer developing time is desired, slowing down the entire image forming cycle. Another scheme available for controlling the size of the nip is to form an elastic layer on the developer carrier and adjust the contact pressure of the developer carrier acting on the image carrier for thereby causing the elastic layer to deform.

(7) The deposition of the carrier liquid on the image carrier can be reduced without disturbing the toner image formed on the image carrier.

(8) A high-quality image free from short image density and fog is insured.

(9) The developing liquid is coated on the developer carrier such that the pigment content of the toner on the developer carrier is 4 μg or above, but 40 μg or below, for the unit area of 1 $cm^2$ of the surface of the developer carrier. The resulting image is free from short image density and fog.

(10) The cleaning means removes the developer left on the developer carrier after development, so that the coating means can coat a new developer on the developer carrier to thereby maintain the developing ability of the developer carrier.

(11) The image carrier is implemented by a-Si higher in hardness than, e.g., OPC and highly resistant to moisture, repeated use, voltage and environment and highly durable. The image carrier therefore suffers from a minimum of damage despite the contact of the developer carrier and liquid removing member and swells or deteriorates little despite the developing liquid.

Second Embodiment

This embodiment is directed toward the second object stated earlier and implemented as an electrophotographic copier by way of example. As shown, the copier includes a photoconductive drum or image carrier 1. Arranged around the drum 1 are a charger 2, an optical writing unit 3, a developing unit 4, an image transferring unit 5, and a cleaning unit 6. Again, the drum 1 may be formed of, e.g., a-Si or OPC. The optical writing unit 3 may include an LED array or laser optics by way of example.

The copier with the above configuration forms a toner image by the following negative-to-positive development procedure by way of example. A motor or similar drive means, not shown, causes the drum 1 to rotate at a constant speed in a direction indicated by an arrow. The charger 2 uniformly charges the surface of the drum 1 in rotation to about 600 V in the dark by corona discharge. If desired, the charger 2 effecting corona discharge may be replaced with a charge roller or similar charging member held in contact with the drum 1 and applied with a preselected bias.

The optical writing unit 3 scans the charged surface of the drum 1 in accordance with image data to thereby form a latent image on the drum 1. The developing unit 4 develops the latent image being conveyed by the drum 1, thereby producing a corresponding toner image. The image transferring unit 5 transfers the toner image from the drum 1 to a sheet or recording medium. After the sheet has been peeled off the drum 1, the cleaning unit 6 removes the toner left on the drum 1. After the image transfer from the drum 1 to the sheet, a quenching lamp, not shown, discharges the surface of the drum 1 to thereby prepare the drum 1 for the next printing cycle. The sheet with the toner image is driven out of the copier via a fixing unit not shown.

For the image transferring device 5, use may be made of any one of conventional methods including one using an electrostatic roller, one using corona discharge, and one using adhesion transfer. Likewise, the fixing unit may be implemented by, e.g., a thermal fixing system, a solvent fixing system or a pressure fixing system.

Figure 9:
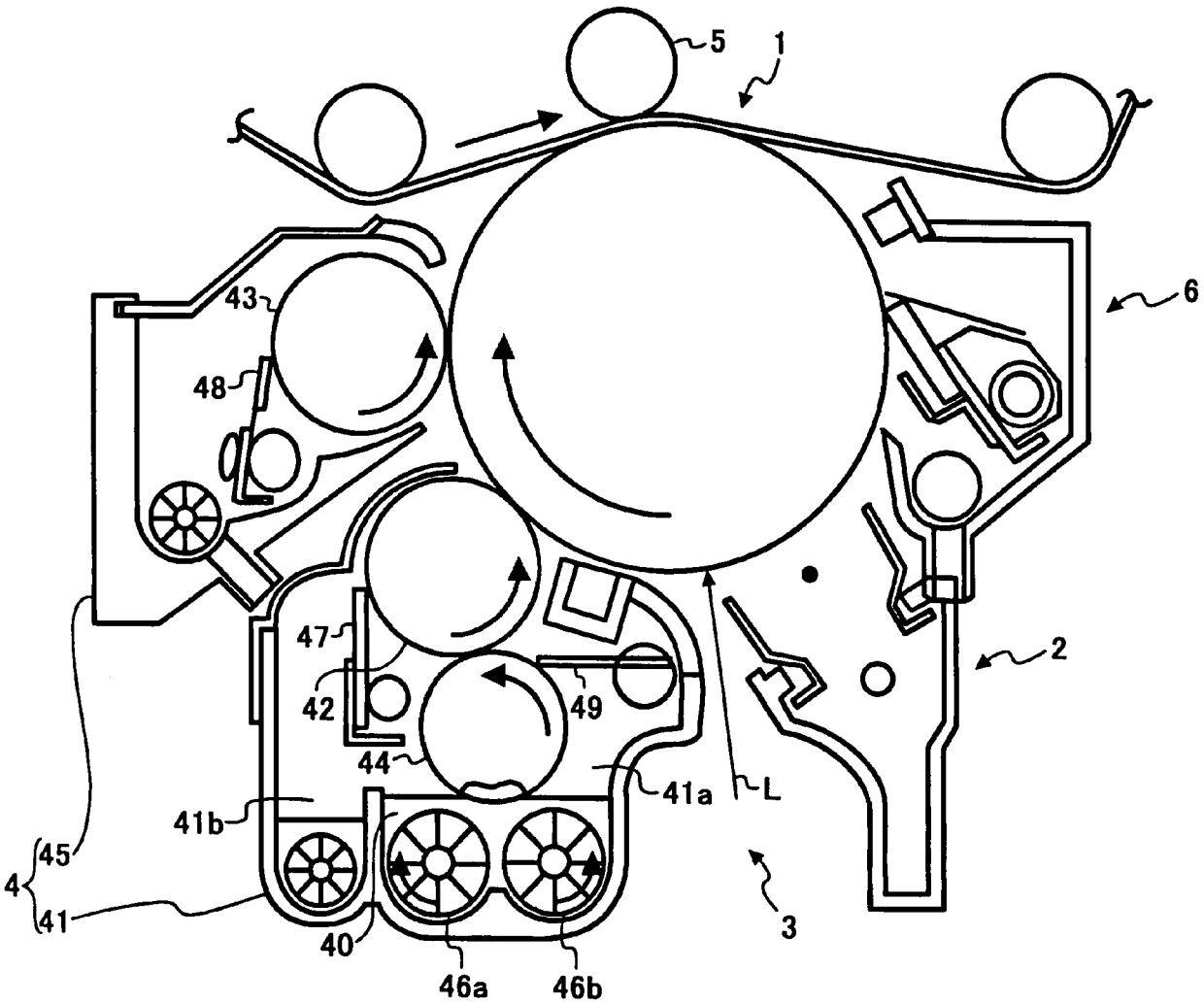
FIG. 9 is a fragmentary view showing a second embodiment of the present invention.

The developing liquid, labeled 40 in FIG. 9, applicable to the illustrative embodiment is a high viscosity, high density developing liquid as distinguished from an ordinary low viscosity (about 1 cSt), low density (about 1%) developing liquid containing Isoper as a carrier. The high viscosity, high density developing liquid has viscosity ranging from 50 cSt to 5,000 cSt and density ranging from 5% to 40% by way of example; in the illustrative embodiment, the density is 15%. A carrier liquid is implemented by silicone oil, normal paraffin, Isopar M, vegetable oil, mineral oil or similar highly insulative material. The carrier liquid may be either volatile or nonvolatile, depending on the application. The toner may have any grain size between submicrons and 6 μm so long as it matches with the application.

As shown in FIG. 9, the developing unit 4 is generally made up of a developing section 41 and a sweeping section 45. The developing section 41 includes a tank 41*a* storing the developer 40, a developing roller or developer carrier 42, a sweep roller or removing member 43, Anilox roller 44, a pair of agitators 46*a* and 46*b* implemented as screws, and a returning portion 41*b*. Cleaning members 47 and 48 implemented as metal blades or rubber blades are associated with the developing roller 42 and sweep roller 43, respectively. The blades may be replaced with ropers, if desired. A doctor blade 49 is associated with the roller 44.

A conductive elastic layer is formed on the circumference of each of the developing roller 42 and sweep roller 43 and may be formed of urethane rubber. The elastic layers should preferably have rubber hardness of 50° or below in JIS A scale. Urethane rubber forming the elastic layer 52*a* may, of course, be replaced with any other suitable material that is conductive and does not swell or dissolve on contacting a solvent. Alternatively, such an elastic layer may be formed on the drum 1. Further, the drum 1 may be implemented as an endless belt. The sweep roller 43 is provided with surface smoothness (Rz) of 3 μm or below by means of coating or a tube.

When the developing roller 42 and sweep roller 43 are pressed against the drum 1 by adequate pressure, the elastic layers thereof elastically deform and form a development nip and a removal nip, respectively. The development nip guarantees a preselected developing time long enough for the toner of the developing liquid 40 to move toward and deposit on the drum 1 under the action of an electric field formed in the developing zone. By adjusting the pressure to act between the developing roller 42 and the drum 1, it is possible to control the width of the development nip. The widths of the above two nips each are selected to be larger than the product of the linear velocity of the associated roller and a time constant for development, which refers to a period of time necessary for the amount of development to saturate and is produced by dividing the nip width by a process speed. For example, if the nip width is 3 mm and if the process speed is 300 mm/sec, then the time constant for development is about 10 milliseconds.

During development, the Anilox roller 44 coats the developing liquid 40 on the developing roller 42 in the form of a thin layer. In the illustrative embodiment, the Anilox roller 44 coats the developing liquid 40 such that the pigment content of the toner deposited on the developing roller 42 is 4 μg or above, but 40 μg or below for a unit area of 1 $cm^2$. For this purpose, the Anilox roller 44 coats the developing liquid 40 in a layer whose thickness is between 5 μm and 10 μm. If the pigment content of the toner deposited on the developing roller 42 for the unit area of 1 $cm^2$ is smaller than 4 μg, then the pigment is likely to fail to migrate to the image portion of the latent image formed on the drum 1 in a sufficient amount, resulting in short image density. If the pigment content of the toner is larger than 40 μg, then the toner is apt to remain in the non-image portion or background after development in an amount too large to be fully removed by the sweep roller 43. In the illustrative embodiment, the developer layer formed on the developing roller 42 is 8 μm thick while the film of the drum 1 is 30 μm thick.

The developing liquid 40 forming a thin layer on the developing roller 42 is brought to the development nip between the drum 1 and the developing roller 42. Generally, in a developing device for an electrophotographic process, the surface of a developing roller is moved at a higher speed than the surface of a photoconductive drum in order to convey a sufficient amount of toner to a developing zone between the roller and the drum. The toner therefore moves at a higher speed than the surface of the drum and is therefore shifted relative to a latent image formed on the drum. This causes the leading edge of an image to be blurred or brings vertical lines and horizontal lines out of balance. This is also true with development using a developing liquid. By contrast, in the illustrative embodiment, the surface of the developing roller 42 and that of the drum 1 move at substantially the same speed in order to prevent the toner from having a speed vector in the tangential direction of the drum 1, thereby obviating the above defective images.

Figure 10A:
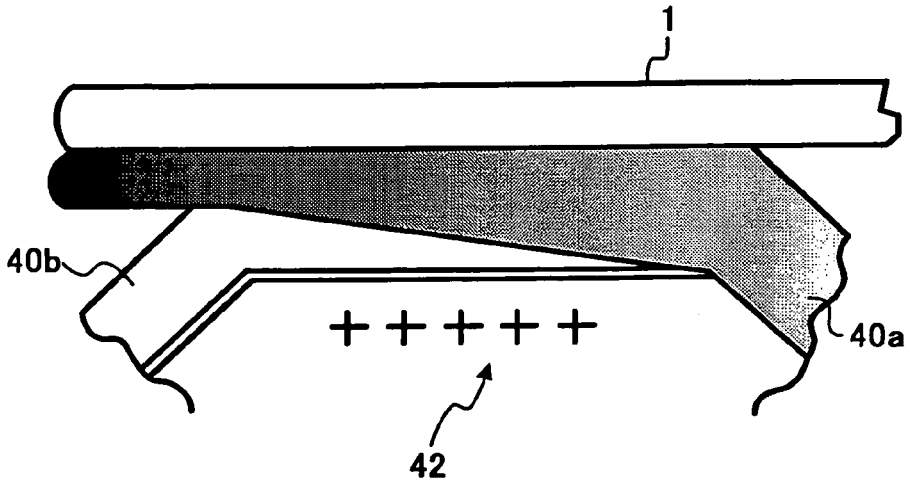
FIGS. 10A and 10B show different conditions of the developer at the development nip.
Figure 10B:
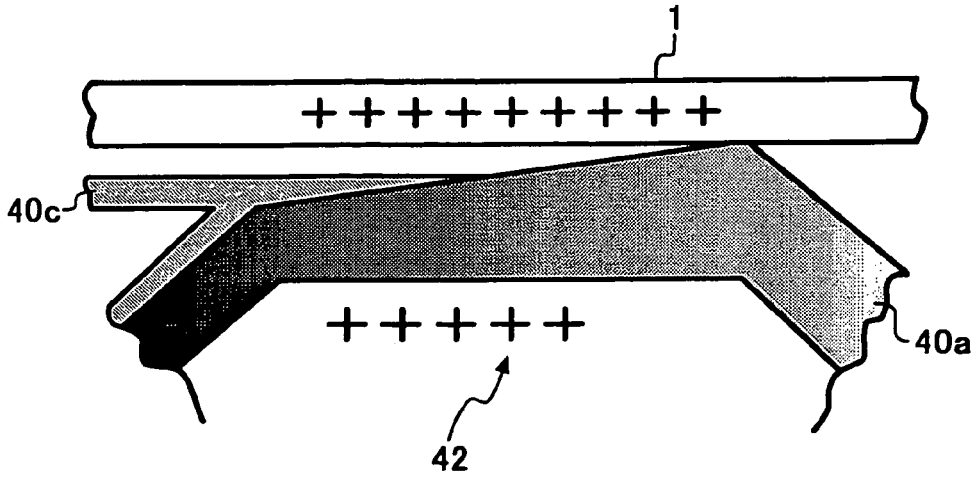

A bias for development (400 V) lower than the surface potential (600 V) of the drum 1 is applied to the developing roller 42. The bias forms an electric field between the developing roller 42 and the image portion of the drum 1 lowered in potential to 50 V or below by the optical writing unit 3. FIGS. 10A and 10B show the conditions of the developing liquid 40 brought to the development nip. As shown in FIG. 10A, toner 40*a* contained in the developer 40 moves to the drum 1 due to the above electric field and develops a latent image (image portion). As shown in FIG. 2B, in the background portion, the electric field formed by the bias and the potential of the drum 1 attracts the toner 40*a* left in the background toward the developing roller 42 for thereby preventing it from remaining on the background.

Referring again to FIG. 9, in the tank 41*a*, the toner left on the developing roller 42 after development and the toner removed by the sweep roller 43 from the background of the drum 1 and then removed by the cleaning member 48 are returned to the Anilox roller 44 via the returning portion 41*b*. This implements a mechanism for recycling the residual toner and a mechanism for recycling the removed toner. The agitators or screws 46*a* and 46*b* are positioned in parallel to each other in the developing liquid 40 stored in the tank 41*a*. Drive means, not shown, causes the agitators 46*a* and 46*b* to rotate in opposite directions to each other, as indicated by arrows, for thereby agitating the developing liquid 40. As a result, the liquid level of the developing liquid 40 rises between the agitators 46*a* and 46*b* and deposits on the Anilox roller 44 positioned above the agitators 46*a* and 46*b*.

To prevent the toner from remaining on the background of the drum 1 and fogging an image, it has been customary to form an electric field strong enough to attract the above toner toward the developing roller 42 between the background and the developing roller 42. However, such a strong electric field brings about another problem that it compresses the developing liquid present on the developing roller 42 and moved away from the developing zone, causing the toner to cohere. This is undesirable when the developer is repeatedly used. Further, the amount of toner to move toward the image portion decreases, resulting in short image density. Specific examples of the illustrative embodiment configured to obviate the cohesion of the toner on the developing roller 42 will be described hereinafter.

EXAMPLE 1

We experimentally determined a relation between the development ratio of the background and the cohesion of toner. FIG. 11 shows lump generation ranks derived from various development ratios. To determine a lump generation rank, a latent image formed on a drum was developed at a process speed of 300 mm/sec by negative-to-positive development. 20 mg of developer was collected, and then a carrier liquid is introduced into the developer. The liquid was then skimmed to prepare a precipitated, cohered sample. Usually, by repeating such a procedure five times with a 10-cc bottle, it is possible to prepare samples for lump estimation. In FIG. 11, rank 5 shows that no lumps were observed, rank 4 shows that one lump was observed, rank 3 shows that a few lumps were observed, rank 2 shows that more than a few lumps were observed, and rank 1 shows that numerous lumps were observed.

As FIG. 11 indicates, the lower the development ratio of the background, the lower the toner generation rank, i.e., the more noticeable the cohesion. This suggests that toner cohesion can be obviated if the development ratio of the background is increased. This, however, increases the amount of toner to deposit on the background. In Example 1 to be described, the development ratio is selected to be 10% or above in order to confine the generation of lumps in the allowable range for thereby obviating toner cohesion. Although Example 1 does not define the upper limit specifically, the upper limit is assumed to cover the general range of development ratios of the background.

Figure 12A:
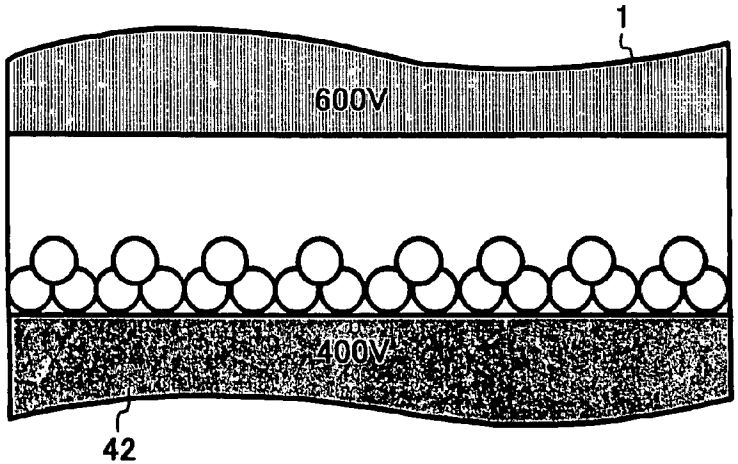
FIGS. 12A through 12C show how the condition of residual toner left on the background varies when the developing time is varied.
Figure 12B:
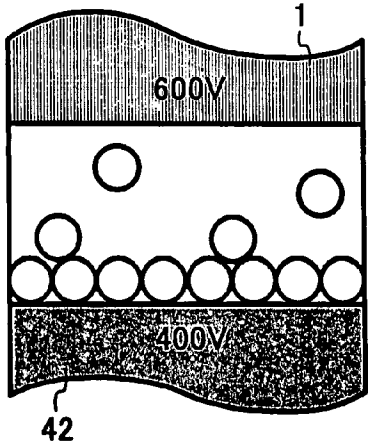
Figure 12C:
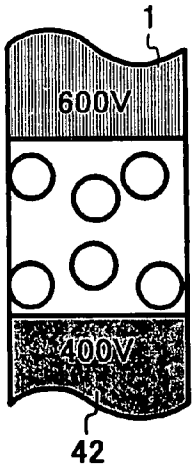

FIGS. 12A through 12C show three different conditions of toner grains in the background portion determined by experiments. For the experiments, the potential of the background of the drum 1 and the potential of the developing roller 42 were selected to be 600 V and 400 V, respectively, so that an electric field of $1.2\times10^7$ V/m was formed between the background and the developing roller 42 (background electric field hereinafter). The developing time of the background was 20 milliseconds in FIG. 12A, 10 milliseconds in FIG. 12B and 5 milliseconds in FIG. 12C. The width of each of FIGS. 12A through 12C is proportional to the width of development nip for the background; the nip width shown in FIG. 12C is smallest. The background electric field between the background and the developing roller 42 attracts much of the toner present on the background of the drum 1 toward the developing roller 42, thereby forming the background.

Figure 13:
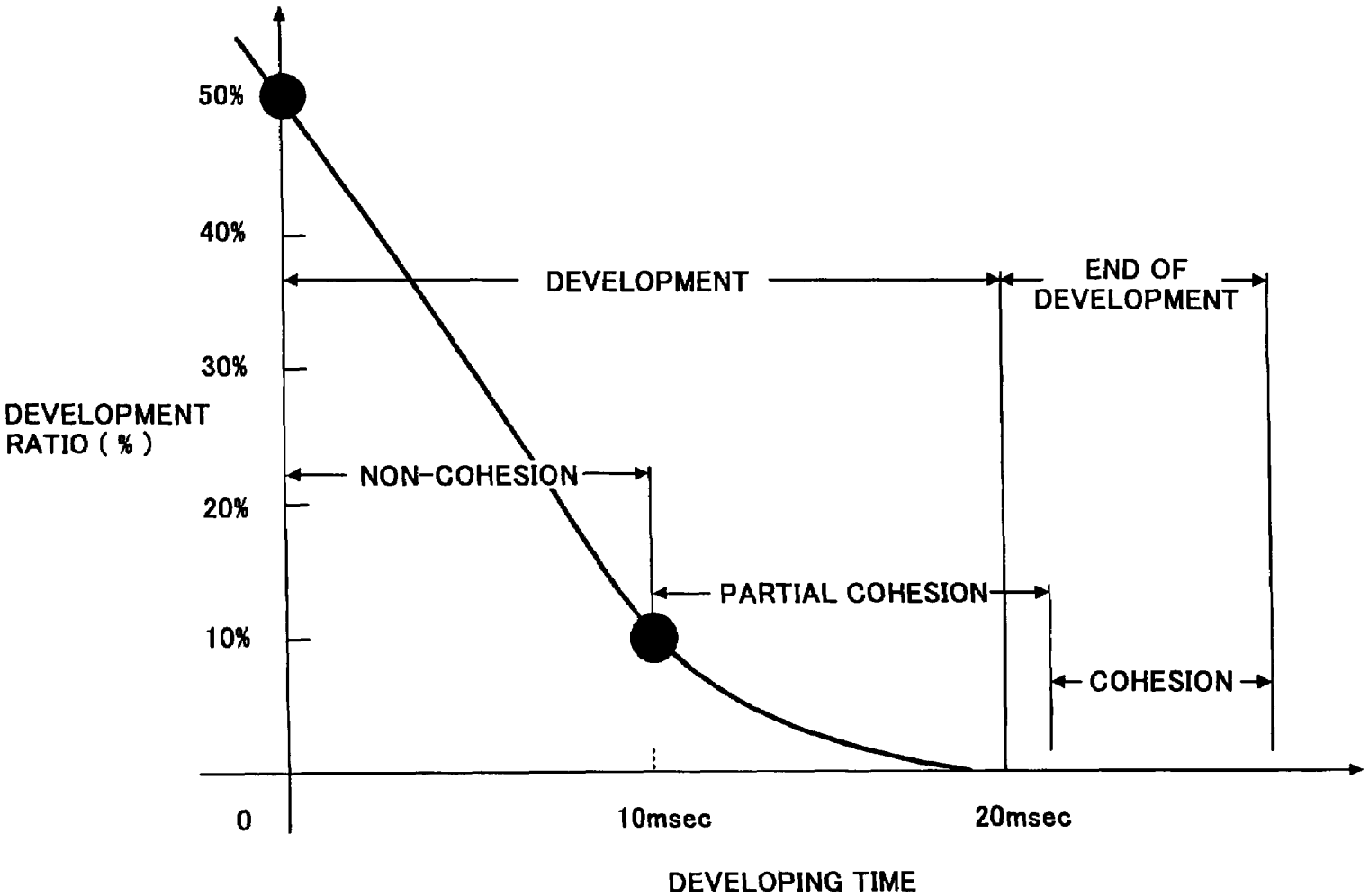
FIG. 13 is a graph showing a relation showing a developing time assigned to the background and the development ratio of the background.

FIG. 13 shows a relation between the developing time and the development ratio of the background determined under the same conditions as in FIGS. 12A through 12C. To determine the relation, a bias (400 V) lower than the surface potential (600 V) of the drum or image carrier 1 was applied to the developing roller or developer carrier 42, so that the potential difference in the background portion 200 V. In this case, the electric field for development (development electric field hereinafter) was $1.2\times10^7$ V/m. Various conditions other than the developing time including the electric field were maintained constant.

As FIG. 13 indicates, as the developing time is extended, the development ratio of the background becomes lower, i.e., development approaches saturation. As a result, the cohesion of the toner attracted toward the developer carrier becomes noticeable. That is, by reducing the developing time, it is possible to prevent the above development ratio from excessively decreasing and therefore to end development before the toner grains cohere. It follows that for a given electric field, toner cohesion can be obviated if the developing time is reduced.

FIGS. 12A through 12C and 13 indicate the following. When the developing time is 20 milliseconds (FIG. 12A), almost entire toner is attracted toward the developing roller and make the development ratio of the background substantially zero percent. In this case, the toner remaining on the developing roller 42 coheres although no fog toner is present in the background. On the other hand, when the developing time is as short as 5 milliseconds (FIG. 12C), the residual toner cannot be efficiently attracted toward the developing roller 42, increasing the development ratio to about 30%; the toner on the developing roller 42 does not cohere. By contrast, when the developing time is 10 milliseconds (FIG. 10B), the toner is partly left on the drum 1 and partly attracted toward the developing roller 42, implementing a development ratio of 10% belonging to allowable rank 3, FIG. 11.

For the reasons described above, in Example 1, the developing time of the background is selected to be 10 milliseconds when the background electric field is $1.2\times10^7$ V/m, thereby implementing the development ratio of 10% or above and obviating the cohesion of residual toner. When the developing time is 10 milliseconds and the development ratio of the background is 10%, the developer deposited on the developing roller 42 is almost non-cohered, as seen from FIG. 11. That is, by selecting a developing time shorter than 10 milliseconds, it is possible to reduce cohesion. In this manner, by making the developing time shorter than the development time constant, Example 1 prevents the toner left on the background from cohering.

Further, in Example 1, to implement the desired development ratio of the background, there is adjusted the developing time of the background correlated to the development ratio. This insures accurate control over the development ratio in terms of the developing time for thereby surely obviating the cohesion of the residual toner.

It is to be noted that by controlling the development ratio of the background, it is possible to control the weight ratio of toner to move from the developing roller 42 toward the background of the drum 1 (weight ratio of moving toner hereinafter). This is because image density is correlated to the toner content (mg/cm$^2$) of the developer deposited on the developing roller 42 and the image density measuring region of the drum 1.

Figure 14:
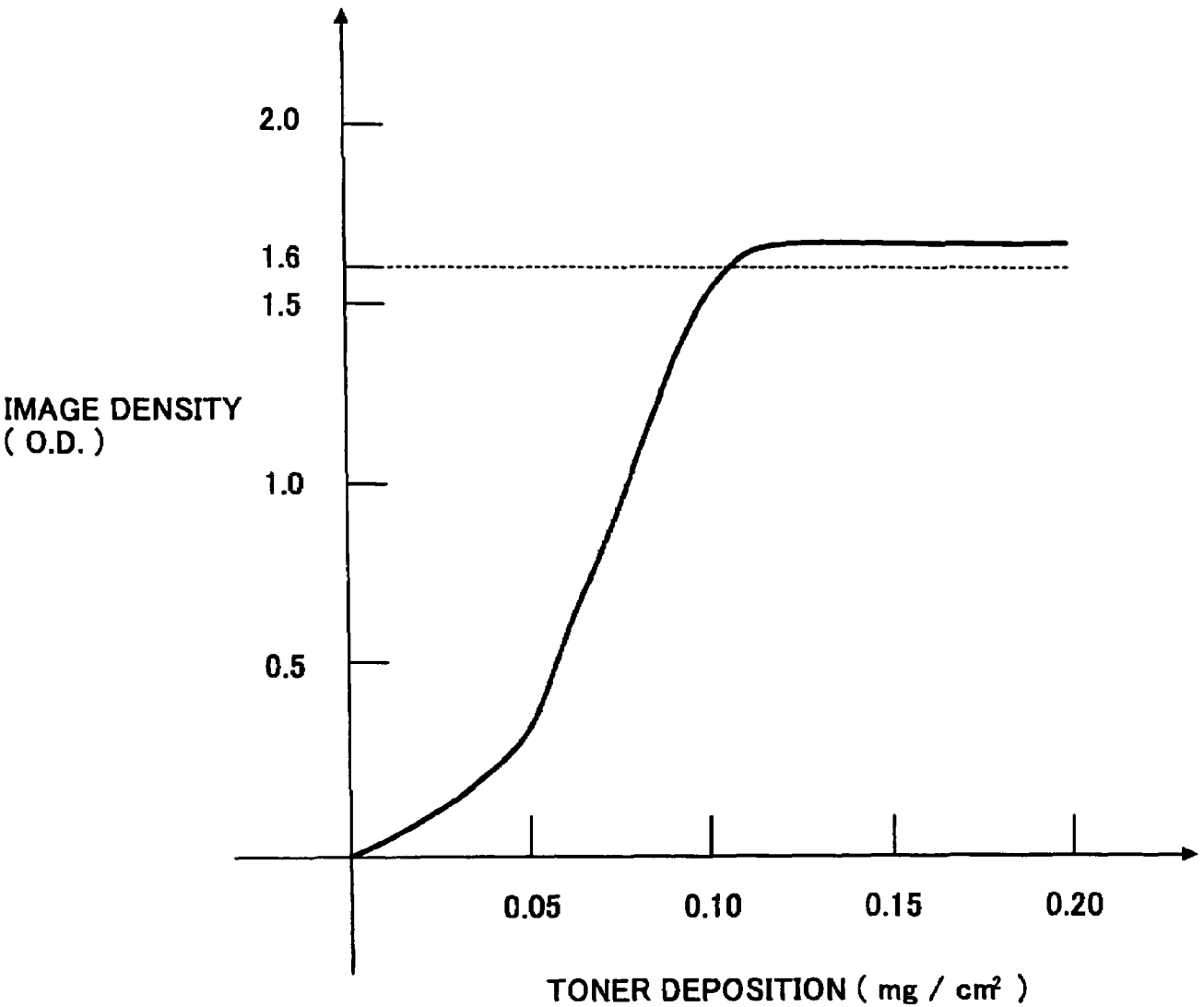
FIG. 14 is a graph showing a relation between the amount of toner deposited on an image density measuring region for a unit area and the image density of the same region.

FIG. 14 shows a relation between the amount of toner for a unit area of the image density measuring region of the drum 1 and image density (O.D.) in the same region. The data shown in FIG. 14 were obtained when the toner had a grain size of 3 μm and when the ratio of a pigment to resin was 2:8. As shown, the amount of toner in weight for a unit area (mg/cm$^2$) is dependent on image density until image density saturates, i.e., until it exceeds about 1.6.

Therefore, translating the control of the development ratio of the background as in Example 1, there is controlled the weight ratio of moving toner expressed as:

weight of toner present in background of drum 1/weight of toner for developing background and present in region of roller 42 not undergone development Stated another way, there is controlled, among toner grains present in the region of the developing roller 42 for developing the background and not undergone development, the ratio of toner grains moved to the background of the drum 1.

Further, in FIG. 14, the target image density of 1.6 of the image portion is achievable when the amount of toner is 0.10 mg/cm$^2$. Therefore, the settings of the developer and bias for development described above are obviously applicable to actual image formation.

Example 1 does not define the upper limit of the development ratio of the background because the upper limit is not necessary in consideration of the fact that the development ratio of the background is originally low. How to deal with an increase in the development ratio of the background will be described specifically later.

EXAMPLE 2

Figure 15:
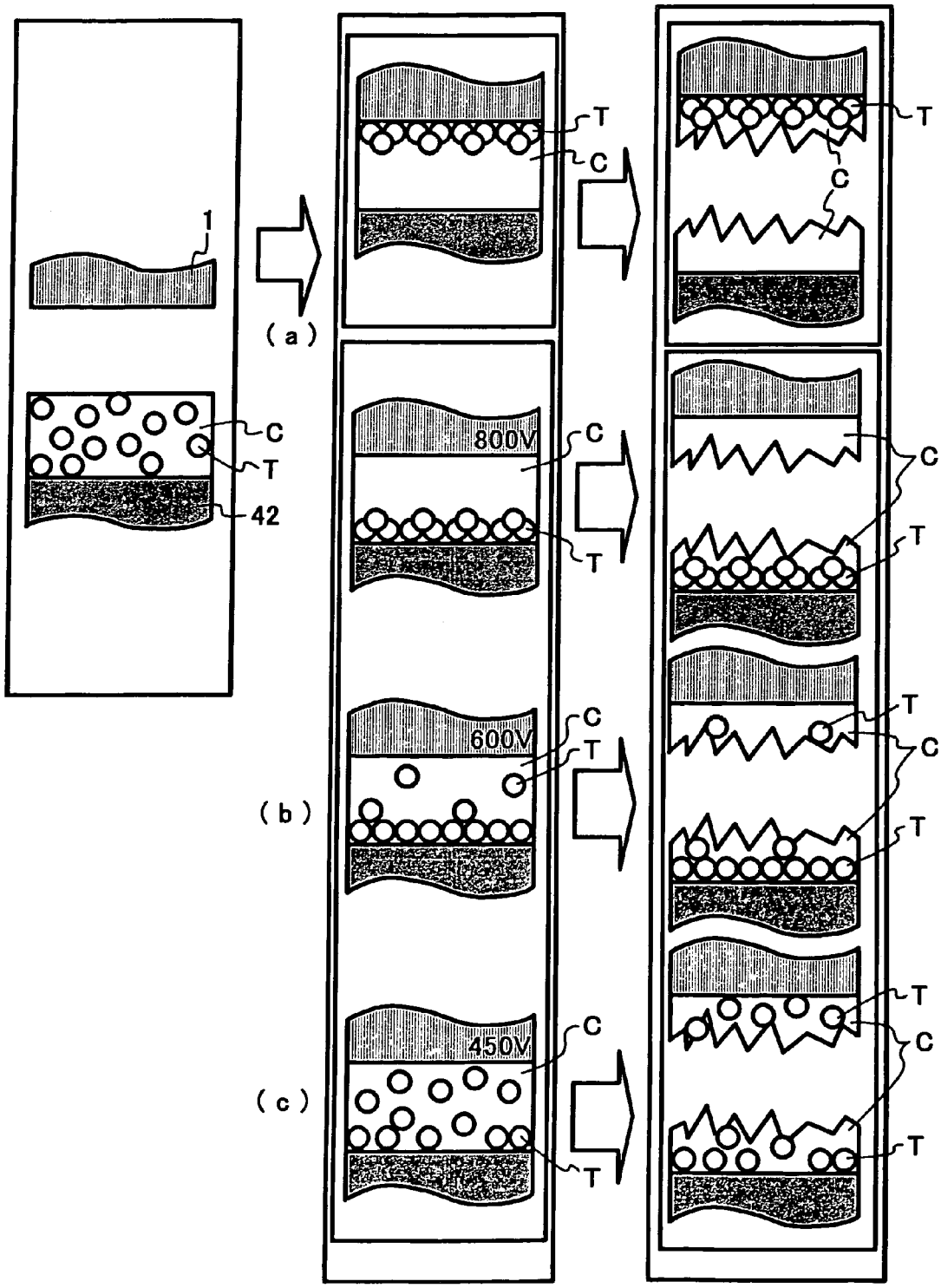
FIG. 15 demonstrates how the condition of the developer varies when a voltage applied to the developing roller is varied.

Example 2 to be described controls the background electric field for obviating toner cohesion. FIG. 15 shows three different conditions of toner remaining on the background. These conditions were determined when the potential of the image portion of the drum 1 was 0 V, when the potential of the developing roller 42 was 400 V, and when the potential of the background of the drum 1 was 800 V (FIG. 15, (a)), 600 V (FIG. 15, (b)) and 450 V (FIG. 15, (c)). As shown, the electric field formed between the image portion of the drum 1 and the developing roller 42 causes the developer to move to the image portion and develop it.

As shown in FIG. 15, (a), when the potential of the background is as high as 80 V, the background electric field between the background and the developing roller 42 is as strong as $2.9\times10^7$ V/m and causes the residual toner on the developing roller 42 to cohere although not producing fog toner on the background. On the other hand, as shown in FIG. 15, (C), when the potential of the background is as low as 450 V, the background electric field is as weak as $3.6\times10^6$ V/m and cannot sufficiently attract the residual toner toward the developing roller 42, resulting in fog toner on the drum 1. By contrast, as shown in FIG. 15, (b), when the potential of the background is 600 V, the background electric field is $1.4\times10^7$ V/m that can sufficiently attract the residual toner toward the developing roller 42 while preventing the residual toner on the developing roller 42 from cohering.

FIG. 16 shows the results of experiments conducted to determine lump generation ranks and background (non-image portion) densities with respect to various field strengths in the background. Lump generation ranks shown in FIG. 16 are identical with ranks shown in FIG. 11. As for background density, "bad" indicates background density above 0.6 in terms of optical density, "stain" indicates background density above 0.1, but below 0.6 inclusive, and "clear" indicates background density below 0.01 inclusive.

As FIG. 16 indicates., although background density approaches "clear" as the electric field in the background portion becomes strong, lump generation rank falls, i.e., toner cohesion becomes noticeable. More specifically, toner cohesion becomes more noticeable with an increase in the background electric field. Conversely, background density becomes more noticeable with a decrease in the background electric field. When the background electric field is about $3.5\times10^7$ V/m, lump generation rank 2 or above is achievable, i.e., the cohesion of toner grains in the developer is confined in the allowable range. When the development electric field is close to 0 V/m, the boundary between the image portion and the background is not clear. Although this was desirable from the toner cohesion standpoint, such an electric field aggravated background contamination and made images unacceptable in practical use. This is true even when removing means to be described later is used. It was also found that the electric field of $3.5\times10^7$ V/m allowed the density of background to attain "clear". Even when the above electric field was lower than $3.5\times10^7$ V/m, the density of background was "stain" lying in an allowable range.

It follows that the background electric field should preferably be $3.5\times10^7$ V/m or below. Particularly, Example 2 selects an electric field of about $2\times10^7$ V/m that realizes lump generation rank 4 and background density "stain", meaning that the toner coheres little. The toner can therefore be easily dispersed during collection of the removed developer, so that the developer not used for development can be repeatedly used. The lower limit of the above electric field may be 0 V/m in absolute value, in which case removing means will successfully obviate background contamination.

EXAMPLE 3

Figure 17:
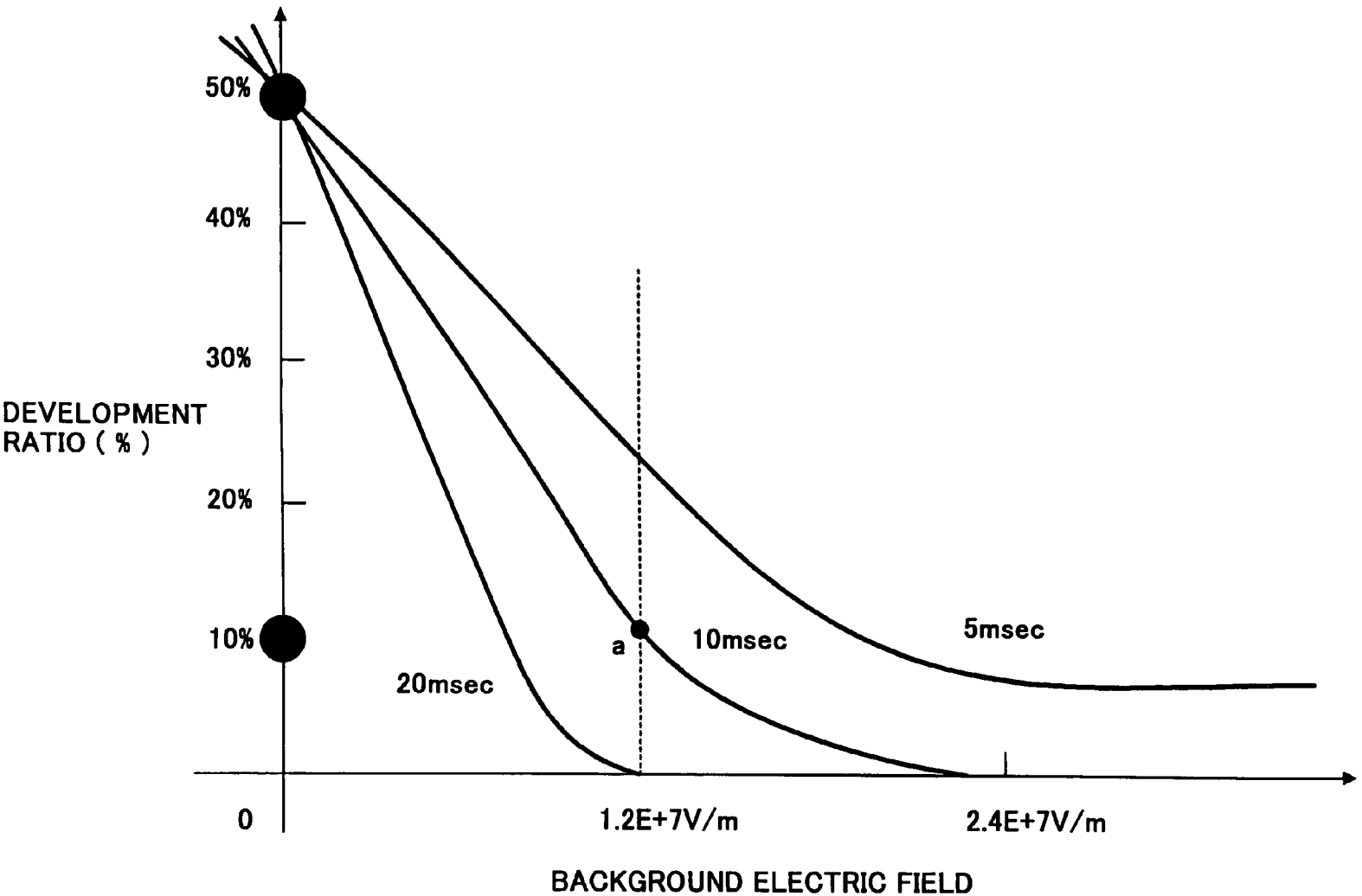
FIG. 17 is a graph showing a relation between a background electric field and a background development ratio with respect to three different developing times.

Example 3 is based on, but more specific than, Examples 1 and 2. FIG. 17 shows a relation between the background electric field and the development ratio of the background particular to Example 3 with respect to developing times of 5 milliseconds, 10 milliseconds and 20 milliseconds. More specifically, FIG. 17 shows how the above development ratio varies in accordance with the combination of two parameters having influence on the development ratio, i.e., the developing time and background electric field. As shown, for a given developing time, the development ratio increases with a decrease in electric field, reducing the cohesion of residual toner. Also, for a given electric field, the development ratio increases with a decrease in developing time, reducing the cohesion of residual toner. As FIG. 17 indicates, if the developing time is 10 milliseconds or less when the electric field is $1.2\times10^7$ V/m, (position "a"), the development ratio of 10% or above is achievable as in Example 1.

In light of the above, Example 3 uses a printer having a developing time of 10 milliseconds and causes it to develop the background with the electric field of $1.2\times 10^7$ V/m and development ratio of substantially 10% for the background (point a, FIG. 7). This realizes lump generation rank 3, meaning that the toner coheres little. The toner can therefore be easily dispersed during collection of the removed developer, so that the developer not used for development can be repeatedly used. In addition, the background is free from fog toner because background density does not excessively rise.

When use is made of a printer having a developing time other than 10 milliseconds, use should only be made of a developer having a different development time constant necessary for development to saturate, thereby implementing the development ratio of substantially 10% in the background.

Further, as shown in FIG. 17, other different combinations of electric field and developing time that implement the development ratio of substantially 10% are available, so that Example 3 is highly practical. Any suitable combination matching with the settings of a printer may be selected.

Examples 1 through 3 shown and described obviate the cohesion of residual toner by defining the lower limit of the development ratio and the range of background electric fields. However, a decrease in electric field or an increase in development ratio may cause background density to increase. In such a case, the sweep roller 43 may remove the developer from the background or a strong electric field may cause discharge to occur during image transfer for the same purpose.

The lower limit of the electric field for the background may be selected to be $0\times10^7$V/m. In such a case, only the developer mechanically transferred from the developing roller 42 to the image portion of the drum 1 is the developer that deposits on the background, so that the development ratio of the background is close to 50%. The amount of toner to deposit on the background is about one-half the toner content of the developer, i.e., 15%. To further reduce background image density, the sweep roller 43 may be used to reduce such toner.

In the illustrative embodiment, the sweep roller or removing member 43 removes the toner remaining on the background of the drum 1 by attracting it. More specifically, if part of the toner 40*a* present on the background fails to move to the surface of the developing roller 42 and remains on the drum 1, then it constitutes the fog toner 40*c*. The sweep roller 43 removes the fog toner 40*c* by sweeping it. The sweep roller 43 is positioned downstream of the developing roller 42 in the direction of rotation of the drum 1 and pressed against the drum 1. The surface of the sweep roller 43 moves at substantially the same speed as the surface of the drum 1.

Figure 18A:
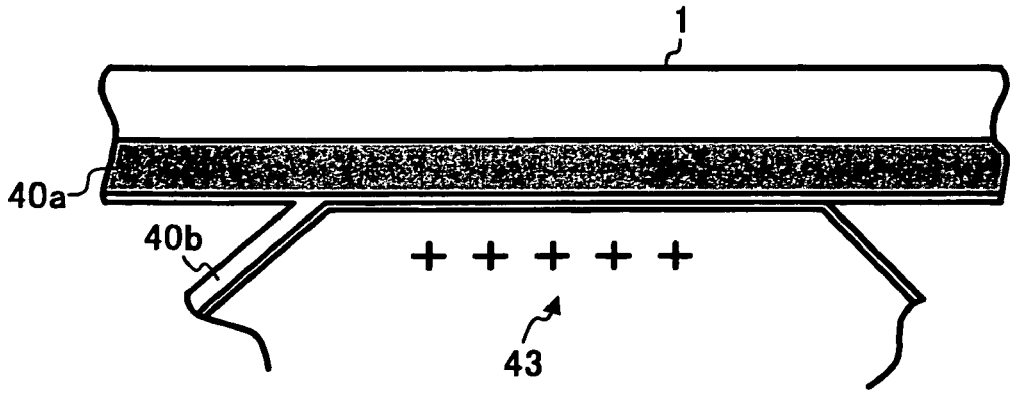
FIGS. 18A and 18B show different conditions of the developer brought to a removal nip formed between the drum and a sweep roller.
Figure 18B:
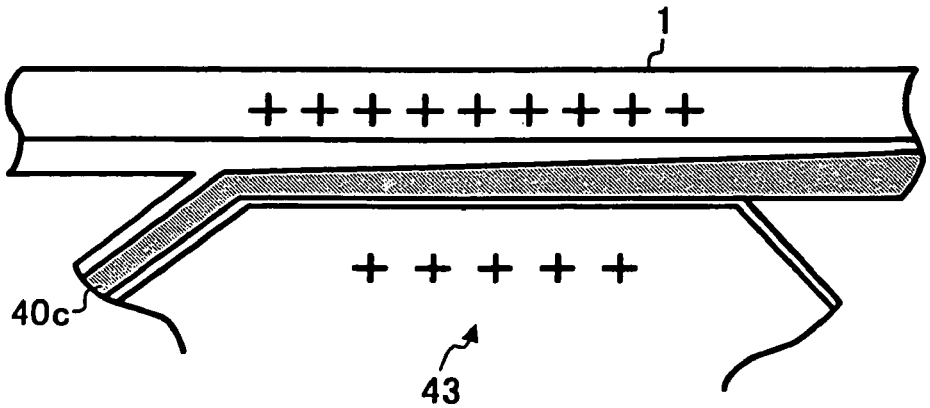

FIGS. 18A and 18B each show a particular condition of the developer present at the removal nip between the drum 1 and the sweep roller 43. A bias voltage (250 V) close to the surface potential (100 V to 200 V) of the toner layer formed on the drum 1 is applied to the sweep roller 43, so that the toner 40*a* is not reversely transferred from the toner layer to the sweep roller 43. As shown in FIG. 18B, the electric field formed by the difference between the background potential of the drum 1 and the bias stated above causes the floating toner to move toward the sweep roller 43. At this stage, the developer layer on the background has thickness about one-half of the thickness of the development nip formed by the developing roller 42 and has a toner content lowered to about 20%. The sweep roller 43 can therefore easily remove the fog toner 40*c* to thereby free the background from fog. The relation (2) stated earlier indicates the above relation between the potentials.

Further, the sweep roller 43 can remove even about one-half of the excess carrier liquid C deposited on the background of the drum 1 during development.

Because the sweep roller 43 efficiently removes the fog toner 40*c*, some fog toner 40*c* may be left at the development nip between the drum 1 and the developing roller 42. This successfully lowers an electric field necessary for removing fog, i.e., a potential difference between the bias applied to the developing roller 42 and the charge potential of the drum 1 and therefore lowers the charge potential required of the drum 1. The illustrative embodiment therefore enhances the durability of the drum 1 reduces the load on the charge roller 2 as well as power necessary fore exposure.

The conventional image forming method sated earlier can effect development and the removal of fog toner with a developer carrier at the same time. Such a method, however, needs a relatively long developing time, e.g., about 40 milliseconds and therefore a large nip width between the image carrier and the developer carrier. In the conventional method, the developer carrier with an elastic layer is pressed against the image carrier to form the above nip, so that relatively high contact pressure is necessary for forming the nip.

By contrast, in the illustrative embodiment, the sweep roller 43 removes the fog toner 40*c* and therefore allows the developing roller 42 to effect only development. This reduces the required nip width and therefore the required contact pressure (e.g. 0.3 kgf/mm or below) and thereby reduces the loads on the developing roller 42 and sweep roller 43 for thereby enhancing durability.

Figure 19:
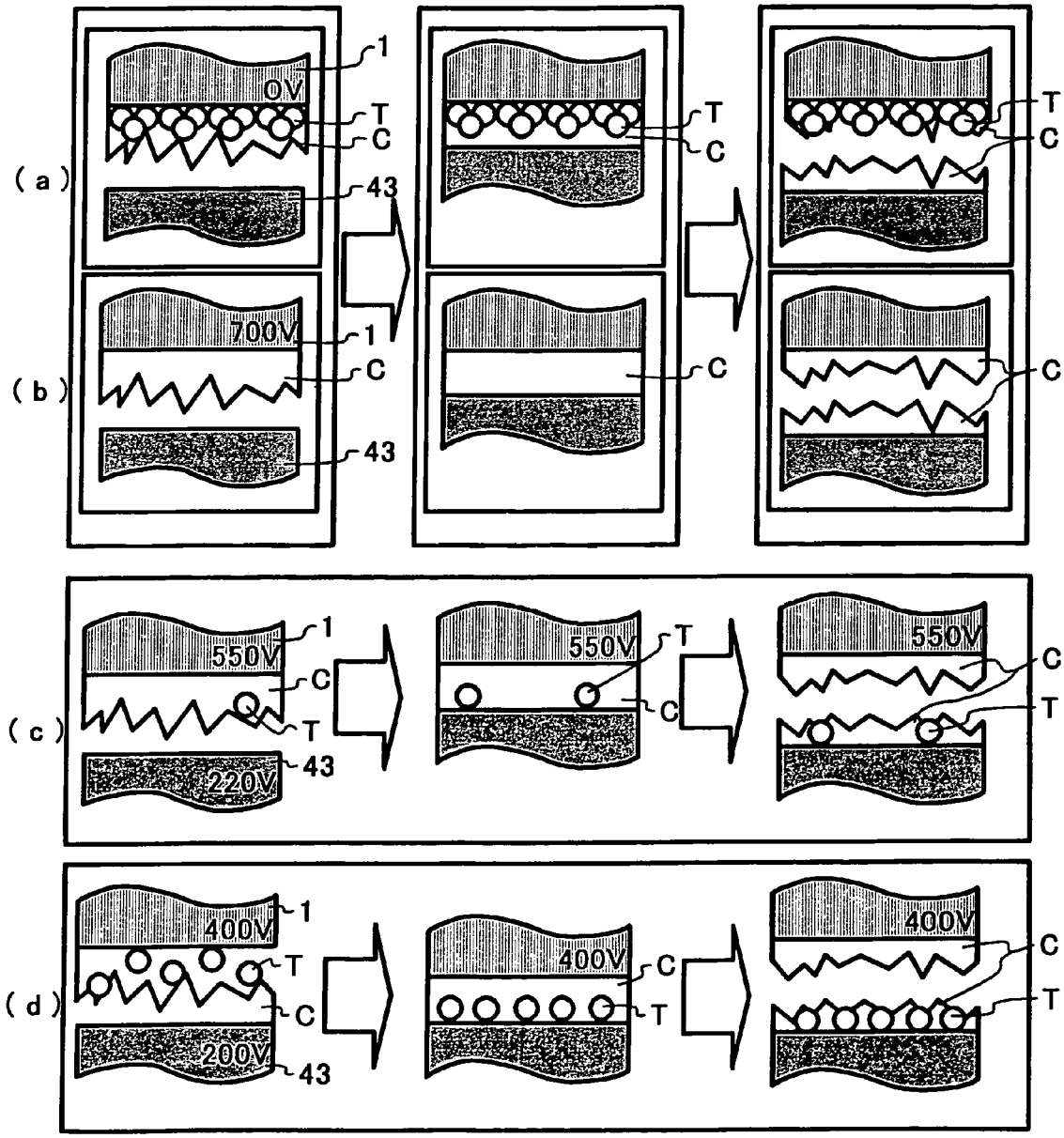
FIG. 19 shows how the sweep roller removes fog toner.

FIG. 19 shows four specific conditions in which the sweep roller 43 removes the fog toner. In the illustrative embodiment, the developer layer formed on the drum 1 is 5 μm thick while the film thickness of the drum 1 is 30 μm thick. In FIG. 19, the bias applied to the sweep roller 43 is assumed to be 200 V. In FIG. 19, (a) shows the image portion of the drum 1 while (b) through (d) each shows the background of the drum 1. The surface potential of the drum 1 is 0 V in the image portion (a) and 770 V, 550 V and 400 V in the background (b), (c) and (d), respectively. The sweep electric field formed between the background and the sweep roller 43 is $4.5\times10^7$ V/m in (b), $3.2\times10^7$ V/m in (c) and $1.8\times10^6$ V/m in (d). As shown, as for the background portion, the sweep electric field causes the fog toner to move. In FIG. 19, (a) through (b) each shows the cohesion of the fog toner or the movement of the toner T.

More specifically, in the image portion (a), the sweep roller 43 parts from the drum 1 while removing only some carrier C and leaving the toner T of the developer. In the condition (b) wherein the surface potential of the background of the drum 1 is sufficiently high, the sweep roller 43 parts the drum 1 while removing about one-half of the carrier C from the background. In the condition (c) wherein some toner T exists on the background of the drum 1 and the sweep electric field is $3.2\times10^7$ V/m, the sweep roller 43 parts the drum 1 while removing the toner T together with about one-half of the carrier C deposited on the background. Further, in the condition (d) wherein much toner T exists on the background, but the sweep electric field is $1.8\times10^6$ V/m, the sweep roller 43 leaves the drum 1 while removing substantially the entire toner T together with one-half of the carrier C present on the background.

However, when the sweep electric field that prevents the toner from depositing on the background is selected, the developer collected by the sweep roller 43 is apt to cohere due to compression ascribable to the electric field. FIG. 20 shows a relation between the electric field and the lump generation rank and background density estimated in the same manner as in FIG. 16. As shown, an increase in sweep electric field lowers the background density toward "clear", but aggravates lump generation rank, i.e. makes toner cohesion noticeable. Stated another way, the toner T coheres more as the sweep electric field increases while the background is more contaminated as the sweep electric field decreases. When the sweep electric field was $5.0\times10^7$ V/m or below, lump generation rank 3 or above was achieved. Particularly, when the sweep electric field was about $3.2\times10^7$ V/m, the toner grains of the developer did not cohere and formed attractive images. When the sweep electric is close to 0 V/m, the image portion and fog toner T cannot be removed.

As shown in FIG. 20, the lump generation rank derived from the strength of the sweep electric field is higher than the lump generation rank derived from the strength of development electric field, meaning that toner coheres little. This is presumably because the number of toner grains in the carrier liquid is small at the sweeping station. However, when the amount of fog tone is large, the sweep electric field is apt to compress the fog toner collected by the sweep roller 43. In such a case, sweeping must be executed with a further weaker electric field.

Figure 21:
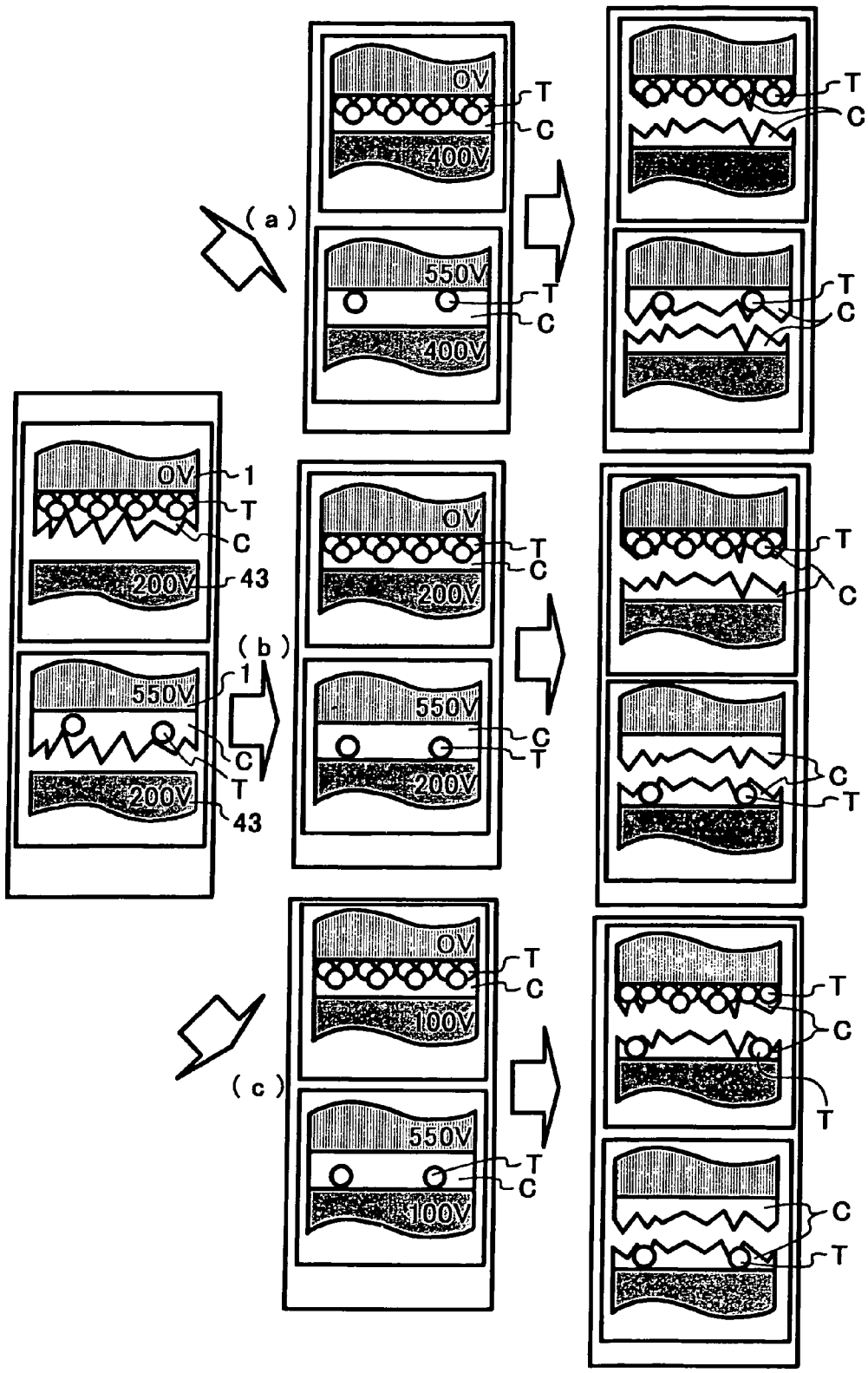
FIG. 21 demonstrates the influence of a sweep electric field on an image.

FIG. 21 demonstrates the influence of the sweep electric field on the image portion. In FIG. 21, While the surface potential of the drum 1 is 0 V in the image portion and 550 V on the background, the potential applied to the sweep roller 43 is 400 V in (a), 200 V in (b) and 100 V in (c). The field strength in the image portion is therefore $-3.6\times10^7$ V/m in (a), $-1.8\times10^7$ V/m in (b) and $-9.1\times10^6$ V/m in (c). Also, the field strength in the background portion is $1.4\times10^7$V/m in (a), $3.2\times10^7$ V/m in (b) and $4.1\times10^7$ V/m in (c).

In the condition (c) wherein 100 V is applied to the sweep roller 43 to intensify the sweep electric field, the sweep roller 43 peels off even the toner grains deposited on the image portion of the drum 1. In the condition (a) wherein 400 V is applied to the sweep roller 43 to weaken the sweep electric field, the sweep roller 43 does not peel off such toner grains, but fails to remove the fog toner T present on the background. By contrast, in the condition (b) wherein 200 V is applied to the sweep roller 43, the sweep roller 43 can remove the fog toner T without peeling off the toner grains deposited on the image portion.

In light of the above, the illustrative embodiment applies 200 V to the sweep roller 43 for forming the sweep electric field of about $3.2\times10^7$ V/m between the background and the sweep roller 43 and thereby achieves lump generation rank 5 and background density "clear". In this condition, the toner coheres little and has weak cohesion, so that the fog toner can be dispersed while being collected and can therefore be repeatedly used.

The lower limit of the sweep electric field may be selected to be $0\times10^7$ V/m, if desired. Although such a lower limit makes it difficult for the electric field to attract the developer from the background toward the sweep roller 43, the sweep roller 43 can remove the developer mechanically transferred to the sweep roller 43 at the position where the sweep roller 43 contacts the drum 1. The crux is that the optical density (ID) of the background lies in the allowable range, preferably 0.01 or below, after removal.

It should be noted that the background electric field and sweep electric field must be optimized so as to satisfy the image density of the background and that of the image as well as toner cohesion. After such optimization, the background electric field and sweep electric field are determined.

The preferable strength of the background electric field is dependent on the mobility of the toner as well. In this sense, although the field strength described above is desirable for the developer used in the illustrative embodiment, it may be varied when use is made of a different kind of toner. The crux is that the developer left on the developing roller 42 after development does not cohere.

The experimental results shown in FIGS. 16 and 20 were derived from negative-to-positive development using a process speed of 300 mm/sec. The range of electric fields capable of reducing the cohesion of toner grains is, of course, dependent on the property of the developer. Positive-to-positive development may be substituted for negative-to-positive development only if the background electric field and sweep electric field described above are dealt with as absolute values.

While the illustrative embodiment causes the surface of the developing roller 42 and that of the drum 1 to move at substantially the same speed, the present invention is practicable even when the former moves at a higher speed than the latter.

As stated above, the illustrative embodiment achieves various advantages, as enumerated below.

(1) In an arrangement that removes toner left in the background of an image carrier with a background electric field, the movement ratio of toner is determined to prevent the toner removed from the background from cohering. This not only improves image quality, but also allows the removed toner to be reused for development.

(2) The movement ratio of toner can be accurately determined in terms of the weight ratio of moving toner.

(3) The movement ratio of toner or the weight ratio of moving toner can be accurately determined by determining the development ratio of the background. In addition, measurement can be performed without regard to the amount of residual carrier.

(4) Cohesion of toner can be obviated if the lower limit of the background development ratio is 10%, if the developing time of the background is so selected as not to cause the toner removed from the background to cohere, or if the upper limit of the background electric field in absolute value is so selected as not to cause the above toner to cohere.

(5) Even when the background development ratio is increased or the electric field for removal is lowered to obviate toner cohesion, a removing member can remove the toner left on the background for thereby reducing, e.g., background contamination ascribable to the increase in background development ratio.

(6) The toner left in the background of the image carrier can be removed in two consecutive steps. This not only protects the background from contamination, but also prevents the removed toner from cohering.

(7) The background electric field and removal electric both can be reduced in absolute value, promoting the obviation of toner cohesion.

(8) Toner images are free from short density or fog.

Third Embodiment

Figure 22A:
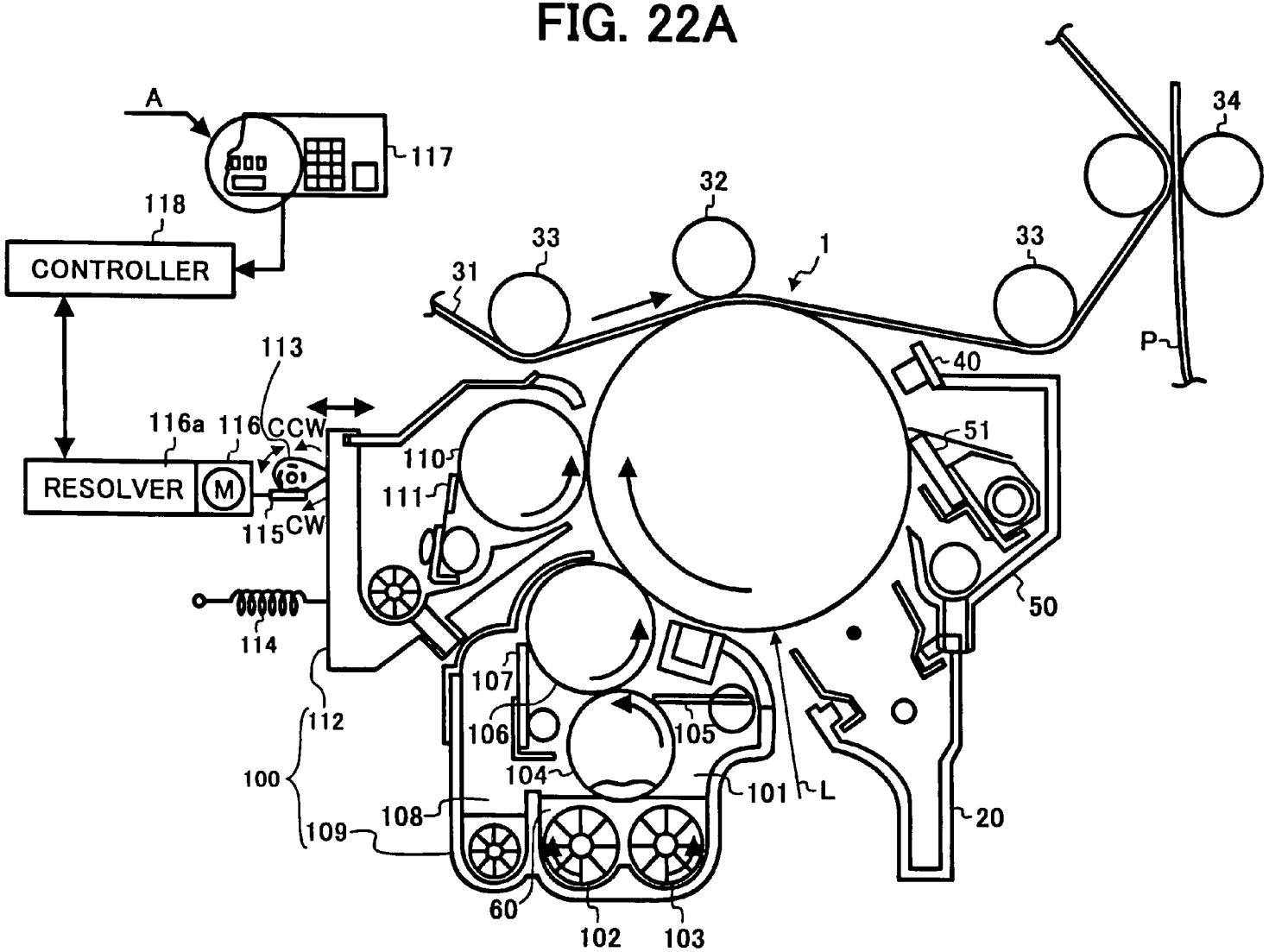
FIG. 22A is a view showing a third embodiment of the present invention.

This embodiment is directed toward the third object stated earlier and implemented as an electrophotographic printer by way of example. As shown in FIG. 22A, the printer includes a photoconductive drum or image carrier 1. Arranged around the drum 1 are a charger 20, an optical writing unit represented by a light beam L, a developing unit 100 storing a developing liquid, an image transferring unit including an intermediate image transfer belt 31 and an image transfer roller 32, a quenching lamp 40, and a drum cleaning unit 50. The surface of the drum 1 is formed of a-Si. Drive means, not shown, causes the drum 1 to rotate in a direction indicated by an arrow in FIG. 22A during operation.

The charger 20 uniformly charges the surface of the drum 1 in the dark by corona discharge. In the illustrative embodiment, the charger 20 charges the drum surface to about 600 V. The charger 20 effecting corona discharge may be replaced with any other suitable charging device, e.g., a charge roller or similar charging member held in contact with the drum 1 and applied with a preselected bias.

The optical writing unit includes scanning optics and scans the charged surface of the drum 1 with an LED array or a laser beam L in accordance with image data, thereby forming a latent image on the drum 1. The developing unit 100 develops the latent image by depositing charged toner thereon to thereby produce a corresponding toner image.

In the image transferring unit, the intermediate image transfer belt (simply belt hereinafter) 31 is passed over the image transfer roller 32 and other rollers 33. A power supply, not shown, applies a bias opposite in polarity to the toner to the image transfer roller 32. The belt 31 is moved in a direction indicated by an arrow in FIG. 22A during printing. The image transfer roller 32 presses the belt 31 against the drum 1, so that a nip for image transfer is formed between the belt 31 and the belt 1. A potential difference between the surface of the image transfer roller 32 applied with the bias and the surface of the drum 1 forms an electric field at the nip for image transfer. When the toner image is conveyed by the drum 1 to the nip, it is transferred from the drum 1 to the belt 31 by the above electric field and nip pressure (primary image transfer). If desired, the image transfer roller 32 may be replaced with an image transfer member using corona discharge, adhesion or heat.

After the primary image transfer, a secondary image transfer roller 34 transfers the toner image from the belt 31 to a sheet P (secondary image transfer). The sheet P with the toner image is conveyed to a fixing unit, not shown, and has the toner image fixed thereby. The sheet P coming out of the fixing unit is driven out of the printer as a print.

The quenching lamp 40 dissipates charges left on the surface of the drum 1 moved away from the image transfer nip. Subsequently, the drum cleaning unit 50 removes the developing liquid left on the drum 1 with a cleaning blade 51 to thereby prepare the drum 1 for the next printing cycle.

The developing unit 100 is generally made up of a developing section 109 and a sweeping section 112. The developing section 109 includes a tank 101 storing the developing liquid, a pair of agitators 102 and 103 implemented as screws, an Anilox roller 104, a doctor blade 105, a developing roller 106, a cleaning blade 107, and a returning portion 108. The sweeping section 112 includes a sweep roller 110, a cleaning blade 111, and a carrier collecting device.

The developing liquid, labeled 60, stored in the tank 101 is made up of toner and liquid carrier. The developer liquid 60 is a high viscosity, high density developing liquid as distinguished from an ordinary low viscosity, low density developing liquid. The ordinary developing liquid contains about 1 wt % of toner in an insulative liquid carrier Isopar and has viscosity of about 1 mPa·s. The highly viscous, dense developing liquid contains about 5 wt % to 40% of toner in an insulative carrier liquid and has viscosity of 50 mPa·s to 10,000 mPa·s; the carrier liquid may be implemented by silicone oil, normal paraffin, Isopar M, vegetable oil or mineral oil.

The carrier liquid may be either volatile or nonvolatile, depending on the application. While a volatile carrier liquid is advantageous over a nonvolatile carrier as to fixation, it is apt to cause toner to adhere in the printer when the printer is left unused for a long time, increasing a load at the restart of the printer. A nonvolatile carrier liquid does not bring about such a problem. The grain size of toner dispersed in the carrier liquid is controlled in the range of from submicrons to about 10 μm in matching relation to the developing ability and image forming ability of the printer.

The agitators or screws 102 and 103 are positioned in parallel to each other in the developing liquid 60 stored in the tank 101. Drive means, not shown, causes the agitators 102 and 103 to rotate in opposite directions to each other, as indicated by arrows, for thereby agitating the developing liquid 60. As a result, the liquid level of the developing liquid 60 rises between the agitators 102 and 103 and deposits on the Anilox roller 104 positioned above the agitators 102 and 103.

Drive means, not shown, causes the Anilox roller or coating roller 104 to rotate in a direction indicated by an arrow in FIG. 22A. The Anilox roller 104 in rotation scoops up the developer 60. More specifically, a plurality of recesses, not shown, are formed in the circumference of the Anilox roller 104 and store part of the developer 60 scooped up therein.

The doctor blade or regulating member 105 is formed of stainless steel or similar metal and held in contact with the Anilox roller 104 being rotated. In this condition, the doctor blade 105 scrapes off the developer 60 deposited on the Anilox roller 104. As a result, the amount of the developer 60 on the Anilox roller 104 is accurately measured to a value corresponding to the total capacity of the dents of the Anilox roller 104.

The developing roller 106 contacts part of the surface of the Anilox roller 104 moved away from the doctor blade 105. The surface of the developing roller 106 moves in the opposite direction to the surface of the Anilox roller 104, as seen at the point of contact or coating nip. At the coating nip, the developing liquid is coated on the developing roller 106 in the form of a thin layer having a uniform thickness because of the above configurations.

Further, while the feed of the developing liquid 60 to the developing roller 106 begins at the outlet side of the coating nip, the developing liquid 106 deposited on the developing roller 106 is moved in the direction opposite to the direction of feed. In this configuration, if the maximum pressure at the coating nip is higher than a preselected value, then the thickness of the thin developer layer on the developing roller 60 does not depend on the maximum pressure. Therefore, it is also possible to free the developer layer from irregular thickness ascribable to the pressure at the coating nip.

A conductive, elastic layer is formed on the circumference of the developing roller 106. The developing roller 106 is rotated at the same speed as the drum 1 in contact with the drum 1, forming a development nip. A power supply, not shown, applies a bias of the same potential as the toner to the developing roller 106. As a result, a potential difference between the developing roller 106 and the drum 1 forms an electric field for development at the development nip.

More specifically, at the development nip, the developing roller 106 and the background and latent image of the drum 1 are of the same polarity as the toner; the potential is highest on the background, medium on the developing roller 106 and lowest on the latent image. Therefore, an electric field causing the toner to electrostatically move from the background toward the developing roller 106 is formed between the background and the developing roller 106. Also, an electric field causing the toner to move from the developing roller 106 toward the latent image is formed between the developing roller 106 and the latent image. In this condition, at the development nip, the toner present in the thin developer layer moves toward the developing roller 106 away from the background by electrophoresis and gathers there. Also, the toner moves toward the latent image away from the developing roller 106 by electrophoresis and deposits thereon, developing the latent image.

Figure 23A:
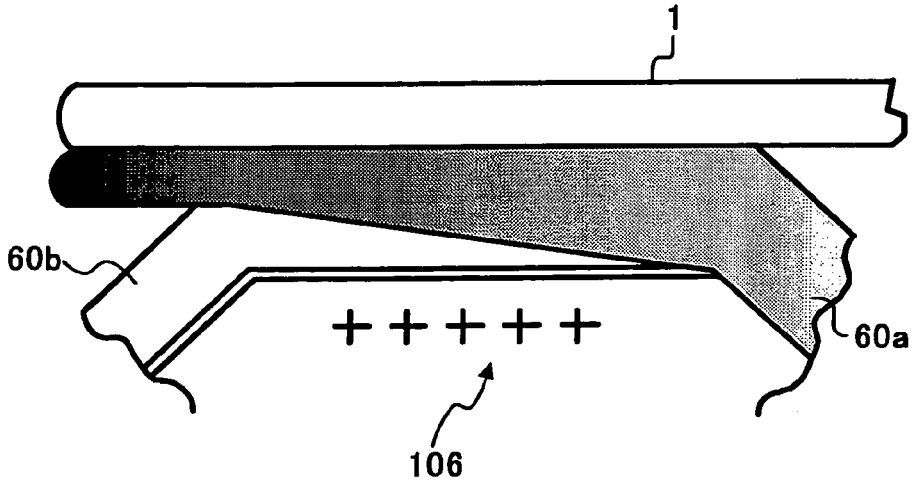
FIGS. 23A and 23B show the conditions of the developer brought to a development nip.
Figure 23B:
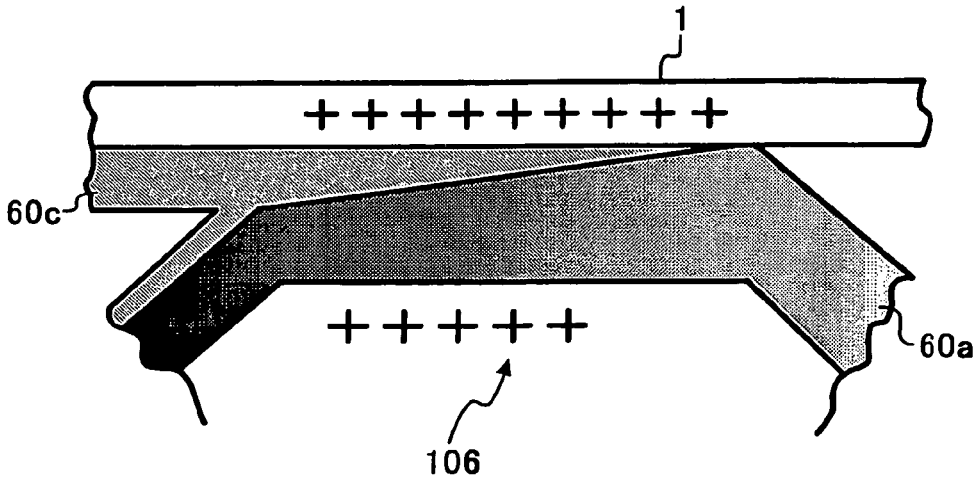

FIGS. 23A and 23B show the conditions of the developing liquid 60 at the development nip. A development bias of 400 V lower than the surface potential of 600 V of the drum 1 is applied to the developing roller 106. The bias forms a development electric field between the developing roller 106 and the image portion of the drum 1 lowered in potential to 50 V or below by the optical writing unit. Also, a background electric field is formed between the developing roller 106 and the background of the drum 1. As shown in FIG. 23A, toner 60*a* contained in the developer 60 separates from carrier liquid 60*b* moves to the drum 1 due to the above electric field and develops a latent image. As shown in FIG. 23B, in the background or non-image portion, the background electric field formed by the bias and the potential of the drum 1 attracts the toner 60*a* toward the developing roller 106 for thereby preventing it from remaining on the background as far as possible.

The cleaning blade 107 is formed of, e.g., metal or rubber and held in contact with part of the surface of the developing roller 106 moved away from the development nip. In this position, the cleaning blade 107 scrapes off the developing liquid left on the developing roller 106, thereby initializing the surface of the developing roller 106. The cleaning blade 106 may be replaced with a cleaning roller, if desired. The developing liquid removed by the cleaning blade 107 is returned to the tank 101 via the returning portion 108. The developing roller 106 may, of course, be replaced with a plurality of developing rollers.

The developing unit 109 develops the latent image formed on the drum 1 in the above-described manner.

As for the development nip, it is necessary to guarantee a developing time long enough for the toner to sufficiently move by electrophoresis; the developing time refers to a period of time over which the thin developer layer passes the development nip. The developing time is dependent on the width of the development nip and the process linear velocity, i.e., the peripheral speed of the drum 1 and developing roller 106. The illustrative embodiment guarantees the above developing time by selecting a development nip width equal to or larger than a product of the process linear velocity and a development time constant. The development time constant refers to a period of time necessary for the amount of development to saturate and is produced by dividing the process linear velocity by the minimum development nip width necessary for the saturation of the amount of development. For example, if the process linear velocity is 300 mm/sec and if the development time constant is 10 milliseconds, then the development nip width is 3 mm. This is also true with a removal nip to be described later.

The toner in the thin developer layer moves toward the developing roller 106 away from the background and gathers there, as stated earlier. Theoretically, therefore, the toner does not deposit on the background. In practice, however, some toner grains with short amounts of charge are apt to move by electrophoresis later than the other toner grains and deposit on the background, fogging the background. The sweeping section 112 removes such fog toner from the drum 1.

More specifically, the sweep roller 110 included in the sweeping section 112 is covered with a conductive, elastic layer formed of, e.g. conductive urethane rubber. The sweep roller 110 rotates at substantially the same speed as the drum 1 in contact with the drum 1, forming a removal nip. A power supply, not shown, applies a bias of the same polarity as the toner to the sweep roller 110. As a result, a potential difference between the sweep roller 110 and the drum 1 forms a sweep electric field at the removal nip.

Figure 24A:
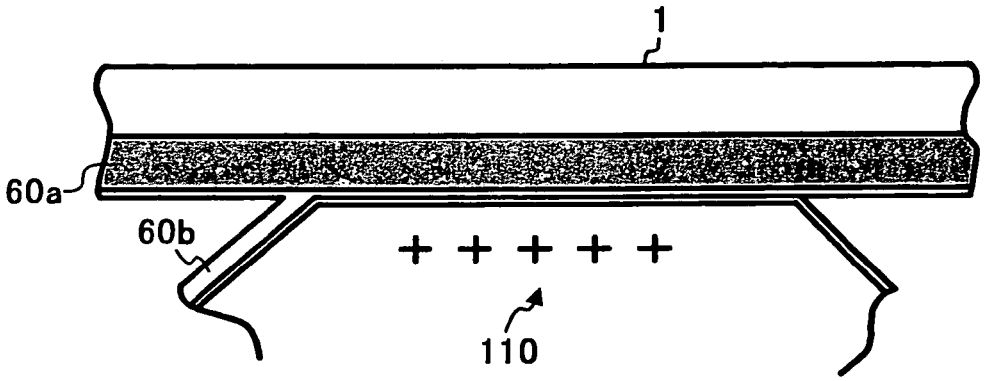
FIGS. 24A and 24B show the conditions of the developer brought to a removal nip between the drum and a sweep roller.
Figure 24B:
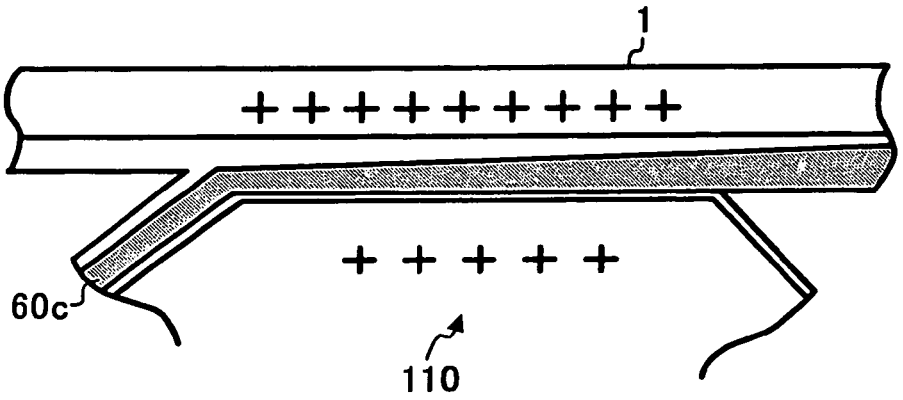

FIGS. 24A and 24B show the conditions of the developing liquid at the removal nip between the drum 1 and the sweep roller 110. A bias of 250 V close to the surface potential of 100 V to 200 V of the toner layer formed on the drum 1 is applied to the sweep roller 110, so that the toner 60*a* is not returned to carrier liquid 60*b* from the toner layer deposited on the latent image to the sweep roller 110. As shown in FIG. 24B, as for the background portion, an electric field formed by a difference in potential between the background and the above bias causes floating fog toner 60*c* to move toward the sweep roller 110. Consequently, the background is fully protected from fogging.

By the above procedure, the fog toner failed to gather on the developing roller 106 at the development nip is caused to move toward the sweep roller 110 away from the background of the drum 1 and is fully removed thereby.

The sweep roller 110 can additionally remove about 70. % of the excess carrier liquid deposited on the background of the drum 1 during development. The surface of the sweep roller 110 moves at substantially the same speed as the surface of the drum and therefore does not disturb the toner image present on the drum 1.

The cleaning blade 111 is formed of e.g., metal or rubber and held in contact with part of the surface of the sweep roller 110 moved away from the removal nip. In this position, the cleaning blade 111 scrapes off the developing liquid collected on the sweep roller 110, thereby initializing the surface of the sweep roller 110.

The developing roller 106 and sweep roller 110 each should preferably be coated with a conductive material or covered with a conductive tube so as to have smoothness (Rz) of 3 μm or below. Such smoothness is essential also in the sense that the developing roller 106 and sweep roller 110 should support the thin developer layer as thin as 3 μm to 10 μm.

The conductive, elastic layer formed on each of the developing roller 106 and sweep roller 110 should preferably be formed of a material whose hardness is 50° or below in terms of JIS A scale. This is because to guarantee the development nip and removal nip each having a particular width, as stated above, despite the use of hard a-Si for the surface of the drum 1, the conductive, elastic layer must be freely deformable. While a softer material broadens the controllable range of the development nip, an excessively soft material is not desirable because of plastic deformation and other defects.

The conductive, elastic layer of the developing roller 106 or that of the sweep roller 110 may be formed of conductive urethane rubber (provided with conductivity by, e.g., carbon), as stated previously. Urethane rubber may be replaced with any other suitable material so long as it is conductive and does not swell or dissolve on contacting the carrier liquid. Further, so long as the surface of the developing roller 106 and that of the sweep roller 110 are conductive, do not swell or dissolve on contacting the carrier liquid and keep the inside from the carrier liquid, elastic layers inward of the above surfaces should only be elastic.

The illustrative embodiment is capable of varying the amount of the carrier liquid to be removed from the thin developer layer formed on the drum 1, thereby optimizing the amount of the carrier liquid in the developer layer in accordance with the property of a sheet. Specific configurations for achieving this purpose will be described hereinafter.

EXAMPLE 1

Figure 22B:
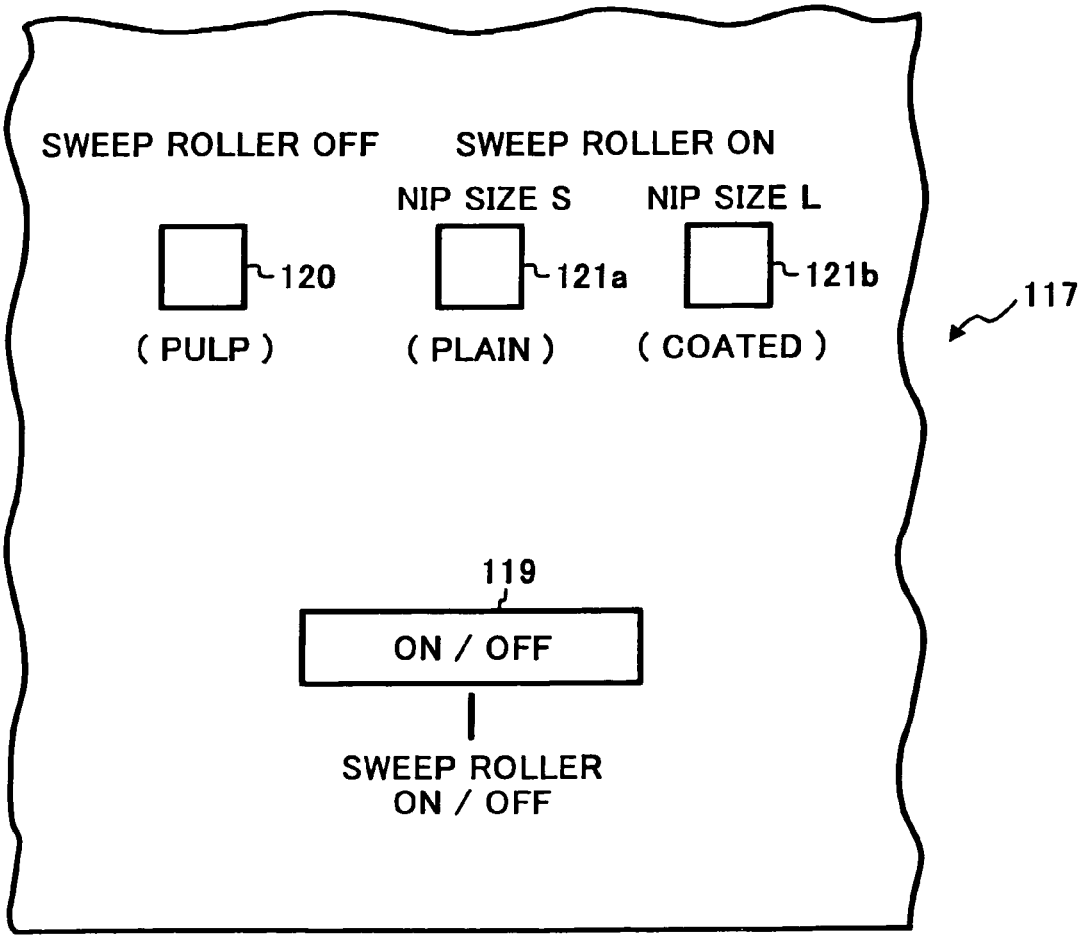
FIG. 22B is an enlarged view showing a control panel included in the third embodiment.

As shown in FIG. 22A, an eccentric cam 113 allows the sweeping section 112 to bodily move over a preselected range in the right-and-left direction. In FIG. 22A, the sweeping section 112 is shown at its rightmost position, pressing the sweep roller 110 against the drum 1. A tension spring 114 constantly biases the sweeping section 112 to the left, as viewed in FIG. 22A, so that the eccentric cam 113 moves the sweeping section 112 rightward or leftward when rotated. A stepping motor 116 drives the eccentric cam 113 via a worm gear 115. A resolver or rotation sensor 116*a* is associated with the stepping motor 116. A controller 118 controls the rotation of the stepping motor 116 in accordance with the operation of a control panel 117. FIG. 22B is an enlarged view of a portion A shown in FIG. 22A.

Figure 25A:
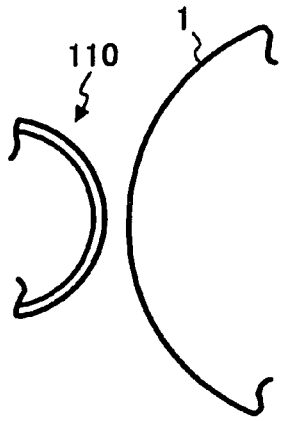
FIG. 25A shows a condition wherein the sweep roller is spaced from the drum.
Figure 25B:
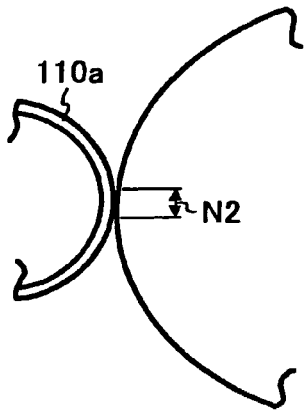
FIG. 25B shows a condition wherein the sweep roller and drum contact each other in such a manner as to form a small nip width.
Figure 25C:
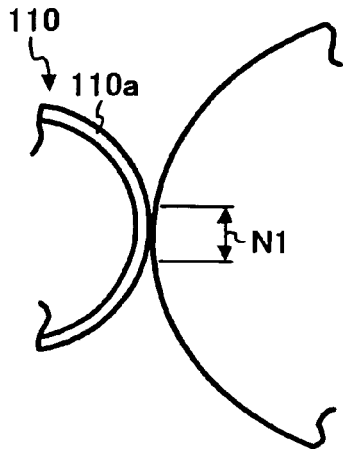
FIG. 25C shows a condition where the sweep roller and drum contact each other in such a manner as to form a large nip width.

FIG. 25C is a fragmentary enlarged view showing the rightmost position of the sweeping section 109 more specifically. As shown, a conductive, elastic layer 110*a* formed on the sweep roller 110 is noticeably deformed to form the removal nip, labeled N1, which may be 3 mm wide by way of example. This nip width NI allows the sweep roller 17.0 to remove the carrier liquid from the drum 1 by the largest amount and is desirable when use is made of a coated sheet. In this case, an LED 121*b* shown in FIG. 22B and indicative of a large nip width (NIP SIZE L), which forms part of sweep roller ON display, is turned on.

The operator of the printer can operate the control panel 117 to switch the removal nip width or to release the sweep roller 110 from the drum 1 in accordance with the kind of a sheet to be used, i.e., a sheet to be fed from a sheet cassette, not shown, or from a manual sheet tray not shown. For example, a rough sheet, a liquid-absorptive sheet, a non-coated sheet or a sheet coated little, e.g., pulp paper is used, the operator operates the control panel 117 to release the sweep roller 110 from the drum 1 because much developer must be deposited. For this purpose, the operator pushes a sweep roller ON/OFF button 119 shown in FIG. 22B once. In response, the controller 118 drives the stepping motor 116 so as to rotate the eccentric cam 113 counterclockwise by a preselected angle, while turning on sweep roller OFF display 120 shown in FIG. 22B. The eccentric cam 113 so rotated causes the sweeping section 112 to move leftward under the bias of the tension spring 114. As a result, as shown in FIG. 25A, the sweep roller 110 is released from the drum 1. In this condition, although the sweep roller 110 does not remove the excess carrier liquid from the developer layer formed on the drum 1, a high-quality image is attained.

When use is made of, e.g., a plain sheet intermediate between a pulp sheet and a coated sheet in absorptivity, the operator again pushes the sweep roller ON/OFF button 119. In response, the controller 118 drives the stepping motor 116 so as to rotate the eccentric cam 113 clockwise by a preselected angle, while turning on an LED 121*a* indicative of a small nip width (NIP SIZE S). As a result, as shown in FIG. 25B, the sweep roller 110 is brought into contact with the drum 1 to such a degree that the elastic, conductive layer 110*a* slightly deforms to form a small nip width N2, which may be 1.5 mm by way of example. The small nip width N2 is suitable for, e.g., a plain sheet although it reduces the amount of the carrier liquid to be removed by the sweep roller 110. If the operator again pushes the sweep roller ON/OFF button 119, then the eccentric cam 113 is further rotated clockwise to set up the condition shown in FIG. 25C.

If desired, an arrangement may be made such that the sweep roller 110 is simply moved into or out of contact with the drum 1, in which case the surface of the drum 1 and that of the sweep roller 110 both may be implemented by a rigid material.

The developer layer formed on the drum 1 after development should preferably be as thin as 20 μm or less, more preferably 10 μm or less. If the developer film of the drum 1 is thicker than 20 μm, then it is difficult for the developer film to enter the removal nip between the sweep roller 110 and the drum 1 although the difficulty is dependent on the relation between the pressure acting between the sweep roller 110 and the drum 1. As a result, the developer film of the drum 1 is shaved off and therefore thinned. On the other hand, a thin film allows a small potential difference to form a strong electric field, so that the excess liquid can be removed without the toner from being removed from the image portion. It follows that an attractive image free from defective transfer, the thickening of characters and the blurring of a trailing edge is achievable.

The relation described above in relation to the film thickness is also true with the weight ratio of the carrier liquid contained in the developing liquid, which is present on the drum 1 after development. More specifically, the weight ratio of the carrier liquid on the surface of the drum 1 after development should preferably be 85% or below. The carrier liquid is lower in viscosity than the solid toner grains therefore, if the ratio of the carrier liquid to the entire developing liquid is higher than 85%, then the viscosity of the entire developing liquid is lowered although this is dependent on the relation between the pressure of the sweep roller 110 acting on the drum 1 and the viscosity of the developing liquid. This makes it difficult for the developer film of the drum 1 to enter the removal nip. As a result, the developer film of the drum 1 is shaved off and therefore thinned.

EXAMPLE 2

Figure 26A:
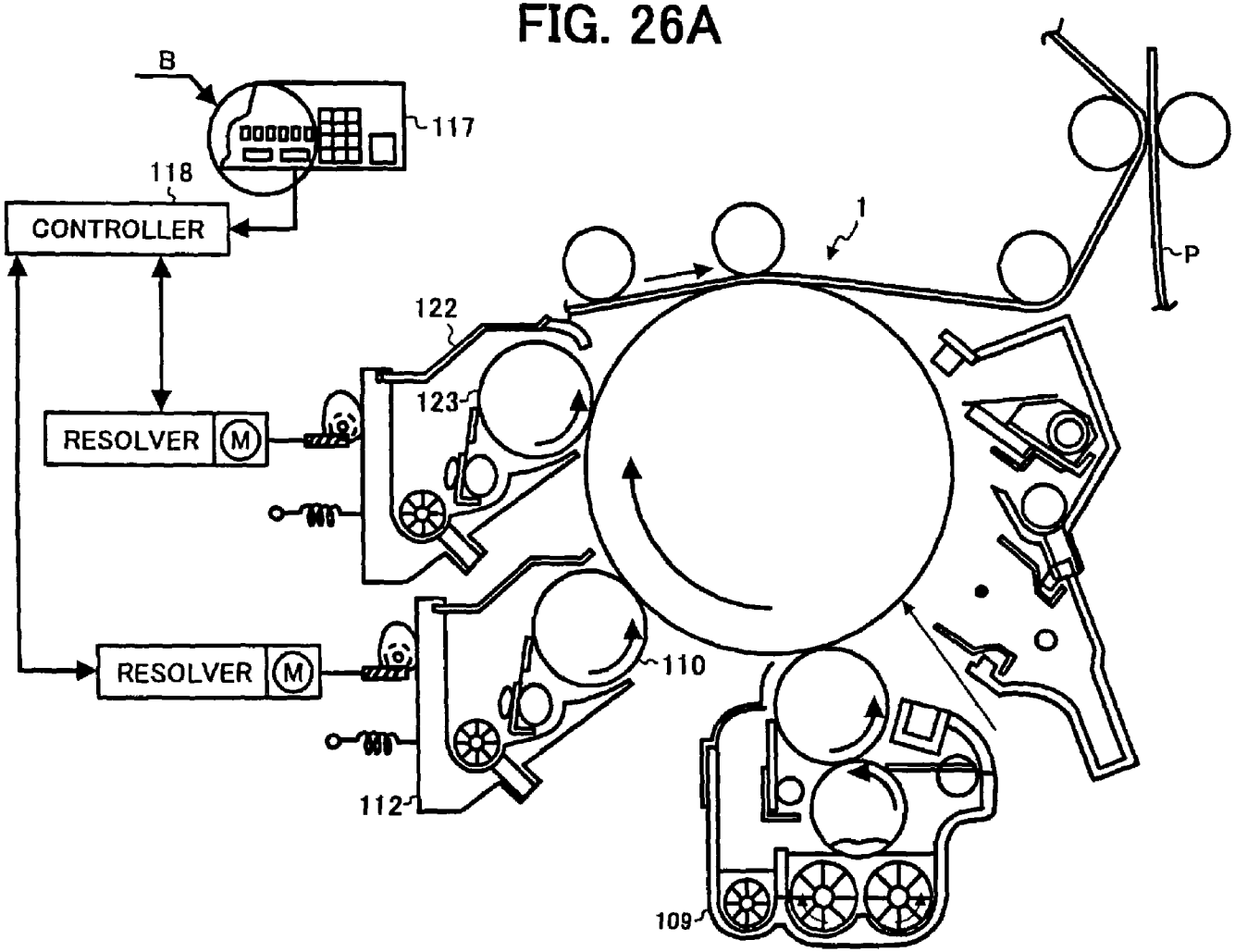
FIG. 26A is a view showing an image forming apparatus representative of Example 2 of the third embodiment.
Figure 26B:
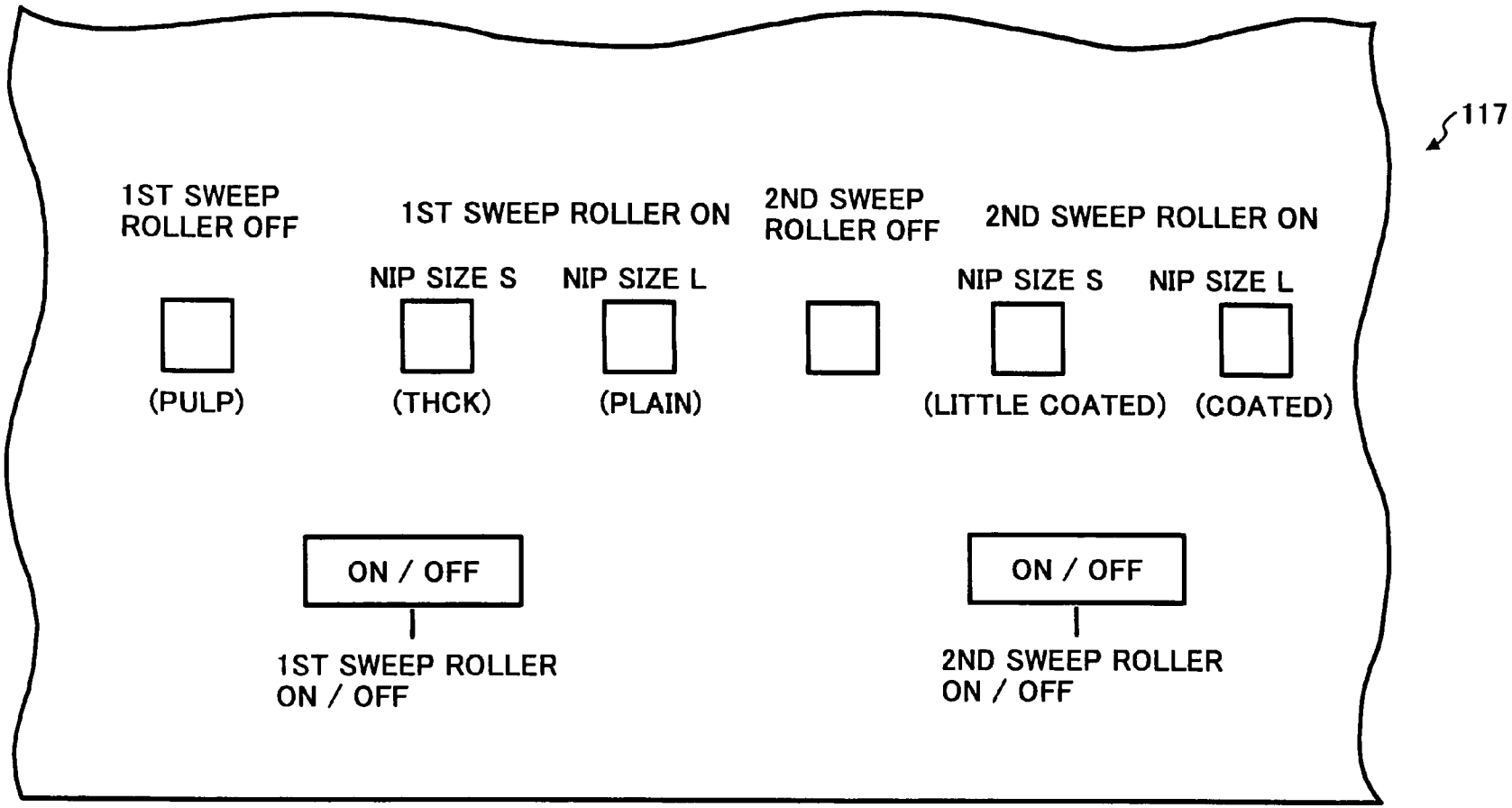
FIG. 26B is an enlarged view of a control panel included in the apparatus of Example 2.

Example 2 is configured to control the amount of the carrier to be removed more accurately than Example 1 for thereby implementing optimal image transfer with various kinds of sheets. As shown in FIG. 26A, Example 2 includes a second sweeping section 122 in addition to the first sweeping section 112. As shown in FIG. 26B, the control panel additionally includes a section "B" assigned to the second sweeping section 122 and identical in configuration with the section assigned to the first sweeping section 112.

The second sweeping section 122 is interlocked to the first sweeping section 112 such that its sweep roller 123 contacts the drum 1 only when the sweep roller 110 of the first sweeping section 112 contacts the drum 1. As for the rest of the configuration, the second sweeping section 122 is identical with the first sweeping section 112.

Assume that the removal nip width between the sweep roller 110 and the drum 1 and the removal nip width between the sweep roller 123 and the drum 1 each can be switched between a small nip width of 1.0 mm and a large nip width of 2.5 mm. Then, there are available four different nip widths, i.e., 1.0 mm, 2.5 mm, 3.5 mm and 5.0 mm by the combination of the sweeping sections 112 and 122. Example 2 can therefore control the amount of removal of the carrier liquid more delicately than Example 1. While in Example 2 the sweep rollers 110 and 123 both are movable into or out of contact with the drum 1 together, the crux is that at least one of them be so movable in accordance with the property of a sheet to be used.

EXAMPLE 3

Figure 27:
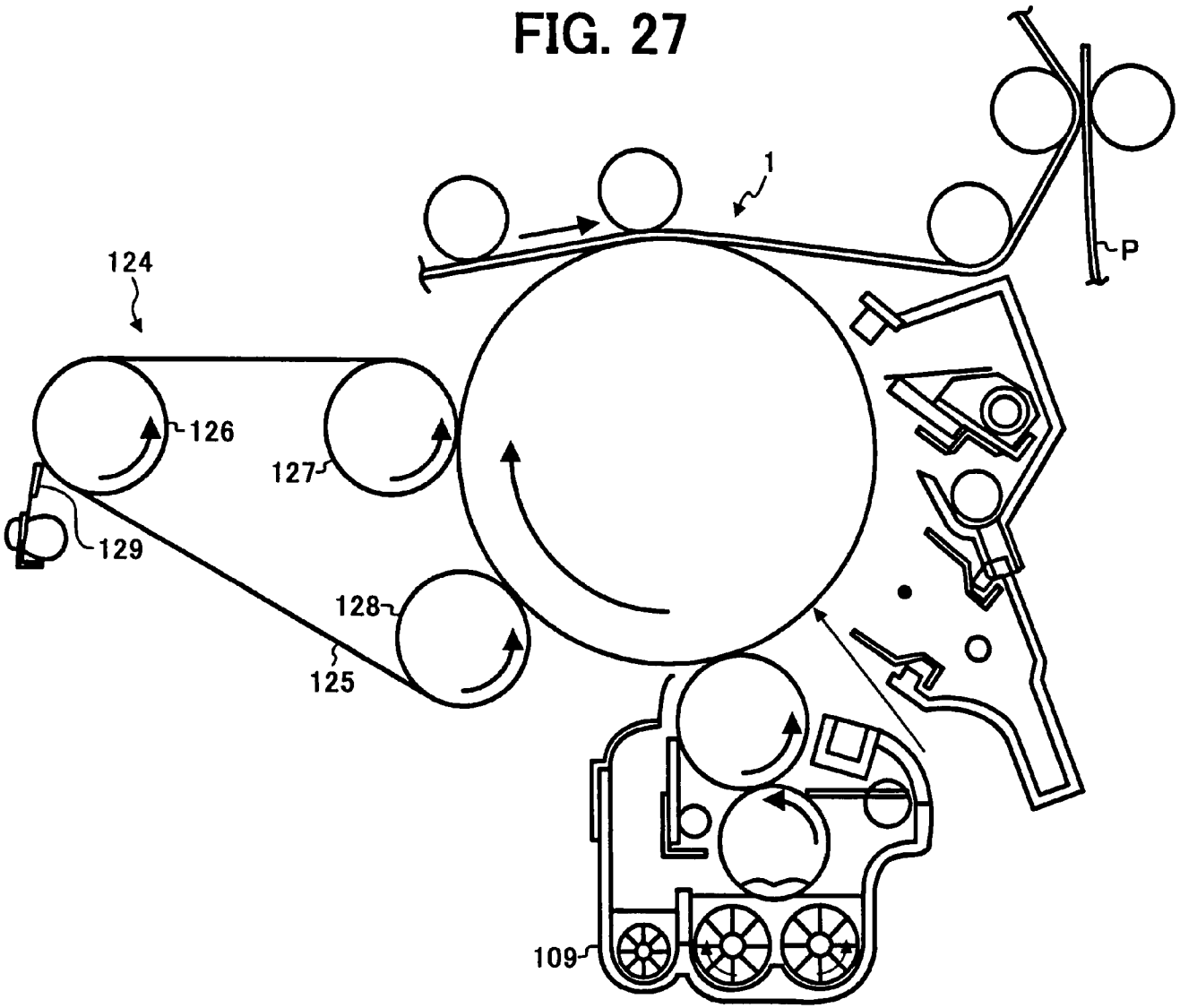
FIG. 27 is a fragmentary view showing an image forming apparatus representative of Example 3 of the third embodiment.

Example 3 uses a sweep belt in place of the sweep roller as excess liquid removing means. As shown in FIG. 27, a sweeping section 124 includes a sweep belt 125 passed over a drive roller 126 and a pair of driven rollers 127 and 128, and a cleaning blade 129 for cleaning the sweep belt 125. The sweep belt 125 implements a larger nip width more easily than the sweep roller. A larger nip width successfully increases a period of time over which the bias for removal is applied, making it possible to remove the excess carrier liquid without removing the toner of the image portion. Further, the sweeping section 124 with the sweep belt 125 occupies a smaller space than the sweeping sections 112 and 122 of Example 2, promoting the free layout of structural parts.

The nip width between the belt 126 and the drum 1 is controllable in terms of the distance between the driven rollers 127 and 128. For example, an arrangement is made such that the driven roller 127 at the downstream side of the nip is supported in such a manner as to be movable toward or away from the driven roller 128 along the surface of the drum 1. When use is made of a coated sheet lacking absorptivity, the driven roller 127 is moved away from the driven roller 128. When use is made of a plain sheet more absorptive than a coated sheet, the driven roller is moved toward the driven roller 128. A tension roller, not shown, adjusts tension to act on the sweep belt 125. If desired, the sweeping section 124 may be bodily moved in the right-and-left direction, as viewed in FIG. 27, in order to control the nip width, if desired.

EXAMPLE 4

Figure 28:
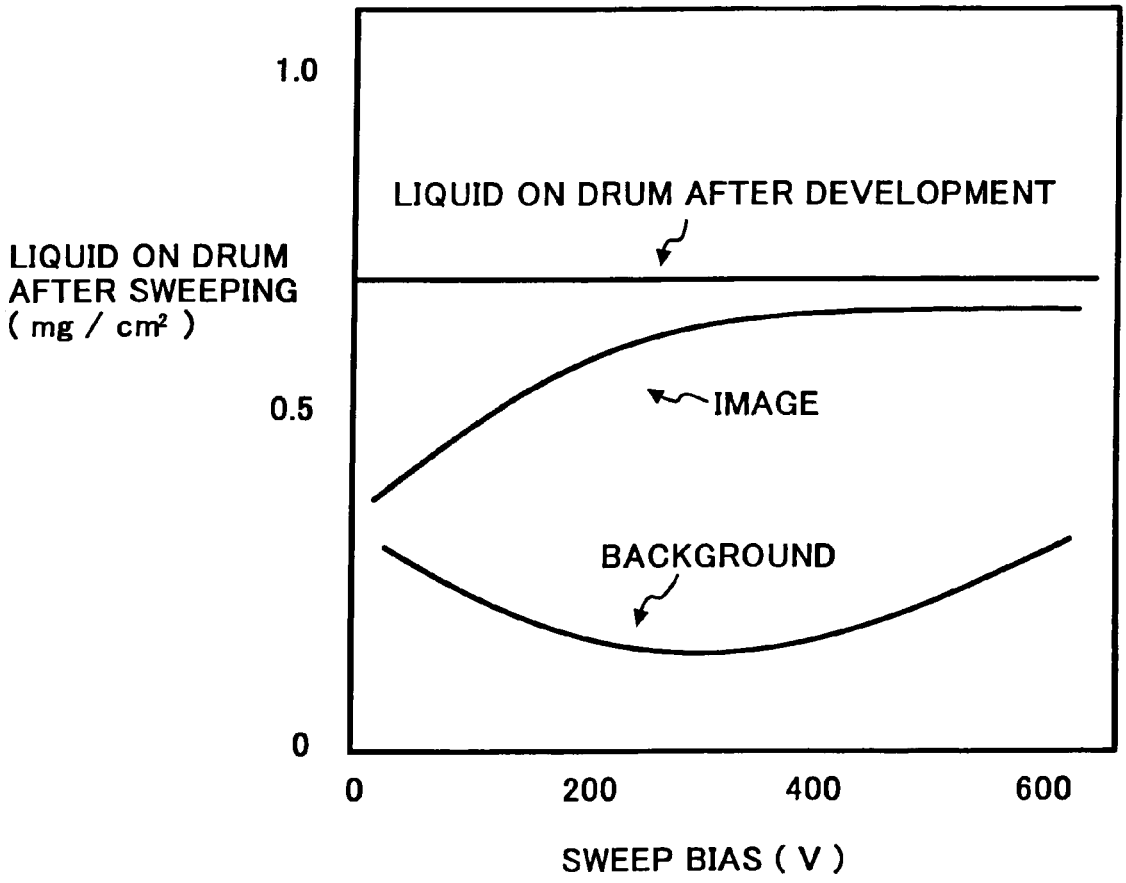
FIG. 28 is a graph showing a relation between the amounts of liquid to deposit on the image and background of the drum and a sweep bias determined with a single sweep roller.
Figure 29:
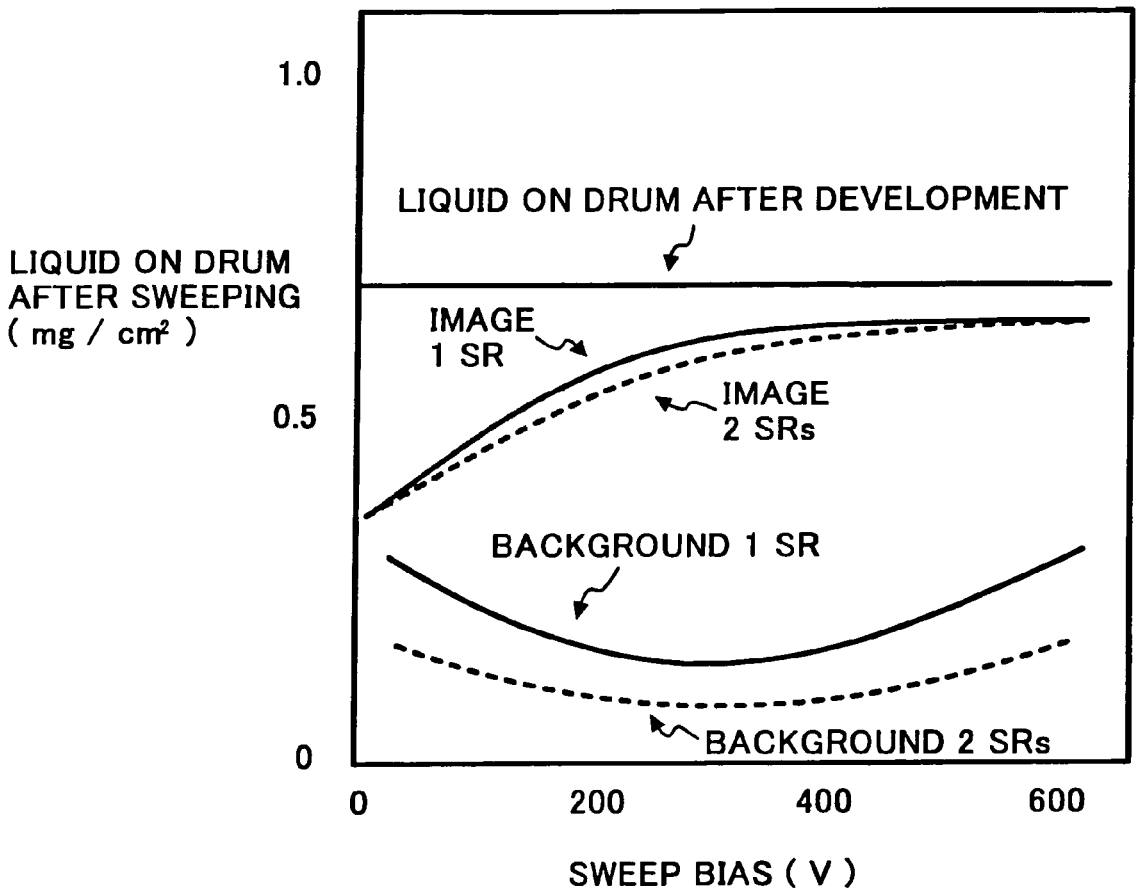
FIG. 29 is a graph showing a relation between the amounts of liquid to deposit on the image and background of the drum and a sweep bias determined with a single sweep roller.

When the voltage to be applied to the sweep roller ore excess liquid removing member is varied, the amount of removed liquid varies. As a result, as shown in FIGS. 28 and 29, the amount of liquid present in the drum after sweeping varies. FIGS. 28 and 29 respectively pertain to Example 1 including a single sweep roller and Example 2 including two sweep rollers. In FIGS. 28 and 29, a sweep bias refers to a voltage applied to the sweep roller. The charge potential of the drum or image carrier is assumed to be about +650 V at the time of development while the potential of the image portion is assumed to be about +50 V. Use is made of toner chargeable to positive polarity.

The image formed on the drum by development contains the toner and carrier, but mainly the carrier is present on the background although some toner is present, too. In FIG. 29, in a range where the amount of deposition on the image is particularly small, the amount of toner is also small. That is, the sweep roller removes even the toner and thereby lowers image density. In such a case, the sweep bias should preferably be between about 300 V and 600 V.

Figure 30:
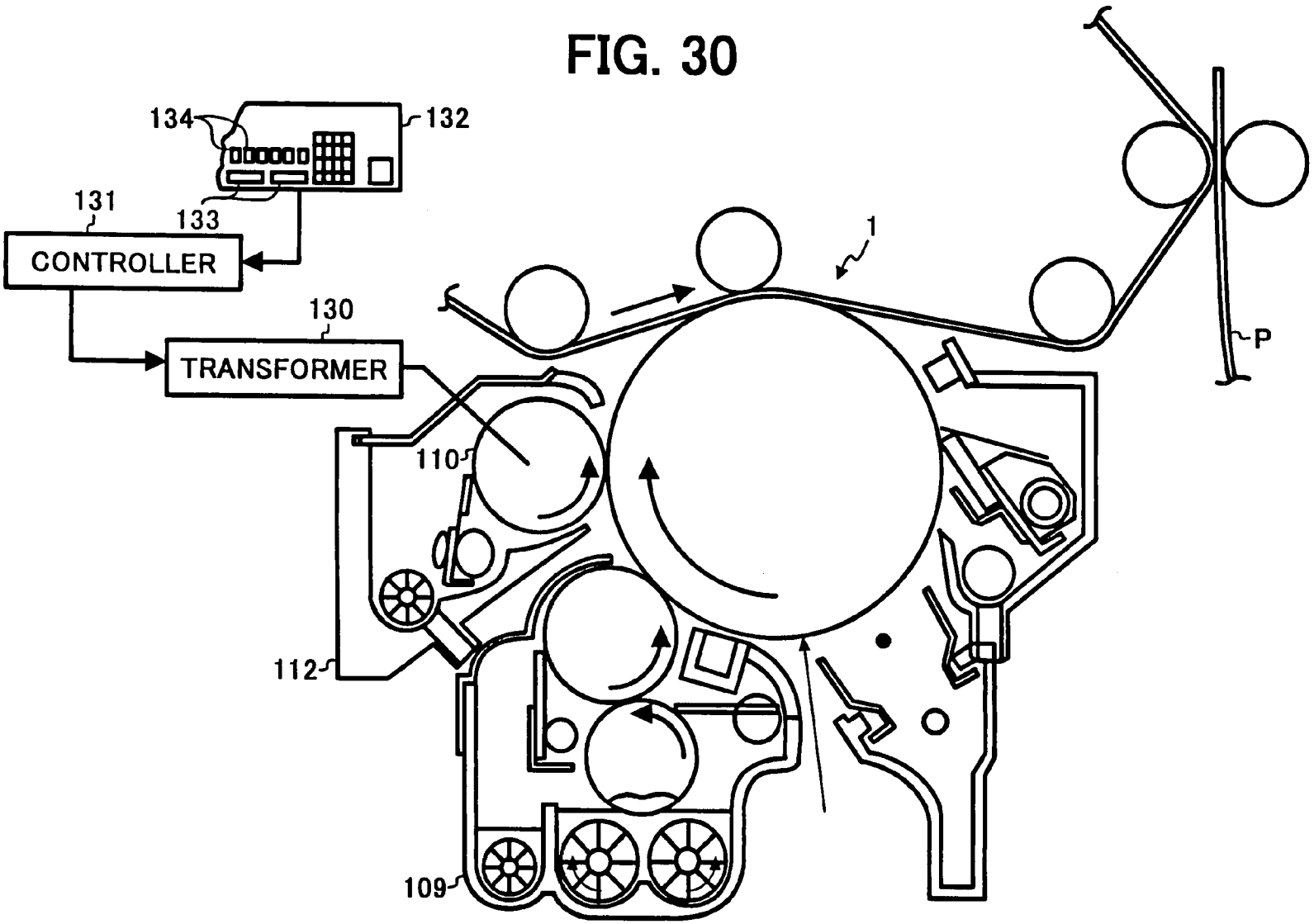
FIG. 30 is a fragmentary view showing an image forming apparatus representative of Example 4 of the third embodiment.

Considering the relations shown in FIGS. 28 and 29, Example 4 allows the sweep bias to be switched in accordance with the property of a sheet to be used. Specifically, as shown in FIG. 30, a control panel 132 is connected to a controller 131 that controls a DC transformer 130 assigned to the sweep roller 110. The control panel 132 includes an UP switch and a DOWN switch, collectively 133, for allowing the operator to switch a voltage to be applied to the sweep roller 110, and level indicators 134 for indicating a level selected on the switches 133. The controller 131 switches the voltage to be applied to the sweep roller 110 in accordance with a command input on the UP switch 133 or the DOWN switch 133.

In operation, the operator operates either one of the UP switch and DOWN switch 133 to select an adequate voltage in accordance with the kind of a sheet to be fed from a sheet cassette, not shown, or a manual feed tray not shown. For example, when use is made of a sheet with a rough surface, a highly absorptive sheet, a non-coated sheet or a sheet coated little, the operator selects a relatively high voltage or sweep bias (e.g. 600 V) because a relatively large amount of developer should be deposited. On the other hand, when a sheet with a smooth surface, a sheet lacking absoptivity or a sheet sufficiently coated is used, the operator selects a relatively low sweep bias (e.g. 300 V) because a relatively small amount of developer is desirable from the image quality standpoint. To facilitate such selection of a sweep voltage, the level indicators 134 may additionally display the kind of sheets each corresponding to a particular voltage.

Figure 31:
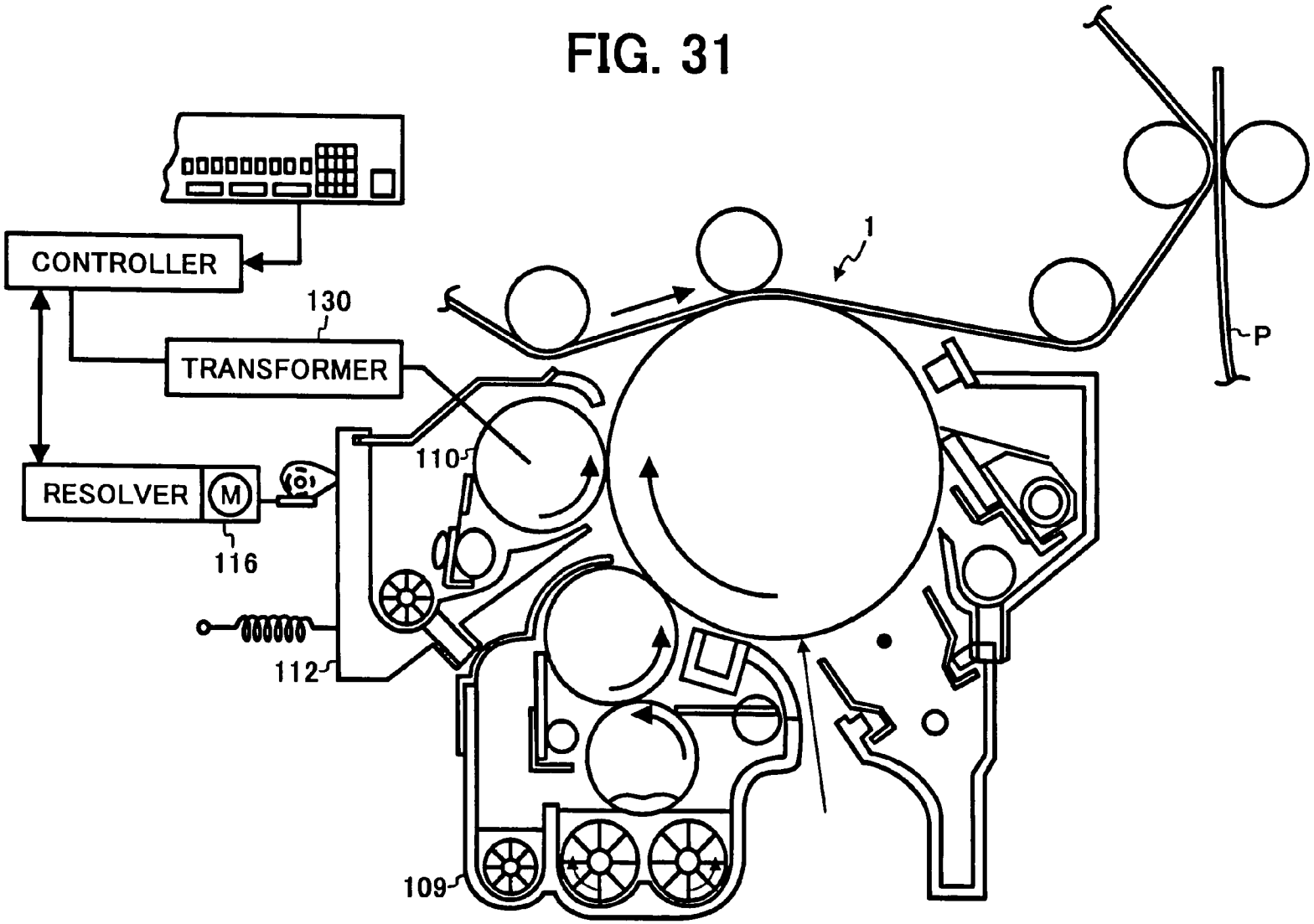
FIG. 31 is a fragmentary view showing a combination of any one of Examples 1 through 3 and Example 4 of the third embodiment.

Any one of Examples 1 through 3 may be combined with Example 4 for controlling the amount of carrier liquid to be removed more delicately in accordance with the kind of a sheet to be used. FIG. 31 shows a specific configuration that switches the sweep bias and nip width at the same time in accordance with the property of a sheet.

EXAMPLE 5

Figure 32:
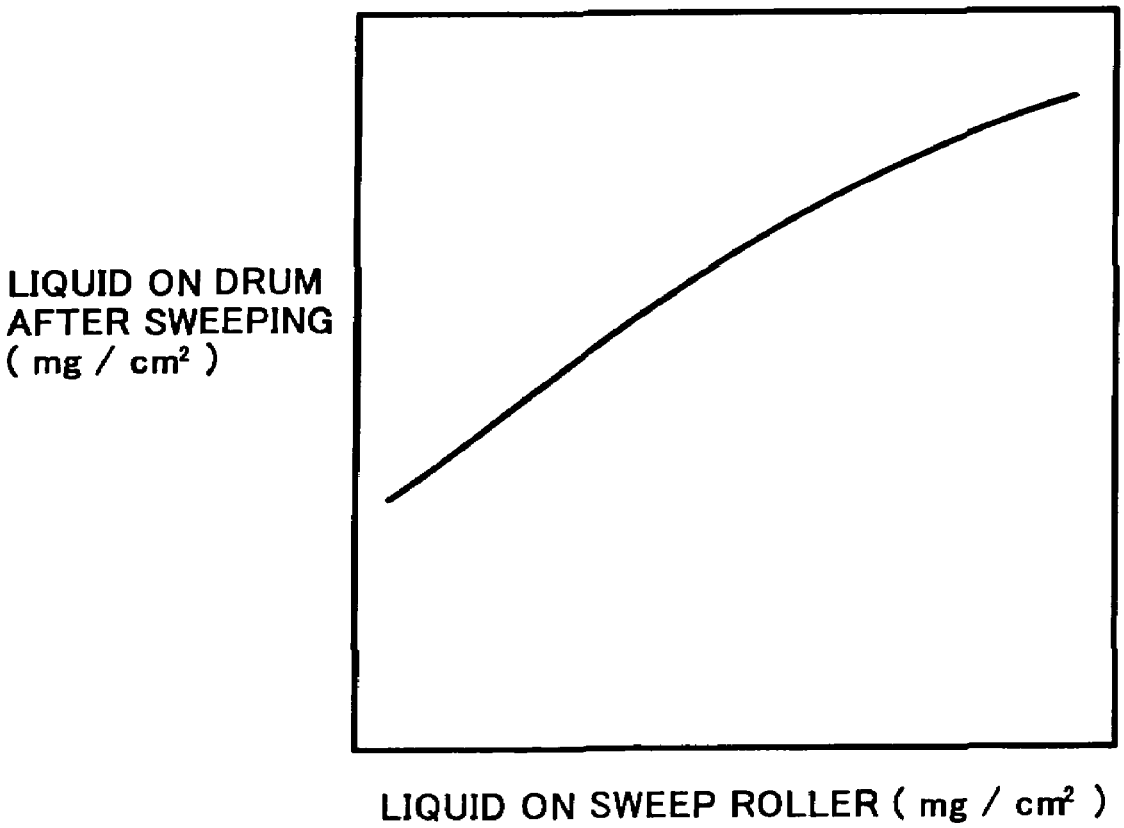
FIG. 32 is a graph showing a relation between the amount of liquid to deposit on the sweep roller and the amount of liquid left on the drum after sweeping.

FIG. 32 shows a relation between the amount of liquid to deposit on the sweep roller and the amount of liquid to remain on the drum after sweeping, as determined by experiments. As shown, when the amount of liquid deposited on the sweep roller is small, the amount of liquid to be removed from the drum is large, and therefore the amount of liquid to remain on the drum after sweeping is small. On the other hand, when the amount of liquid deposited on the sweep roller is large, the amount of liquid to be removed from the drum is small, and therefore the amount of liquid to remain on the drum after sweeping is large. That is, if the developer removed from the drum remains on the sweep roller, then the amount of developer to be removed from the drum when the sweep roller in rotation again contacts the drum is reduced. Paying attention to this point, we found that by varying the force of, e.g., a cleaning blade acting on the sweep roller to remove the excess liquid from the sweep roller, it was possible to vary the force of the sweep roller acting on the drum to remove the excess liquid.

Figure 33A:
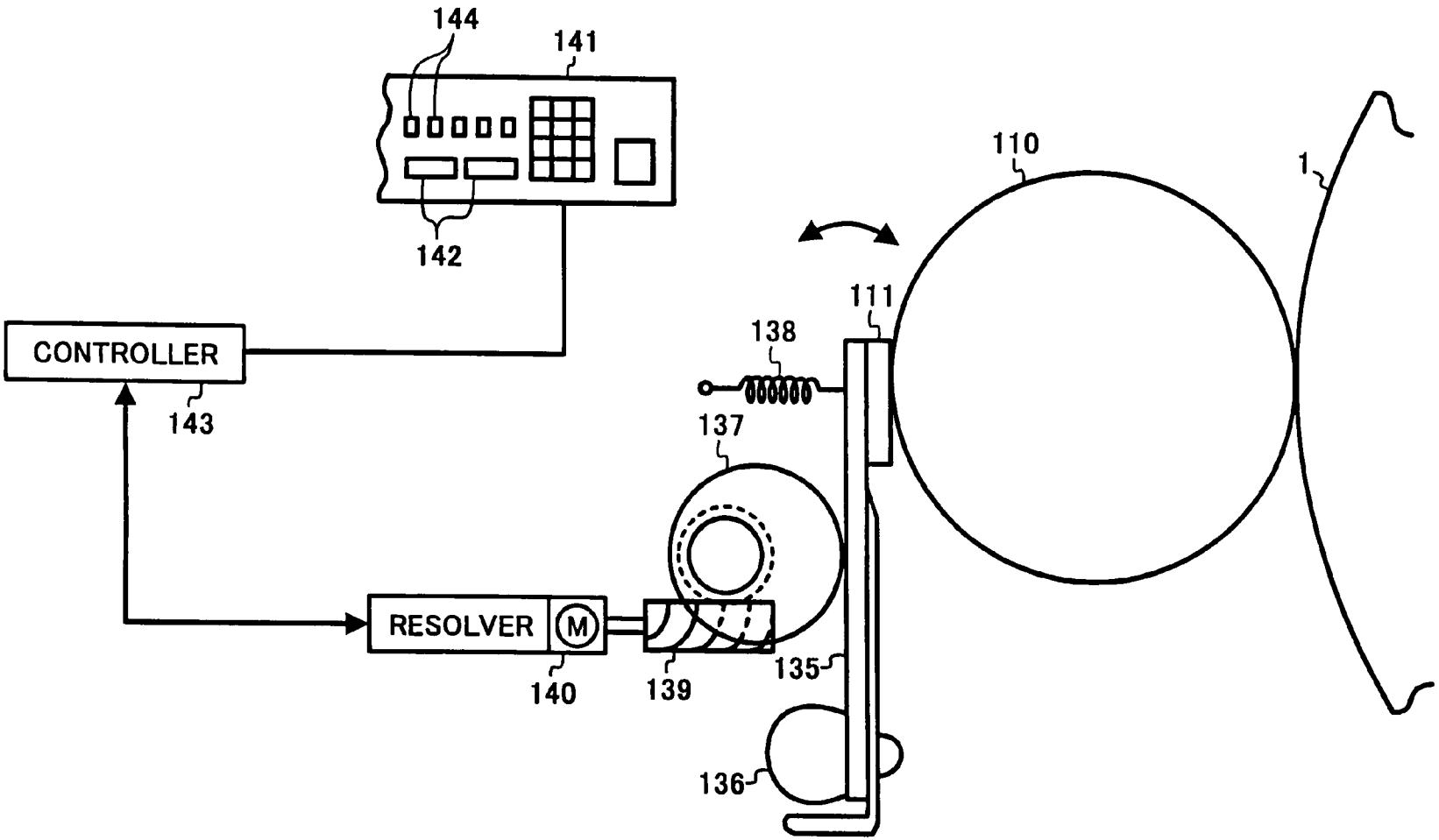
FIG. 33A is a fragmentary view showing an image forming apparatus representative of Example 5 of the third embodiment.

Example 5 to be described uses a cleaning blade for controlling the amount of excess liquid to deposit on the sweep roller and switches the pressure of the cleaning blade acting on the sweep roller. Specifically, as shown in FIG. 33A, a cleaning blade 111 is mounted on a bracket 135, which is angularly movable about a shaft 136. An eccentric cam 137 causes the bracket 135 and therefor the cleaning blade 111 to angularly move in the right-and-left direction within a preselected range. FIG. 33A shows the cleaning blade 111 moved to the rightmost position and relatively heavily pressed against the sweep roller 110.

A tension spring 138 constantly pulls the bracket 135 to the left, as viewed in the FIG. 33A. When the eccentric cam 137 is rotated, it causes the cleaning blade 111 to angularly move together with the bracket 135 with the result that the pressure acting on the sweep roller 110 varies. A stepping motor 140 so drives the eccentric cam 137 via a worm gear 139. A controller 143 controls the stepping motor 140 in accordance with a command input on either one of pressure switches 142 provided on an operation panel 141.

The operator operates either one of the pressure switches 142 to select a desired pressure of the cleaning blade 111 to act on the sweep roller 110 in accordance with the kind of a sheet to be used. For example, when use is made of a sheet with a rough surface, a highly absorptive sheet, a non-coated sheet or a sheet coated little, the operator selects a relatively low pressure because a relatively large amount of developer should be deposited. On the other hand, when a sheet with a smooth surface, a sheet lacking absoptivity or a sheet sufficiently coated is used, the operator selects a relatively high pressure because a relatively small amount of developer is desirable from the image quality standpoint. To facilitate such selection of a sweep voltage, level indicators 144 may additionally display the kind of sheets each corresponding to a particular pressure.

Figure 33B:
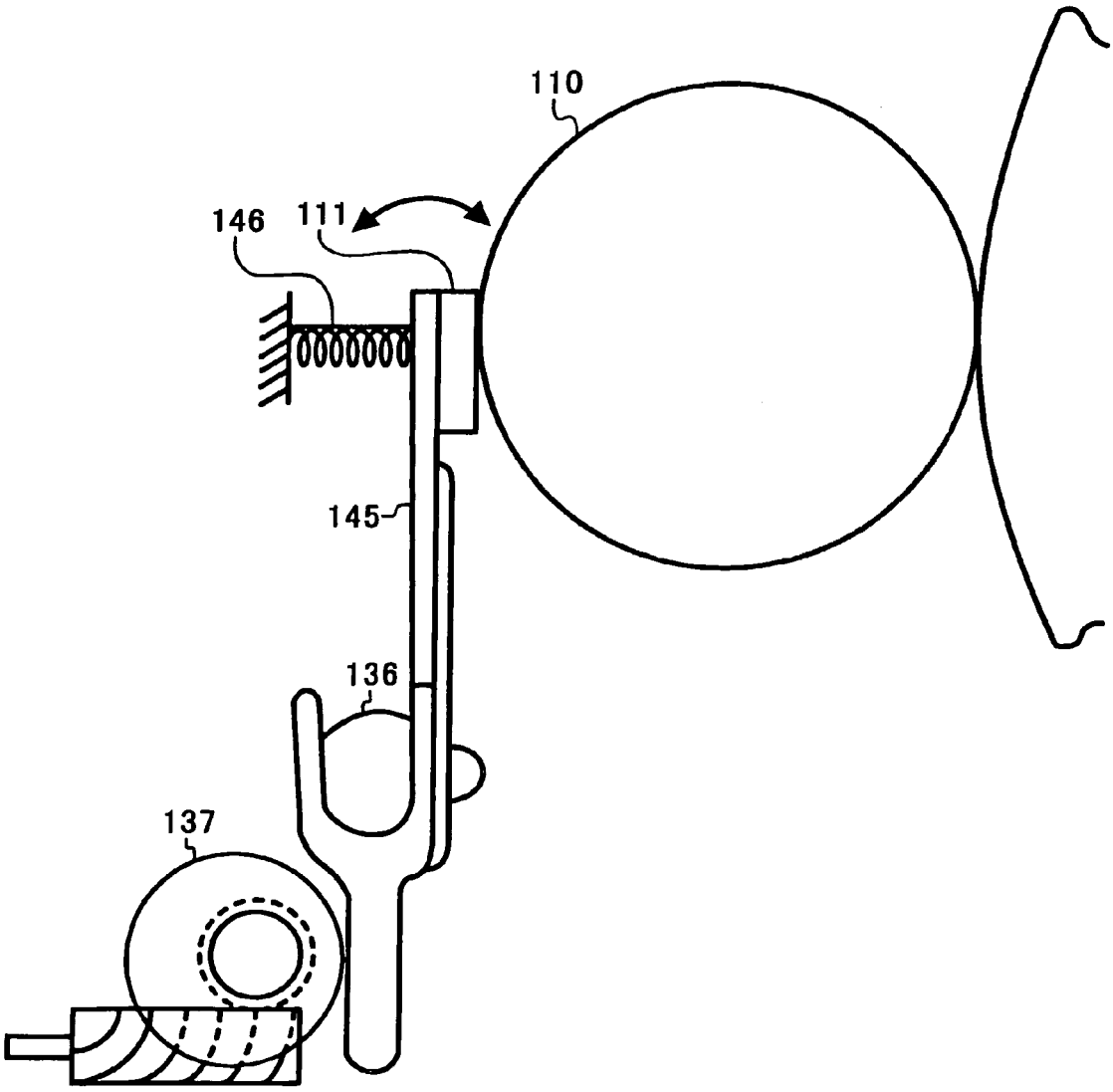
FIG. 33B shows another specific configuration of a cleaning blade included in the apparatus of Example 5.

FIG. 33B shows another specific configuration for supporting the cleaning blade 111. As shown, a compression spring 146 constantly biases a bracket 145 to the right, as viewed in FIG. 33B. The eccentric cam 137 contacts the end of the bracket 145 located at the opposite side tot he cleaning blade 111 with respect to the shaft 136. The eccentric cam 137 causes the cleaning blade 111 to angularly move together with the bracket 135 when rotated, thereby varying the pressure of the cleaning blade 111 acting on the sweep roller 110.

Any one of Examples 1 through 3 and/or Example 4 may be combined with Example 5, if desired.

As stated above, in the illustrative embodiment, an excess liquid removing member remains in contact with an image carrier and can easily remove a highly viscous, dense developing liquid from the image carrier, compared to, e.g., compressed air to be sent via a slit nozzle. Further, the excess liquid removing member makes it unnecessary to maintain high mechanical accuracy, compared to a squeeze roller spaced from the latent image. Moreover, the removing force of the excess liquid removing member is variable in accordance with the property of a sheet to be used, so that the excess liquid can be removed only by an adequate amount. The illustrative embodiment therefore insures attractive images free from defective transfer, the thickening of characters, the blur of a trailing edge and other defects.

Various modifications will become possible for those skilled in the art after receiving the teachings of the present disclosure without departing from the scope thereof.

What is claimed is:

1. An image forming apparatus using a high viscosity, high density developing liquid comprising a carrier liquid and toner dispersed in said carrier liquid, said image forming apparatus comprising:

an image carrier;

latent image forming means for forming a latent image on said image carrier;

developing means for developing the latent image with the developing liquid to thereby produce a corresponding toner image;

excess liquid removing means for removing an excess developing liquid from said image carrier after development to thereby regulate a film thickness; and image transferring means for transferring the toner image from said image carrier to a recording medium; said excess liquid removing means comprising:

a removing member held in contact with said image carrier and having a surface movable at substantially the same speed as a surface of said image carrier;

varying means for varying a liquid removing force of said removing means; and control means for controlling said varying means in accordance with a property of the recording medium, wherein said developing means for developing includes means for applying a predetermined development electric field for a predetermined developing time so as to cause a predetermined amount of toner to be deposited, wherein said removing member comprises a plurality of removing members, and said varying means comprises moving means for selectively moving at least one of said plurality of removing members into or out of contact with said image carrier.

2. The apparatus as claimed in claim 1, wherein at least one of said removing member and said image carrier has an elastic layer on a surface thereof, and said varying means comprises pressure switching means for switching a pressure that presses said removing member against said image carrier.

3. The apparatus as claimed in claim 2, wherein said varying means comprises bias applying means configured to apply to said removing member an electric field that attracts excess toner floating between a background of said image carrier and said removing member toward said removing member, but does not peel off the toner deposited on an image portion of said image carrier, said bias applying means being capable of switching a size of said electric field.

4. The apparatus as claimed in claim 3, further comprising a cleaning member for cleaning the excess liquid from said removing member, wherein said varying means comprising cleaning member pressure switching means for switching a pressure that presses said cleaning member against said removing member.

5. An image forming apparatus using a high viscosity, high density developing liquid comprising a carrier liquid and toner dispersed in said carrier liquid, said image forming apparatus comprising:

an image carrier;

latent image forming means for forming a latent image on said image carrier;

developing means for developing the latent image with the developing liquid to thereby produce a corresponding toner image;

excess liquid removing means for removing an excess developing liquid from said image carrier after development to thereby regulate a film thickness; and image transferring means for transferring the toner image from said image carrier to a recording medium; said excess liquid removing means comprising:

a removing member held in contact with said image carrier and having a surface movable at substantially the same speed as a surface of said image carrier;

varying means for varying a liquid removing force of said removing means; and control means for controlling said varying means in accordance with a property of the recording medium, wherein said developing means for developing includes means for applying a predetermined development electric field for a predetermined developing time so as to cause a predetermined amount of toner to be deposited, wherein at least one of said removing member and said image carrier has an elastic layer on a surface thereof, and said varying means comprises pressure switching means for switching a pressure that presses said removing member against said image carrier.

6. The apparatus as claimed in claim 5, wherein said varying means comprises bias applying means configured to apply to said removing member an electric field that attracts excess toner floating between a background of said image carrier and said removing member toward said removing member, but does not peel off the toner deposited on an image portion of said image carrier, said bias applying means being capable of switching a size of said electric field.

7. The apparatus as claimed in claim 6, further comprising a cleaning member for cleaning the excess liquid from said removing member, wherein said varying means comprising cleaning member pressure switching means for switching a pressure that presses said cleaning member against said removing member.

8. An image forming apparatus using a high viscosity, high density developing liquid comprising a carrier liquid and toner dispersed in said carrier liquid, said image forming apparatus comprising:

an image carrier;

latent image forming means for forming a latent image on said image carrier;

developing means for developing the latent image with the developing liquid to thereby produce a corresponding toner image;

excess liquid removing means for removing an excess developing liquid from said image carrier after development to thereby regulate a film thickness; and image transferring means for transferring the toner image from said image carrier to a recording medium; said excess liquid removing means comprising:

a removing member held in contact with said image carrier and having a surface movable at substantially the same speed as a surface of said image carrier;

varying means for varying a liquid removing force of said removing means; and control means for controlling said varying means in accordance with a property of the recording medium, wherein said developing means for developing includes means for applying a predetermined development electric field for a predetermined developing time so as to cause a predetermined amount of toner to be deposited, wherein said removing member comprises an endless belt, and said varying means comprises nip width switching means for switching a width of a removal nip over which said endless belt and said image carrier contact each other.

9. The apparatus as claimed in claim 8, wherein said varying means comprises bias applying means configured to apply to said removing member an electric field that attracts excess toner floating between a background of said image carrier and said removing member toward said removing member, but does not peel off the toner deposited on an image portion of said image carrier, said bias applying means being capable of switching a size of said electric field.

10. The apparatus as claimed in claim 9, further comprising a cleaning member for cleaning the excess liquid from said removing member, wherein said varying means comprising cleaning member pressure switching means for switching a pressure that presses said cleaning member against said removing member.

11. An image forming apparatus using a high viscosity, high density developing liquid comprising a carrier liquid and toner dispersed in said carrier liquid, said image forming apparatus comprising:

an image carrier;

latent image forming means for forming a latent image on said image carrier;

developing means for developing the latent image with the developing liquid to thereby produce a corresponding toner image;

excess liquid removing means for removing an excess developing liquid from said image carrier after development to thereby regulate a film thickness; and image transferring means for transferring the toner image from said image carrier to a recording medium; said excess liquid removing means comprising:

a removing member held in contact with said image carrier and having a surface movable at substantially the same speed as a surface of said image carrier;

varying means for varying a liquid removing force of said removing means; and control means for controlling said varying means in accordance with a property of the recording medium, wherein said developing means for developing includes means for applying a predetermined development electric field for a predetermined developing time so as to cause a predetermined amount of toner to be deposited, wherein said varying means comprises bias applying means configured to apply to said removing member an electric field that attracts excess toner floating between a background of said image carrier and said removing member toward said removing member, but does not peel off the toner deposited on an image portion of said image carrier, said bias applying means being capable of switching a size of said electric field, further comprising a cleaning member for cleaning the excess liquid from said removing member, wherein said varying means comprising cleaning member pressure switching means for switching a pressure that presses said cleaning member against said removing member.

12. An image forming apparatus using a high viscosity, high density developing liquid comprising a carrier liquid and toner dispersed in said carrier liquid, said image forming apparatus comprising:

an image carrier;

latent image forming means for forming a latent image on said image carrier;

developing means for developing the latent image with the developing liquid to thereby produce a corresponding toner image;

excess liquid removing means for removing an excess developing liquid from said image carrier after development to thereby regulate a film thickness; and image transferring means for transferring the toner image from said image carrier to a recording medium; said excess liquid removing means comprising:

a removing member held in contact with said image carrier and having a surface movable at substantially the same speed as a surface of said image carrier;

varying means for varying a liquid removing force of said removing means; and control means for controlling said varying means in accordance with a property of the recording medium, wherein said developing means for developing includes means for applying a predetermined development electric field for a predetermined developing time so as to cause a predetermined amount of toner to be deposited, further comprising a cleaning member for cleaning the excess liquid from said removing member, wherein said varying means comprising cleaning member pressure switching means for switching a pressure that presses said cleaning member against said removing member.

13. An image forming apparatus using a high viscosity, high density developing liquid comprising a carrier liquid and toner dispersed in said carrier liquid, said image forming apparatus comprising:

an image carrier;

latent image forming device configured to form a latent image on said image carrier;

a developer configured to develop the latent image with the developing liquid to thereby produce a corresponding toner image;

excess liquid removing device configured to remove an excess developing liquid from said image carrier after development to thereby regulate a film thickness; and image transfer device configured to transfer the toner image from said image carrier to a recording medium; said excess liquid removing device comprising:

a removing member held in contact with said image carrier and having a surface movable at substantially the same speed as a surface of said image carrier;

a force varying device configured to vary a liquid removing force of said removing device; and a controller configure to control said force varying device in accordance with a property of the recording medium, wherein said developing device includes a field control device configured to apply a predetermined development electric field for a predetermined developing time so as to cause a predetermined amount of toner to be deposited, wherein said removing member comprises a plurality of removing members, and said force varying device comprises a moving device configured to selectively moving at least one of said plurality of removing members into or out of contact with said image carrier.

14. The apparatus as claimed in claim 13, wherein at least one of said removing member and said image carrier has an elastic layer on a surface thereof, and said force varying device comprises a pressure switching device configure to switch a pressure that presses said removing member against said image carrier.

15. The apparatus as claimed in claim 14, wherein said force varying device comprises a bias applying device configured to apply to said removing member an electric field that attracts excess toner floating between a background of said image carrier and said removing member toward said removing member, but does not peel off the toner deposited on an image portion of said image carrier, said bias applying device being capable of switching a size of said electric field.

16. The apparatus as claimed in claim 15, further comprising a cleaning member for cleaning the excess liquid from said removing member, wherein said force varying device comprises a cleaning member pressure switch configured to switch a pressure that presses said cleaning member against said removing member.

17. An image forming apparatus using a high viscosity, high density developing liquid comprising a carrier liquid and toner dispersed in said carrier liquid, said image forming apparatus comprising:

an image carrier;

latent image forming device configured to form a latent image on said image carrier;

a developer configured to develop the latent image with the developing liquid to thereby produce a corresponding toner image;

excess liquid removing device configured to remove an excess developing liquid from said image carrier after development to thereby regulate a film thickness; and image transfer device configured to transfer the toner image from said image carrier to a recording medium; said excess liquid removing device comprising:

a removing member held in contact with said image carrier and having a surface movable at substantially the same speed as a surface of said image carrier;

a force varying device configured to vary a liquid removing force of said removing device; and a controller configure to control said force varying device in accordance with a property of the recording medium, wherein said developing device includes a field control device configured to apply a predetermined development electric field for a predetermined developing time so as to cause a predetermined amount of toner to be deposited, wherein at least one of said removing member and said image carrier has an elastic layer on a surface thereof, and said force varying device comprises a pressure switch configured to switch a pressure that presses said removing member against said image carrier.

18. The apparatus as claimed in claim 17, wherein said force varying device comprises a bias applying device configured to apply to said removing member an electric field that attracts excess toner floating between a background of said image carrier and said removing member toward said removing member, but does not peel off the toner deposited on an image portion of said image carrier, said bias applying device being capable of switching a size of said electric field.

19. The apparatus as claimed in claim 18, further comprising a cleaning member for cleaning the excess liquid from said removing member, wherein said force varying device comprises a cleaning member pressure switch configured to switch a pressure that presses said cleaning member against said removing member.

20. An image forming apparatus using a high viscosity, high density developing liquid comprising a carrier liquid and toner dispersed in said carrier liquid, said image forming apparatus comprising:

an image carrier;

latent image forming device configured to form a latent image on said image carrier;

a developer configured to develop the latent image with the developing liquid to thereby produce a corresponding toner image;

excess liquid removing device configured to remove an excess developing liquid from said image carrier after development to thereby regulate a film thickness; and image transfer device configured to transfer the toner image from said image carrier to a recording medium; said excess liquid removing device comprising:

a removing member held in contact with said image carrier and having a surface movable at substantially the same speed as a surface of said image carrier;

a force varying device configured to vary a liquid removing force of said removing device; and a controller configure to control said force varying device in accordance with a property of the recording medium, wherein said developing device includes a field control device configured to apply a predetermined development electric field for a predetermined developing time so as to cause a predetermined amount of toner to be deposited, wherein said removing member comprises an endless belt, and said force varying device comprises a nip width switch configured to switch a width of a removal nip over which said endless belt and said image carrier contact each other.

21. The apparatus as claimed in claim 20, wherein said force varying device comprises a bias applying device configured to apply to said removing member an electric field that attracts excess toner floating between a background of said image carrier and said removing member toward said removing member, but does not peel off the toner deposited on an image portion of said image carrier, said bias applying device being capable of switching a size of said electric field.

22. The apparatus as claimed in claim 21, further comprising a cleaning member for cleaning the excess liquid from said removing member, wherein said force varying device comprises a cleaning member pressure switch configured to switch a pressure that presses said cleaning member against said removing member.

23. An image forming apparatus using a high viscosity, high density developing liquid comprising a carrier liquid and toner dispersed in said carrier liquid, said image forming apparatus comprising:

an image carrier;

latent image forming device configured to form a latent image on said image carrier;

a developer configured to develop the latent image with the developing liquid to thereby produce a corresponding toner image;

excess liquid removing device configured to remove an excess developing liquid from said image carrier after development to thereby regulate a film thickness; and image transfer device configured to transfer the toner image from said image carrier to a recording medium; said excess liquid removing device comprising:

a removing member held in contact with said image carrier and having a surface movable at substantially the same speed as a surface of said image carrier;

a force varying device configured to vary a liquid removing force of said removing device; and a controller configure to control said force varying device in accordance with a property of the recording medium, wherein said developing device includes a field control device configured to apply a predetermined development electric field for a predetermined developing time so as to cause a predetermined amount of toner to be deposited, wherein said force varying device comprises a bias applying device configured to apply to said removing member an electric field that attracts excess toner floating between a background of said image carrier and said removing member toward said removing member, but does not peel off the toner deposited on an image portion of said image carrier, said bias applying device being capable of switching a size of said electric field, further comprising a cleaning member for cleaning the excess liquid from said removing member, wherein said force varying device comprises a cleaning member pressure switch configured to switch a pressure that presses said cleaning member against said removing member.

24. An image forming apparatus using a high viscosity, high density developing liquid comprising a carrier liquid and toner dispersed in said carrier liquid, said image forming apparatus comprising:

an image carrier;

latent image forming device configured to form a latent image on said image carrier;

a developer configured to develop the latent image with the developing liquid to thereby produce a corresponding toner image;

excess liquid removing device configured to remove an excess developing liquid from said image carrier after development to thereby regulate a film thickness; and image transfer device configured to transfer the toner image from said image carrier to a recording medium; said excess liquid removing device comprising:

a removing member held in contact with said image carrier and having a surface movable at substantially the same speed as a surface of said image carrier;

a force varying device configured to vary a liquid removing force of said removing device; and a controller configure to control said force varying device in accordance with a property of the recording medium, wherein said developing device includes a field control device configured to apply a predetermined development electric field for a predetermined developing time so as to cause a predetermined amount of toner to be deposited, further comprising a cleaning member for cleaning the excess liquid from said removing member, wherein said force varying device comprising a cleaning member pressure switch configured to switch a pressure that presses said cleaning member against said removing member.

25. A method of forming an image using a high viscosity, high density developing liquid comprising a carrier liquid and toner dispersed in said carrier liquid, said method comprising:

forming a latent image on an image carrier;

developing the latent image with the developing liquid to thereby produce a corresponding toner image;

removing with a removing member an excess developing liquid from said image carrier after development to thereby regulate a film thickness; and transferring the toner image from said image carrier to a recording medium; said step of removing comprising:

varying a liquid removing force of said removing member held in contact with said image carrier and having a surface movable at substantially the same speed as a surface of said image carrier; and controlling said step of varying in accordance with a property of the recording medium, wherein said step of developing includes applying a predetermined development electric field for a predetermined developing time so as to cause a predetermined amount of toner to be deposited, wherein said step of removing comprises removing with a plurality of removing members, and said step of varying comprises selectively moving at least one of said plurality of removing members into or out of contact with said image carrier.

26. The method as claimed in claim 25, wherein at least one of said removing member and said image carrier has an elastic layer on a surface thereof, and said step of varying comprises switching a pressure that presses said removing member against said image carrier.

27. The method as claimed in claim 26, wherein said step of varying comprises applying an electric field to said removing member, said electric field attracting excess toner floating between a background of said image carrier and said removing member toward said removing member, but does not peel off the toner deposited on an image portion of said image carrier, said step of applying an electric field comprising switching a size of said electric field.

28. The method as claimed in claim 27, further comprising cleaning the excess liquid from said removing member, wherein said step of varying comprises switching a pressure that presses said cleaning member against said removing member.

29. A method of forming an image using a high viscosity, high density developing liquid comprising a carrier liquid and toner dispersed in said carrier liquid, said method comprising:

forming a latent image on an image carrier;

developing the latent image with the developing liquid to thereby produce a corresponding toner image;

removing with a removing member an excess developing liquid from said image carrier after development to thereby regulate a film thickness; and transferring the toner image from said image carrier to a recording medium; said step of removing comprising:

varying a liquid removing force of said removing member held in contact with said image carrier and having a surface movable at substantially the same speed as a surface of said image carrier; and controlling said step of varying in accordance with a property of the recording medium, wherein said step of developing includes applying a predetermined development electric field for a predetermined developing time so as to cause a predetermined amount of toner to be deposited, wherein at least one of said removing member and said image carrier has an elastic layer on a surface thereof, and said step of varying comprises switching a pressure that presses said removing member against said image carrier.

30. The method as claimed in claim 29, wherein said step of varying comprises applying an electric field to said removing member, said electric field attracting excess toner floating between a background of said image earner and said removing member toward said removing member, but does not peel off the toner deposited on an image portion of said image carrier, said step of applying an electric field comprising switching a size of said electric field.

31. The method as claimed in claim 30, further comprising cleaning excess liquid from said removing member, wherein said step of varying comprising switching a pressure that presses said cleaning member against said removing member.

32. A method of forming an image using a high viscosity, high density developing liquid comprising a carrier liquid and toner dispersed in said carrier liquid, said method comprising:

forming a latent image on an image carrier;

developing the latent image with the developing liquid to thereby produce a corresponding toner image;

removing with a removing member an excess developing liquid from said image carrier after development to thereby regulate a film thickness; and transferring the toner image from said image carrier to a recording medium; said step of removing comprising:

varying a liquid removing force of said removing member held in contact with said image carrier and having a surface movable at substantially the same speed as a surface of said image carrier; and controlling said step of varying in accordance with a property of the recording medium, wherein said step of developing includes applying a predetermined development electric field for a predetermined developing time so as to cause a predetermined amount of toner to be deposited, wherein said removing member comprises an endless belt, and said step of varying comprises switching a width of a removal nip over which said endless belt and said image carrier contact each other.

33. The method as claimed in claim 32, wherein said step of varying comprises applying an electric field to said removing member, said electric field attracting excess toner floating between a background of said image carrier and said removing member toward said removing member, but does not peel off the toner deposited on an image portion of said image carrier, said step of applying an electric field comprising switching a size of said electric field.

34. The method as claimed in claim 33, further comprising cleaning excess liquid from said removing member, wherein said step of varying comprises switching a pressure that presses said cleaning member against said removing member.

35. A method of forming an image using a high viscosity, high density developing liquid comprising a carrier liquid and toner dispersed in said carrier liquid, said method comprising:

forming a latent image on an image carrier;

developing the latent image with the developing liquid to thereby produce a corresponding toner image;

removing with a removing member an excess developing liquid from said image carrier after development to thereby regulate a film thickness; and transferring the toner image from said image carrier to a recording medium; said step of removing comprising:

varying a liquid removing force of said removing member held in contact with said image carrier and having a surface movable at substantially the same speed as a surface of said image carrier; and controlling said step of varying in accordance with a property of the recording medium, wherein said step of developing includes applying a predetermined development electric field for a predetermined developing time so as to cause a predetermined amount of toner to be deposited, wherein said step of varying comprises applying an electric field to said removing member, said electric field attracting excess toner floating between a background of said image carrier and said removing member toward said removing member, but does not peel off the toner deposited on an image portion of said image carrier, said step of applying an electric field comprising switching a size of said electric field, further comprising cleaning the excess liquid from said removing member, wherein said step of varying comprises cleaning switching a pressure that presses said cleaning member against said removing member.

36. A method of forming an image using a high viscosity, high density developing liquid comprising a carrier liquid and toner dispersed in said carrier liquid, said method comprising:

forming a latent image on an image carrier;

developing the latent image with the developing liquid to thereby produce a corresponding toner image;

removing with a removing member an excess developing liquid from said image carrier after development to thereby regulate a film thickness; and transferring the toner image from said image carrier to a recording medium; said step of removing comprising:

varying a liquid removing force of said removing member held in contact with said image carrier and having a surface movable at substantially the same speed as a surface of said image carrier; and controlling said step of varying in accordance with a property of the recording medium, wherein said step of developing includes applying a predetermined development electric field for a predetermined developing time so as to cause a predetermined amount of toner to be deposited, further comprising cleaning the excess liquid from said removing member, wherein said step of varying comprises switching a pressure that presses said cleaning member against said removing member.

* * * * *